US008382267B2

(12) United States Patent
Watanabe et al.

(10) Patent No.: US 8,382,267 B2
(45) Date of Patent: Feb. 26, 2013

(54) LIQUID CONTAINER, LIQUID SUPPLYING SYSTEM AND CIRCUIT BOARD FOR LIQUID CONTAINER

(75) Inventors: Kenjiro Watanabe, Tokyo (JP); Haruyuki Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/246,778

(22) Filed: Sep. 27, 2011

(65) Prior Publication Data

US 2012/0033023 A1 Feb. 9, 2012

Related U.S. Application Data

(62) Division of application No. 11/911,913, filed as application No. PCT/JP2006/311472 on Jun. 1, 2006, now Pat. No. 8,075,114.

(30) Foreign Application Priority Data

Jun. 1, 2005 (JP) ..... 2005-161316

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS

| | | | | |
|---|---|---|---|---|
| 5,689,290 | A | 11/1997 | Saito et al. | 347/7 |
| 6,151,041 | A | 11/2000 | Bolash et al. | 347/19 |
| 6,302,535 | B1 | 10/2001 | Sturgeon et al. | 347/86 |
| 6,422,675 | B1 | 7/2002 | Tomomatsu | 347/7 |
| 6,641,240 | B2 | 11/2003 | Hsu et al. | 347/7 |
| 6,685,296 | B2 | 2/2004 | Mochizuki et al. | 347/19 |
| 6,760,119 | B1 | 7/2004 | Silverbrook et al. | 358/1.15 |
| 7,140,712 | B2 | 11/2006 | Naka et al. | 347/19 |
| 2001/0019343 | A1 * | 9/2001 | Walker et al. | 347/19 |
| 2001/0043246 | A1 | 11/2001 | Taneya et al. | 347/19 |
| 2002/0008722 | A1 | 1/2002 | Imanaka et al. | 347/14 |
| 2002/0008724 | A1 | 1/2002 | Kubota et al. | 347/19 |
| 2002/0033855 | A1 | 3/2002 | Kubota et al. | 347/19 |
| 2002/0063760 | A1 | 5/2002 | Dietl et al. | 347/86 |

(Continued)

FOREIGN PATENT DOCUMENTS

| | | |
|---|---|---|
| EP | 1114726 | 7/2001 |
| EP | 1234672 | 8/2002 |

(Continued)

OTHER PUBLICATIONS

International Search Report and Written Opinion dated Aug. 30, 2006 in counterpart PCT Application No. PCT/JP2006/311472.

(Continued)

*Primary Examiner* — Laura Martin
(74) *Attorney, Agent, or Firm* — Fitzpatrick, Cella, Harper & Scinto

(57) ABSTRACT

A liquid container detachably mountable to a recording apparatus to which a plurality of liquid containers are detachably mountable, wherein the recording apparatus includes an apparatus antenna and photoreceptor means, the liquid container includes a container antenna communicatable with the apparatus antenna without physical contact therebetween; an information storing portion capable of storing at least individual information of the liquid container; a light emitting portion; and a controller for controlling light emission of the light emitting portion in response to a correspondence between a signal indicative individual information supplied through the container antenna and the information stored in the information storing portion.

43 Claims, 54 Drawing Sheets

U.S. PATENT DOCUMENTS

| | | | | |
|---|---|---|---|---|
| 2003/0025743 | A1* | 2/2003 | Maeda | 347/7 |
| 2003/0063168 | A1 | 4/2003 | Kobayashi et al. | 347/86 |
| 2003/0128248 | A1 | 7/2003 | Kosugi | 347/19 |
| 2004/0247332 | A1 | 12/2004 | Kishi et al. | 399/67 |
| 2004/0252146 | A1 | 12/2004 | Naka et al. | 347/6 |
| 2005/0219303 | A1* | 10/2005 | Matsumoto et al. | 347/19 |
| 2007/0268325 | A1 | 11/2007 | Watanabe | 347/19 |

FOREIGN PATENT DOCUMENTS

| | | |
|---|---|---|
| EP | 1352747 | 10/2003 |
| EP | 1352748 | 10/2003 |
| JP | 57-51480 | 3/1982 |
| JP | 64-16207 | 1/1989 |
| JP | 4-275156 | 9/1992 |
| JP | 7-323573 | 12/1995 |
| JP | 2002-5724 | 1/2002 |
| JP | 2002-5818 | 1/2002 |
| JP | 2002-301829 | 10/2002 |
| JP | 2004-160995 | 6/2004 |
| JP | 2005-35104 | 2/2005 |
| RU | 2236947 | 9/2004 |
| TW | 503186 | 9/2002 |

OTHER PUBLICATIONS

Mexican Office Action dated Dec. 11, 2009 in corresponding Mexican Patent Application No. MX/a/2007/014591, and English language translation thereof.

Russian Decision on Grant dated Dec. 19, 2008, from corresponding Russian Application No. 2007148920/12(053642), and English language translation thereof.

Russian Decision on Grant dated Mar. 24, 2010, from corresponding Russian Application No. 2009110861/12(014733), and English language translation thereof.

Singapore Examination Report dated Dec. 1, 2008, from corresponding Singapore Application No. 200718229-8.

Taiwan IPO Search Report dated Dec. 30, 2007 in corresponding Taiwan Application No. 095119790, and English language translation thereof.

Ukraine Decision on Grant dated Jul. 15, 2008, from corresponding Ukranian Application No. 200714913, and English language translation thereof.

Substantive Examination Report from a Philippine counterpart application.

* cited by examiner (a)

(b)

(a)

(b)

LIQUID CONTAINER, LIQUID SUPPLYING SYSTEM AND CIRCUIT BOARD FOR LIQUID CONTAINER

This application is a division of application Ser. No. 11/911,913, filed Oct. 18, 2007 (pending), the contents of which are incorporated herein by reference, as if set forth here in full.

TECHNICAL FIELD

The present invention relates to a liquid container, a liquid supplying system comprising the container, a manufacturing method for the container, a circuit board for the container and a liquid containing cartridge. More particularly, the present invention relates to a liquid container which is usable with ink jet recording and which is capable of notifying a state of the liquid container such as a remaining ink amount of the ink container, by light emitting means such as a LED, to a liquid supplying system comprising the container, to a manufacturing method of the container, to a circuit board for the container, and to a liquid containing cartridge comprising the container.

BACKGROUND ART

With recent wider use of digital camera, the demand is increasing for printing with the digital camera being directly connected with a printer (recording device), that is, non-PC printing. Another increasing demand is for printing by setting a card type information memory medium detachably mountable to a digital camera directly in a printer to transfer the data, and printing them (another non-PC recording). Generally, the ink remaining amount in the ink container of the printer is checked on a display through a personal computer. In the case of the non-PC printing, this is not possible. However, capability of checking the ink remaining amount in the ink container is desired even in the non-PC printing. This is because if the user can be aware of the fact that ink remaining amount in the ink container is small, the user can exchange the ink container with a fresh one prior to stating printing operation, so that printing failure during the course of printing operation on a sheet can be avoided.

It is conventional to notify the user of such a state of the ink container using a display element such as a LED. For example, Japanese Laid-open Patent Application Hei 4-275156 discloses that ink container which is integral with a recording head is provided with two LED elements, which are switched on depending on the ink remaining amount in two steps. Japanese Laid-open Patent Application 2002-301829 also discloses that ink container is provided with a lamp which is switched on depending on the ink remaining amount. The same also discloses that four ink containers used with one recording device are provided with said lamps, respectively.

In addition, in order to meet a demand for high image quality, light magenta ink, light cyan ink and so on become used in addition to the conventional four color (black, yellow, magenta and cyan) inks. Furthermore, uses of special color inks such as red ink or blue ink are proposed. In such a case, seven-eight color ink containers are used individually in an ink jet printer. Then, a mechanism for preventing the ink containers from being mounted at erroneous positions is desired. U.S. Pat. No. 6,302,535 discloses that engaging configurations between the carriage and the ink containers are made different from each other. By doing so, erroneous mounting (incorrect position) is prevented, when the ink containers are mounted on the carriage.

Even when the ink container is provided with a lamp, as described above, the main assembly side controller has to identify the ink container which is recognized as containing a small amount of the ink. To do this, it is necessary to identify the ink container for which the signal for turning the right lamp on. If, for example, the ink container is mounted on a wrong position, there is a liability that small ink remaining amount is displayed for another ink container which contains a sufficient amount of the ink. Therefore, the emission control for the displaying device such as a lamp has to have correct information of the carried positions of the ink containers.

As to a structure for assuring the correct carried positions of the ink containers, there is a structure in which the mutual configuration relations between the carrying portions and the associated ink containers are made different depending on the carrying positions. However, in such a case, it is required to manufacture ink containers which are different depending on the color and/or kind of the ink, with the result of disadvantages in terms of manufacturing efficiency and/or cost.

As another structure for accomplishing this, a signal line of a circuit which will be closed by connection between the electrical contact of the ink container and the main assembly side electrical contact at the carrying position of a carriage or the like, is provided substantially independently for each of the carrying positions. For example, the signal line for reading ink color information of an ink container out of the ink container, for controlling the actuation of a LED is provided for each of the carrying positions. With such a structure, if the read color information does not meet the carrying position, the erroneous mounting of the ink container is discriminated.

However, this structure results in increased number of signal lines. As mentioned hereinbefore, recent ink jet printers or the like use a greater number of kinds of inks to improve the print quality. The increase of the number of the signal lines increases the cost particularly in such printers. On the other hand, in order to reduce the number of wiring leads, it would be effective to employ a so-called common signal line using a bus connection, but simple use of such a common signal line as bus connection cannot determines the ink containers or the carrying positions of the ink containers.

DISCLOSURE OF THE INVENTION

Accordingly, it is a principal object of the present invention to provide a liquid container, a liquid supplying system comprising the container, a manufacturing method for the container, a circuit board for the container and a liquid containing cartridge, wherein light emission control of displaying devices such as LED are carried out through non-contact communication using a common antenna for a plurality of carrying positions for the ink containers. According to another aspect of the present invention, there is provided a liquid container, a liquid supplying system comprising the container, a manufacturing method for the container, a circuit board for the container and a liquid containing cartridge, wherein the light emission control for the displaying devices are effected on the basis of determination of the carried positions of the ink containers.

According to an aspect of the present invention, there is provided a liquid container detachably mountable to a recording apparatus to which a plurality of liquid containers are detachably mountable, wherein said recording apparatus includes an apparatus antenna and photoreceptor means, said liquid container comprising a container antenna communicatable with the apparatus antenna without physical contact therebetween; an information storing portion capable of storing at least individual information of said liquid container; a light emitting portion; and a controller for controlling light emission of said light emitting portion in response to a correspondence between a signal indicative individual information supplied through said container antenna and said information stored in said information storing portion.

According to another aspect of the present invention, there is provided a liquid container detachably mountable to a recording apparatus to which a plurality of liquid containers are detachably mountable, wherein said recording apparatus includes an apparatus antenna and photoreceptor means, said liquid container comprising a container antenna communicatable with the apparatus antenna without physical contact therebetween; an information storing portion capable of storing at least individual information of said liquid container; a light emitting portion for emitting light toward the photoreceptor means; and a controller for controlling emission of light of said light emitting portion when information indicated by a signal indicative of individual information supplied through said container antenna and said information stored in said information storing means, are the same.

With such a structure, the light emission of the light emitting portion can be controlled both on the signal inputted through the antenna of the ink container (liquid container) communicatable with the antenna provided in the recording apparatus side and on the information of the ink container. Even if the carried ink containers receive the same control signal through the wireless communication using the common main assembly antenna, only the ink container that meets the information can carry out the light emission control. By doing so, the emission control of the light emitting portion is possible only for the ink container particularly determined. For example, when the carriage carrying the plurality of ink containers moves, the light emitting portion is actuated at a predetermined position, sequentially. With this, the light emission is detected at the predetermined position. Then, the ink container with which the light emission is not detected is recognized as being mounted at a wrong position. By doing so, the user may be prompted to remount the ink container to a right position, and in this manner, the respective carried positions of the ink containers can be detected.

As a result, the light emission control for the displaying device such as the LED through the wireless communication using the common main assembly antenna, for the carried positions of the ink containers, and the light emission control of the displaying device can be effected for the ink container the position of which is determined.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 21 is a detailed circuit diagram of the substrate having a controller or the like.

BEST MODE FOR CARRYING OUT THE INVENTION

Figure 1:
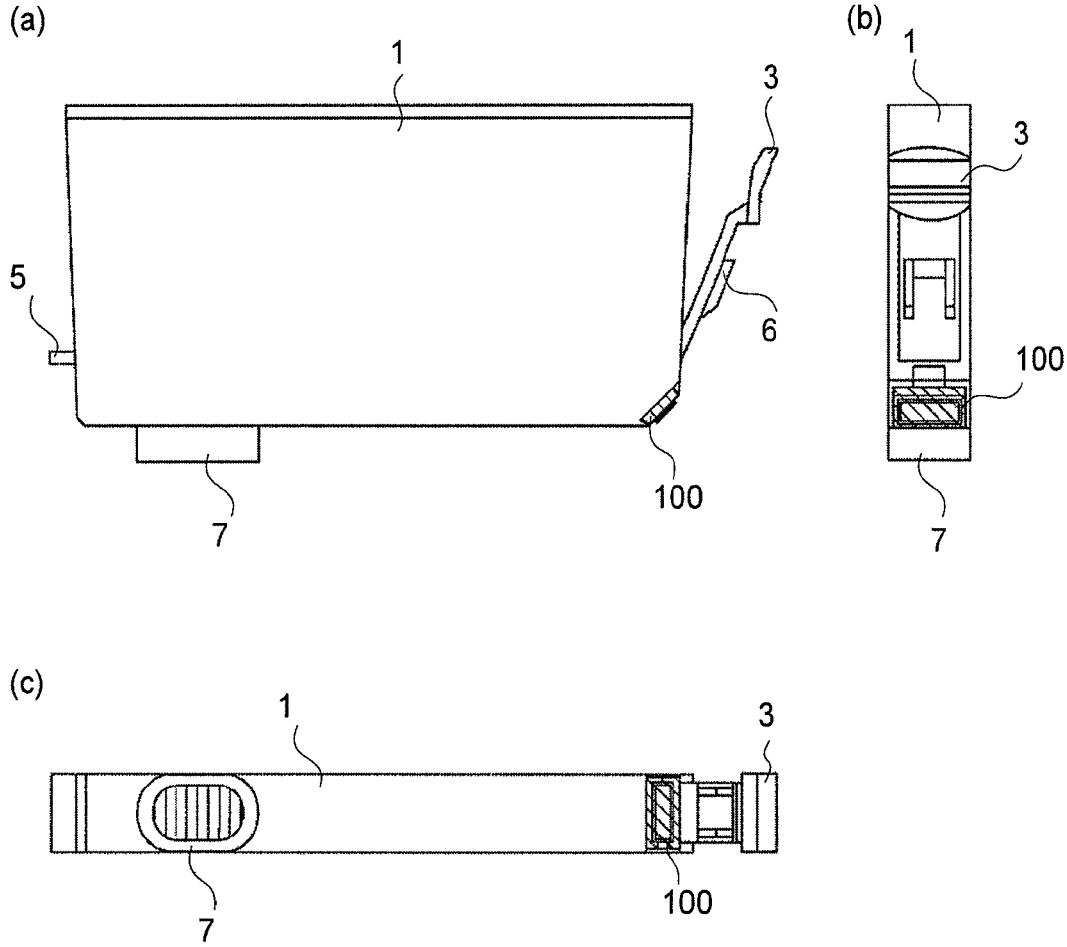
FIG. 1 is a side view (a), a front view (b) and a bottom view (c) of an ink container according to a first embodiment of the present invention.
Figure 2:
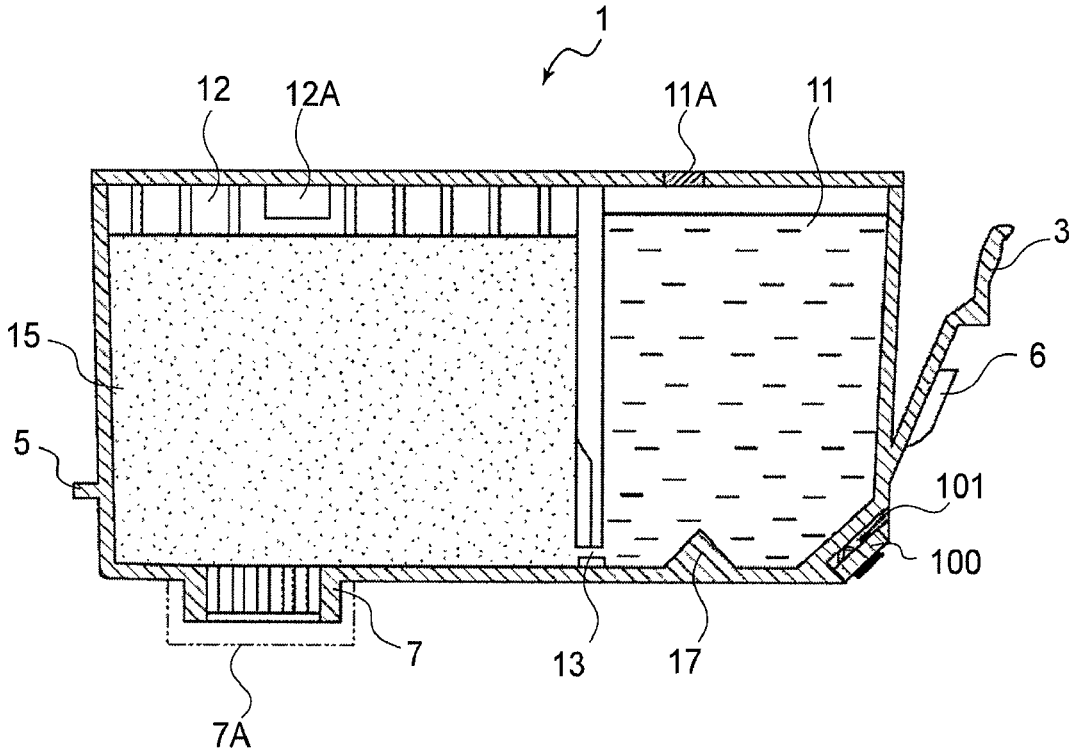
FIG. 2 is a sectional side elevation of the ink container according to the first embodiment of the present invention.

The description will be made as to the embodiments of the present invention in conjunction with the accompanying drawings, in the following order:

1. Mechanical Structure:
1.1 Ink Container:
1.2 Modified Example:
1.3 Ink Container Mounting Portion:
1.4 Recording Device:
2. Control System:
2.1 General Arrangement:
2.2 Connecting Portion:
2.3 Control Process:
3. Other Embodiments:
1. Mechanical Structure:
1.1 Ink Container (FIG. 1-FIG. 5):

FIG. 1 is a side view (a), a front view (b) and a bottom view (c) of an ink container according to a first embodiment of the present invention. FIG. 2 is a sectional side elevation of the ink container according to the first embodiment of the present invention. In the following descriptions, the front side of the ink container is the side which is faced to the user who is manipulating the ink container (mounting and demounting operation of the ink container), which provides the user with information (by light emission of LED which will be described hereinafter).

In FIG. 1, the ink container 1 of this embodiment has a supporting member 3 supported on the lower portion at the front side thereof. The supporting member 3 is made of resin material integrally molded with an outer casing of the ink container 1, and the ink container 1 is displaceable about a portion of the ink container to be supported when the ink container 1 is mounted to the container holder. The ink container 1 is provided on its rear side and front side with a first engaging portion 5 and second engaging portion 6, respectively, which are engageable with locking portions provided in a container holder. In this embodiment, they are integral with the supporting member 3. By engagement of the engaging portion 5 and the engaging portion 6 with the locking portions, the ink container 1 is securedly mounted in the ink container 1. The operation during the mounting will be described hereinafter referring to FIG. 15.

The bottom surface of the ink container 1 is provided with an ink supply port 7 for ink supply, which port is connectable with an ink introduction opening of the recording head which will be described hereinafter, by mounting of the ink container 1 to the container holder. A base member is provided on the bottom side of the supporting portion of the supporting member 3 at a position where the bottom side and the front side intersect with each other. The base member may be in the form of a chip or a plate. In the following description, it is called "substrate" 100.

FIG. 2 is a sectional side elevation of the ink container 1. An inside of the ink container 1 is divided into an ink reservoir chamber 11 which is provided adjacent the front side where the supporting member 3 and the substrate 100 are provided, and a negative pressure generating member accommodating chamber 12 which is provided adjacent the rear side and which is in fluid communication with an ink supply port 7. The ink reservoir chamber 11 and the negative pressure generating member accommodating chamber 12 are in fluid communication with each other through a communication port 13. The ink reservoir chamber 11 contains the ink alone in this embodiment, whereas the negative pressure generating member accommodating chamber 12 accommodates an ink absorbing material 15 (negative pressure generating member which is a porous member in this embodiment) made of sponge, fiber aggregate or the like for retaining the ink by impregnation. The porous member 15 functions to generate such a negative pressure as is sufficient to provide balance with the force of meniscus formed in the ink ejection nozzle of the recording head to prevent ink leakage from the ink ejection portion to the outside and to permits ink ejection by actuation of the recording head.

The upper surface of the negative pressure producing member accommodating chamber 12 is provided with an air vent 12A for introducing the ambient air thereinto to ease the negative pressure increasing with the ink supply out of the recording head, thus maintaining the negative pressure within a predetermined preferable range.

The ink container 1 shown in FIG. 2 can be manufactured by preparing a main body of the ink container 1 provided with the substrate which will be described hereinafter and by injecting the ink into the ink container 1. The ink injection port may be formed in the upper surface of the ink reservoir chamber 11. After the ink injection, the injection port is sealed by a sealing member 11A.

As regards the case in which the use of the ink container 1 has been started, and the ink has been supplied out, the following is possible. For example, at a certain point after the ink is consumed following the start of the use of the ink container 1, that is, when the ink remaining amount in the container becomes substantially zero, for example, the sealing member 11A may be dismounted or may be broken to reform an injection port, and the ink is injected using an injector, and then, the reformed injection port may be re-sealed by a sealing member 11A or a substitute member, if necessary. In place of using the original injection port, opening may be formed at another position in the top surface of the ink reservoir chamber 11, for example, and the ink may be injected through the opening, and then, the opening may be sealed. For example, the Embodiments of the manufacturing method for the ink container are in tended to cover such manufacturing methods in which the ink is injected into the ink container containing some responsibility zero amount of the ink.

The sealing member 7A is detachably mountable in order to prevent of the ink leakage during transportation or storage of the manufactured ink container 1. The sealing member 7A may be of any type, such as a capping or taping member or the like, if a predetermined sealing property is provided, and it is removable when the ink container is mounted to the recording head. In the case that ink container is dismounted from the recording head after the start of use, the sealing member 7A and the substitute member may be used to seal the ink supply port 7.

The internal structure of the ink container 1 is not limited to such a partitioned structure in which the inside is partitioned into the porous member accommodating chamber and the reservoir containing the ink alone. In another example, the porous member may occupy substantially all of the entire inner space of the ink container. The negative pressure generating means is not limited to the one using the porous member. In another example, the ink alone is contained in a bladder-like member made of elastic material such as rubber or the like which produces tension in the direction of expanding the volume thereof. In such a case, the negative pressure is generated by the tension in the bladder-like member to retain the ink. In a further example, at least a part of the ink accommodation space is constructed by a flexible member, and the ink alone is accommodated in the space, wherein a spring force is applied to the flexible member, by which a negative pressure is generated. In such cases, the ink container may be manufactured by injecting the ink in the above-described manner. In such cases, the ink injection may be carried out utilizing the air vent portion, which is provided to introduce the ambience in order to ease the negative pressure tending to increase with ink supply into the recording head and in order to maintain the negative pressure within a predetermined preferable range, as described hereinbefore. With such a structure, the air vent portion can be used to inject the ink.

The bottom portion of the ink reservoir chamber 11 is provided with a portion to be detected 17 at a position opposite to an ink remaining amount detection sensor (which will be described hereinafter) provided in the apparatus side, when the ink container 1 is mounted to the apparatus. In this embodiment, the ink remaining amount detection sensor is in the form of a photo-sensor comprising a light emitting portion and a light receiving portion. The portion to be detected 17 is made of a transparent or semi-transparent material, and when the ink is not contained, the light from the light emitting portion is appropriately reflected toward the light receiving portion (which will be described hereinafter) by a prism-like element including an inclined surface portion having a configuration, angle or the like for this purpose.

Figure 3:
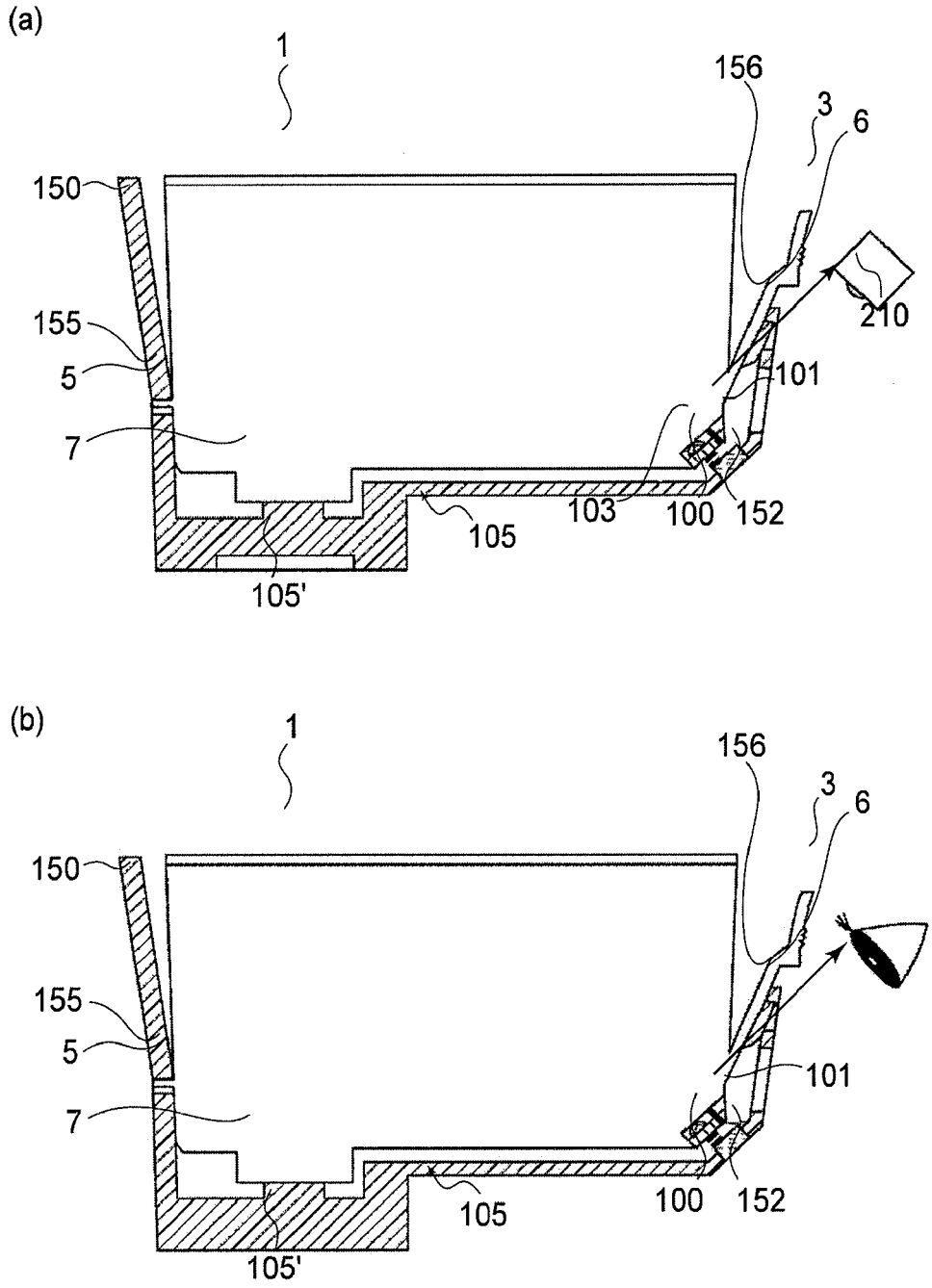
FIG. 3 is schematic side views (a) and (b) of the ink container according to the first embodiment of the present invention, illustrating function of a substrate provided on the ink container.
Figure 4:
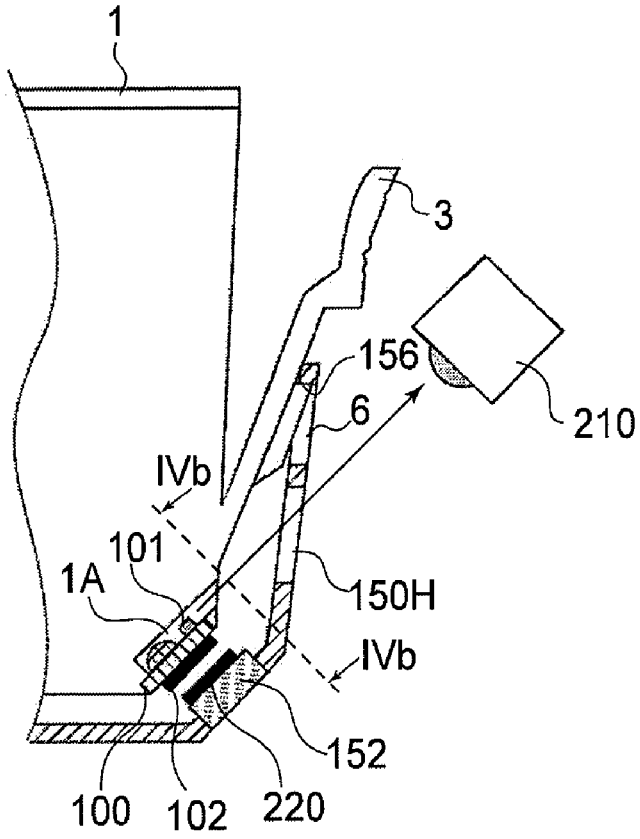
FIG. 4 is an enlarged view (a) of a major part of the ink container shown in FIG. 3, and a view (b) as seen in a direction IVb.
Figure 4:
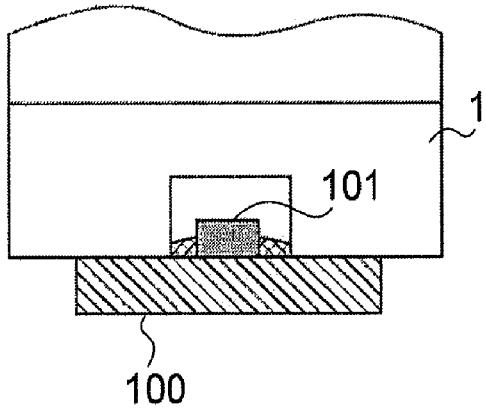
Figure 5:
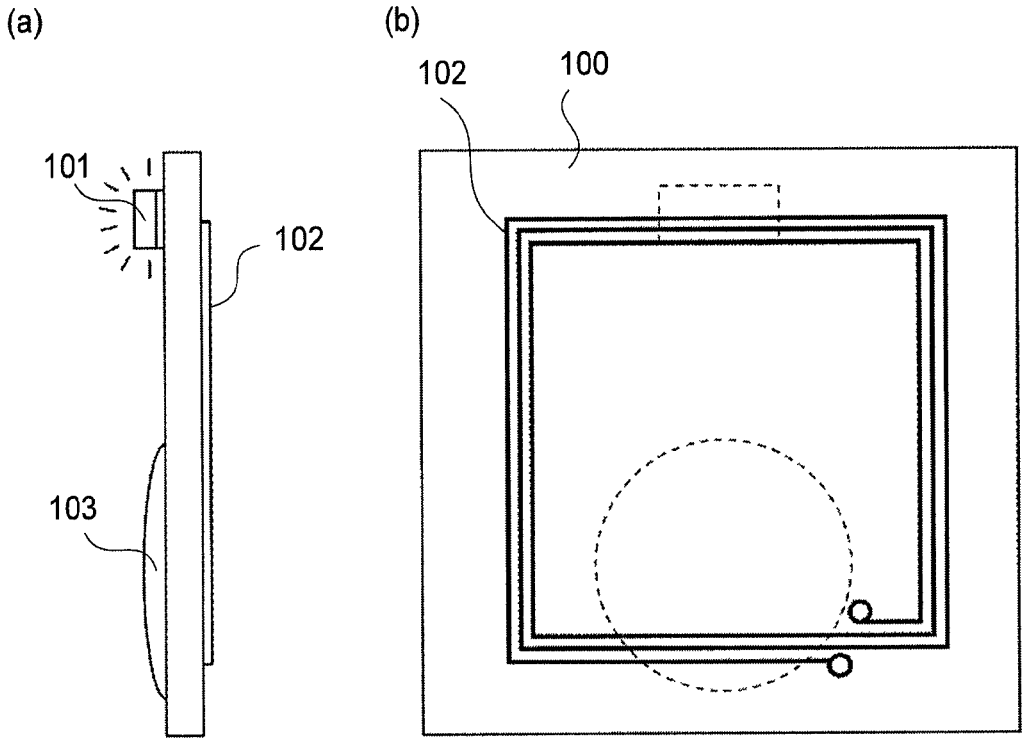
FIG. 5 is a side view (a) and a front view (b) of an example of a controller substrate mounted on the ink container of the first embodiment.

Referring to FIG. 3-FIG. 5, the description will be made as to the structure and the function of the substrate 100. FIG. 3 is schematic side views ((a) and (b)) of a substrate provided on the ink container which the present invention is applicable to. FIG. 4 is an enlarged view (a) of a major part of the ink container shown in FIG. 3, and a view (b) as seen in a direction IVb. FIG. 5 is a side view (a) and front view (b) of an example of a controller substrate mounted to an ink container which the present invention is applicable to.

The ink container 1 is securedly mounted in or to the holder 150 which is integral with the recording head unit 105 having the recording head 105, by engagements of the first engaging portion 5 and the second engaging portion 6 of the ink container 1 with a first locking portion 155 and a second locking portion 156 of the holder 150, respectively. By doing so, the ink container 1 is securedly mounted on the holder 150. An antenna 102 (FIG. 5, (b)) in the form of a loop provided by a wiring pattern on a side of the substrate 100 of the ink container facing toward outside is closely opposed to an antenna substrate 152 provided in the holder 150, so that wireless communication is enabled.

The inwardly facing side of the substrate 100 is provided with a first light emitting portion 101 emitting a visible light such as a LED and a control element 103 for controlling the light emitting portion. The control element 103 controls the light emission of the first light emitting portion 101 by an electric signal fed through the ink container side antenna 102 from the antenna substrate 152. FIG. 5, (a) shows the state in which after the control element 103 is provided on the substrate 100, it is coated with a protection sealant. When a memory element for storing information such as a color of the ink in the container and/or the remaining amount of the ink contained in the ink container is employed, it is set at the same place, so that it is coated with the sealant.

Here, as described hereinbefore, the substrate 100 is disposed at a lower portion of the supporting portion of the supporting member 3 adjacent the portion where the sides of the ink container 1 constituting the bottom side and the front side cross with each other. At this position, an inclined surface is provided between the bottom and front sides of the ink container 1. Therefore, when the first light emitting portion 101 emits light, a part of the light is emitted outwardly from the front side of the ink container 1 along the inclined surface.

By this disposition of the substrate 100, the information relating to the ink container 1 can be directly provided not only to the recording device (and to a host apparatus such as a computer connected thereto) but also to the user, by the first light emitting portion 101 alone. As shown by (a) in FIG. 3, the light receiving portion is disposed at a position for receiving the light emitted in an upper right direction in the Figure adjacent an end of a scanning range of the carriage for carrying the holder 150. At the timing when the carriage comes to the position, the light emission of the first light emitting portion 101 is controlled, by which the recording device side can obtain predetermined information relating to the ink container 1 on the basis of a content of the light received by the light receiving portion. In addition, by controlling the light emission of the first light emitting portion 101 with the carriage being disposed at a center portion of the scanning range, as shown by (b) in FIG. 3, the user is visually informed of the state of the light emission, so that user can be given the predetermined information relating to the ink container 1.

Here, the predetermined information of the ink container (liquid container) 1 includes at least one of properness of the mounting state of the ink container 1 (i.e. whether the mounting is complete or not), properness of the position of mounting of the ink container 1 (i.e. whether or not the ink container 1 is mounted on the right position in the holder which is determined corresponding to the ink color) (flickering or the like). The predetermined information may further includes the sufficiency of the ink remaining amount (i.e. whether the remaining amount of the ink is sufficient or not). The information relating to them can be provided by emission or non-emission of the light and/or states of light emission (flickering or not, for example). The control of the light emission, the manners of providing the information will be described hereinafter in the description of the structure of the control system.

In FIG. 4, (a) and (b) show preferable examples of the disposition and the operation of the substrate 100 and the first light emitting portion 101. From the standpoint of smooth reaching of the light emitted from the first light emitting portion 101 into the view field of the first light receiving portion 210 or the user, it is preferable that such a portion of the ink container 1 as is opposed to the surface of the substrate 100 having the first light emitting portion 101 and the control unit 103, is provided with a space 1A at least along the optical axis, as indicated by the arrow. For the same purpose, the arrangement and the configuration of the supporting member 3 are so selected that optical axis is not blocked. In addition, the holder 150 is provided with a hole (or a light transmitting portion) 150H to assure non-blocking of the optical axis.

1.2 Modified Example (FIG. 6-FIG. 13):

The foregoing structures are examples and can be modified as long as the predetermined information relating to the ink container 1 can be given to the recording device and to the user by the first light emitting portion 101. The description will be made as to some modified examples.

Figure 6:
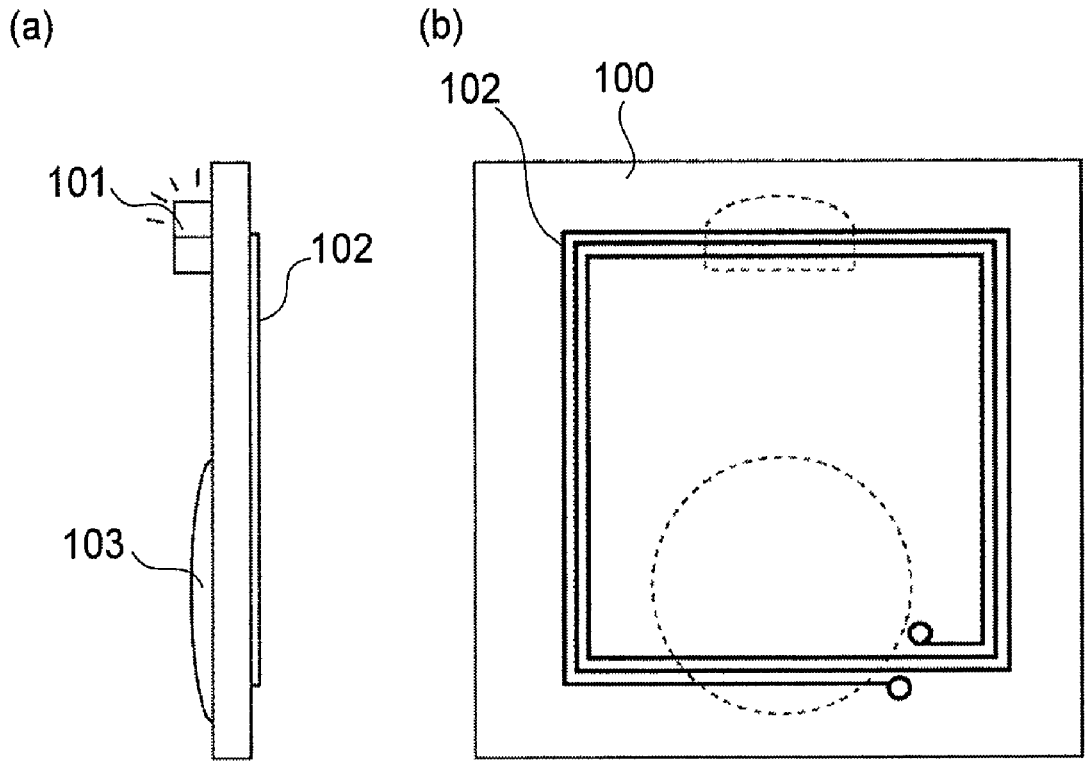
FIG. 6 is a side view (a) and a front view (b) of a modified example of the controller substrate mounted on the ink container according to the first embodiment.

FIG. 6 is a side view (a) and a front view (b) of a modified example of the controller substrate mounted on the ink container according to the first embodiment. In this example, the directivity is provided such that light is directed particularly toward the first light receiving portion 210 and toward the eyes of the user. To accomplish this, the attitude of the first light emitting portion 101 is appropriately determined, and an element (a lens or the like) for providing the directivity may be employed.

Figure 7:
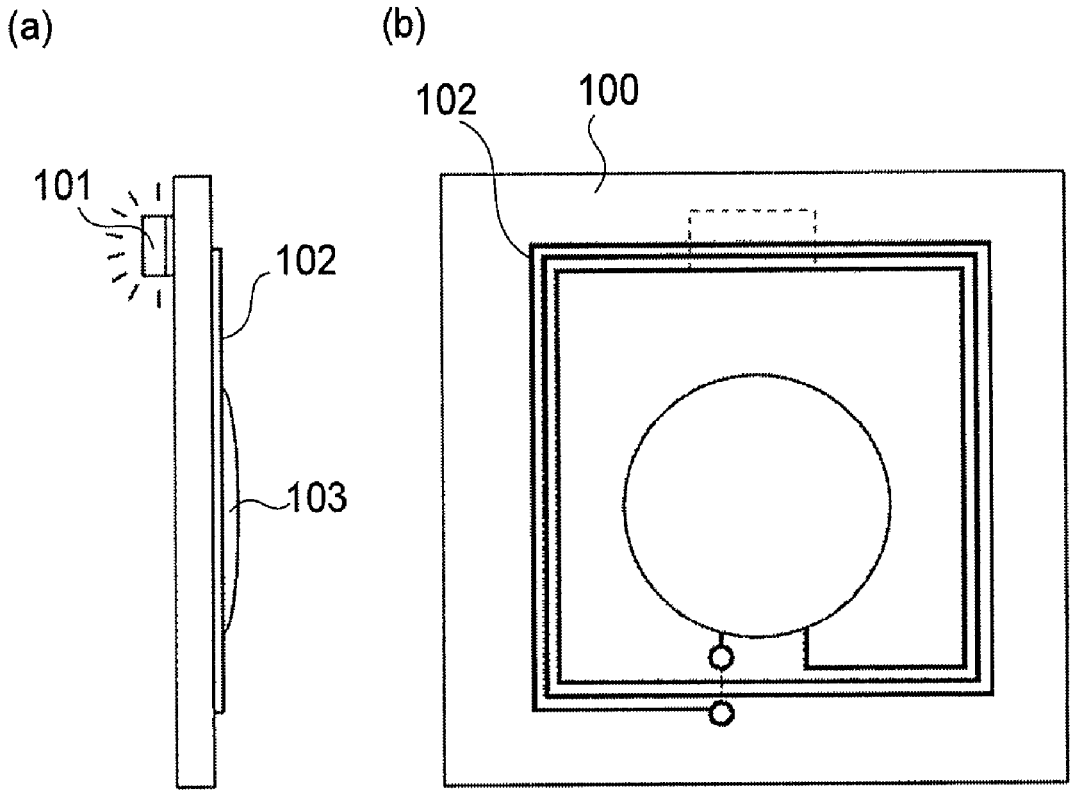
FIG. 7 is a side view (a) and a front view (b) of another modified example of the controller substrate mounted on the ink container according to the first embodiment.

In the example of (a) and (b) of FIG. 7, the surface of the substrate 100 facing toward the inside of the ink container 1 is provided only with the first light emitting portion 101, and the surface of the substrate 100 facing toward the outside is provided with the control element 103 and the antenna 102. With this structure, the light emitted from the first light emitting portion 101 is not blocked by the control element 103, so that light is directed not only in an inclined upward direction but also in an inclined downward direction along the surface of the substrate 100.

Figure 8:
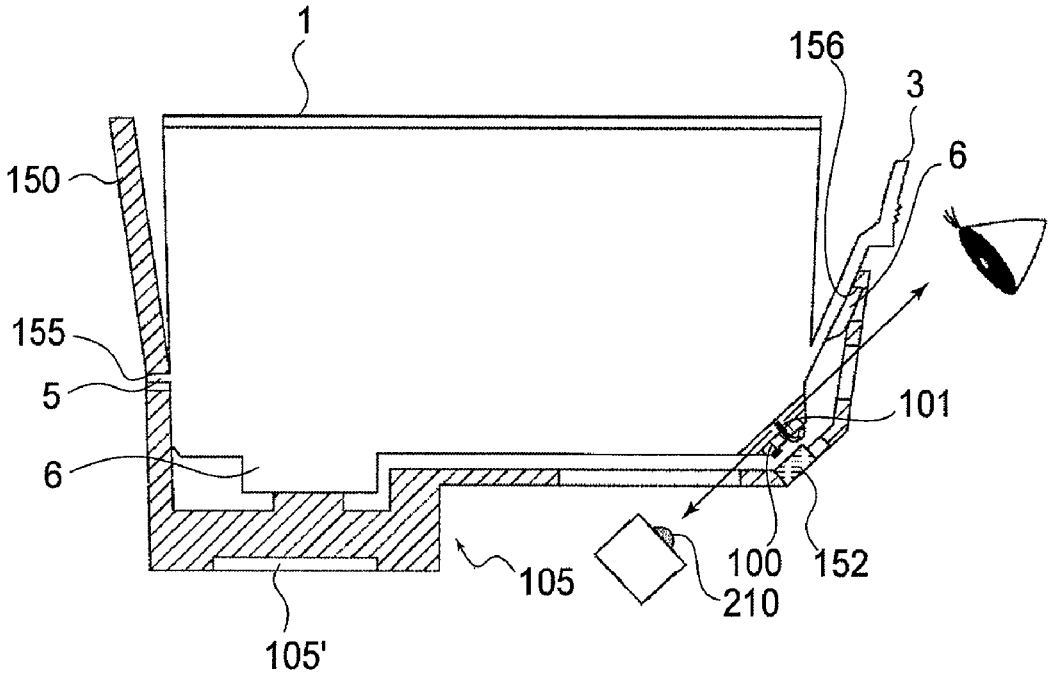
FIG. 8 is a side view of an ink container illustrating a use of the controller substrate of FIG. 7.

FIG. 8 is a side view of the ink container illustrating a use of the controller substrate of FIG. 7. As will be understood from this Figure, the first light emitting portion 101 directs the light not only in the upper right direction toward the user's observation but also in the lower left direction. In this arrangement, the first light receiving portion 210 is disposed across the optical axis extending toward the lower left, so that recording device side can receive the predetermined information relating to the ink container 1.

Figure 9:
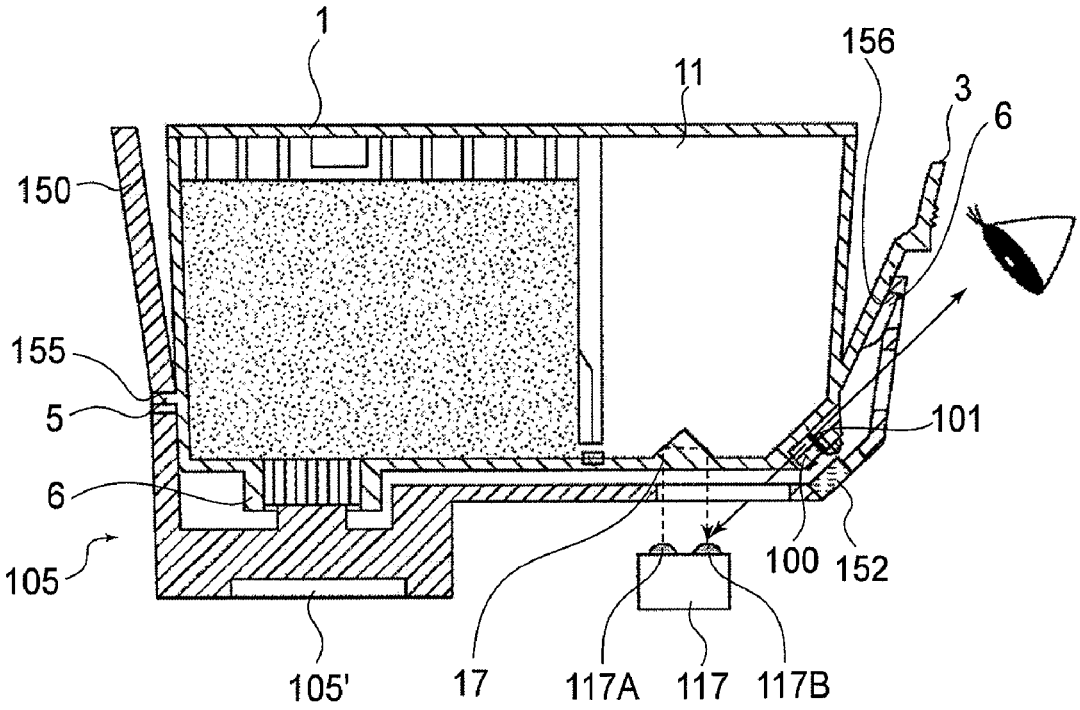
FIG. 9 is a side view illustrating another example of usage of the controller substrate of FIG. 7.

FIG. 9 is a side view illustrating another example of usage of the controller substrate of FIG. 7. This example is suitable to the case that sensor 117, in the form of a photosensor, for detection of the ink remaining amount is provided in the apparatus so as to be opposed to the portion to be detected 17 which is in the form of a prism, when the ink container 1 is mounted on the apparatus. More particularly, the sensor 117 for detection of the ink remaining amount includes a light emitting portion 117A and a light receiving portion 117B. When the ink remaining amount in the ink chamber 11 of the ink container 1 is small, the light from the light emitting portion 117A is reflected by the prism-like portion to be detected 17, and returns to the light receiving portion 117B, so that apparatus can detect the ink shortage. In this embodiment, the light receiving portion 117B is utilized also as a photoreceptor for receiving the light from the first light emitting portion 101 to permit the apparatus to detect the presence or absence and/or properness of the mounted ink container 1.

Figure 10:
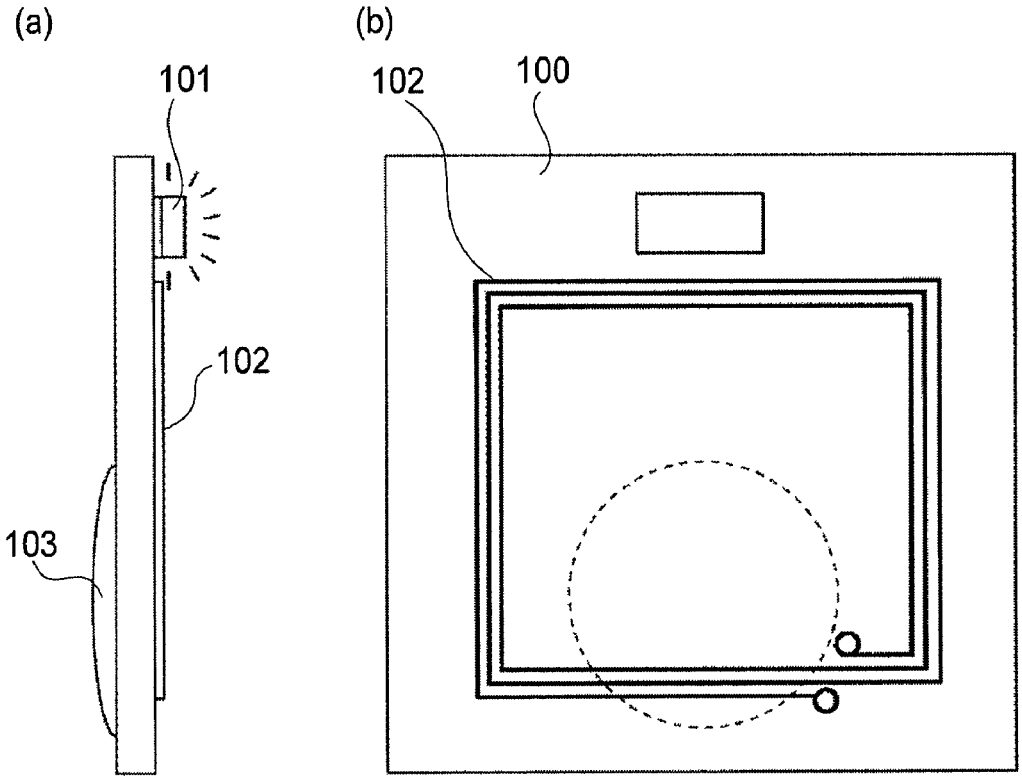
FIG. 10 is a side view (a) and a front view (b) of a further modified example of the controller substrate mounting on the ink container according to the first embodiment.

In the example shown in (a) and (b) of FIG. 10, the surface of the substrate 100 facing inwardly of the ink container 1 is provided with a control element 103, and the first light emitting portion 101 and the electrode pad 102 are disposed on the surface of the substrate 100 facing outwardly. With this structure, the light emitted from the first light emitting portion 101 travels also in the outward direction from the surface of the substrate 100.

Figure 11:
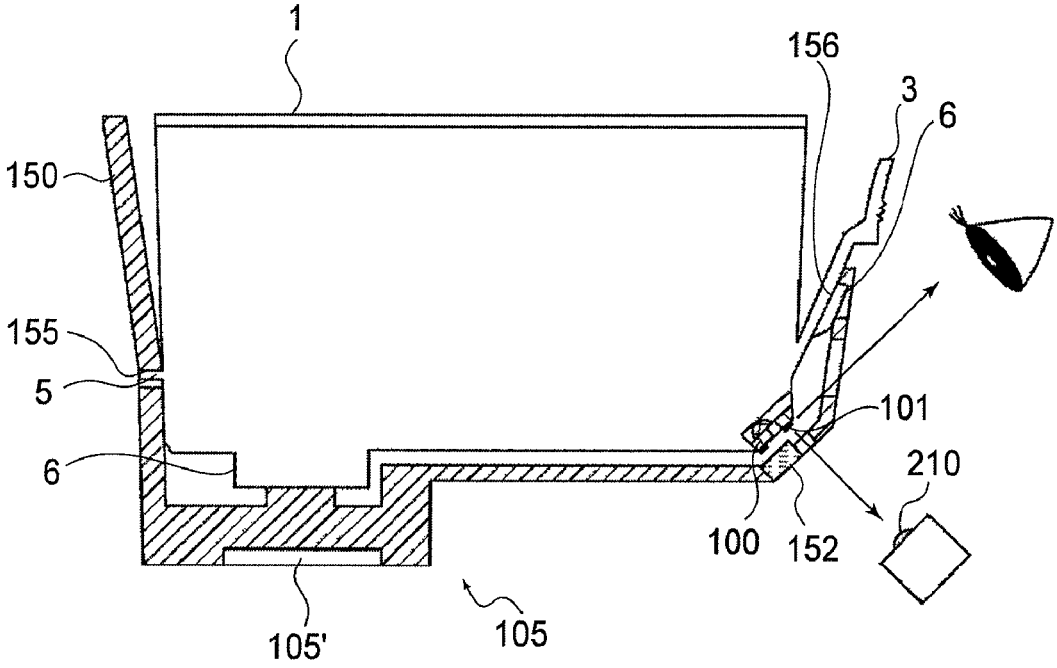
FIG. 11 is a side view illustrating a use of the controller substrate of FIG. 10 provided on the ink container.

FIG. 11 is a side view of the ink container having the controller substrate of FIG. 7, illustrating a use thereof. As will be understood from the Figure, the first light emitting portion 101 emits the light not only in the upper right direction by which the user can visually receive the light, but also in the lower right direction. The first light receiving portion 210 is disposed across the optical axis extending in the lower right direction, so that predetermined information relating to the ink container 1 can be transmitted to the recording device side.

With the above-described structures, the position and/or the configuration of a member or members which may block the light travelling along the optical axes are appropriately selected, and an opening and/or light-transmissive are provided, so that optical axes directing toward the eyes of the user and toward the light receiving portion are positively assured.

However, other arrangements are usable by which the light is directed to the eyes of the user and/or to the light receiving portion.

Figure 12:
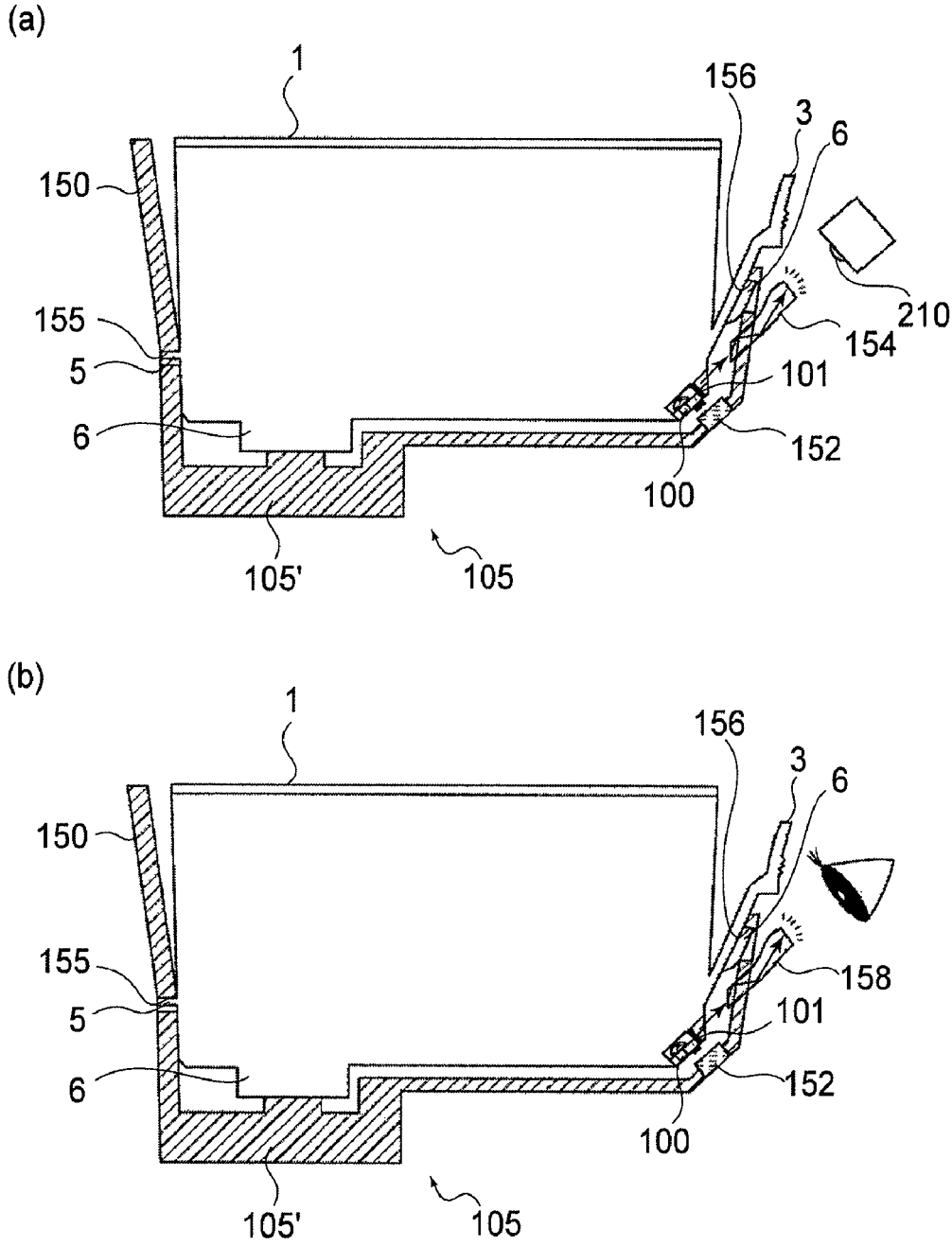
FIG. 12 is a schematic side view illustrating another example of the structure and an operation of a major part of the ink container according to the first embodiment of the present invention.

In FIG. 12, (a) and (b) shows an example of such a structure, wherein the light emitted from the first light emitting portion 101 is directed to a desired position by using a light guiding member 154 such as optical fibers. By means of the light guiding member 154, the predetermined information relating to the ink container 1 can be transmitted to the first light receiving portion 210 (FIG. 12, (a)) and to the eyes of the user (FIG. 12, (b)).

Figure 13:
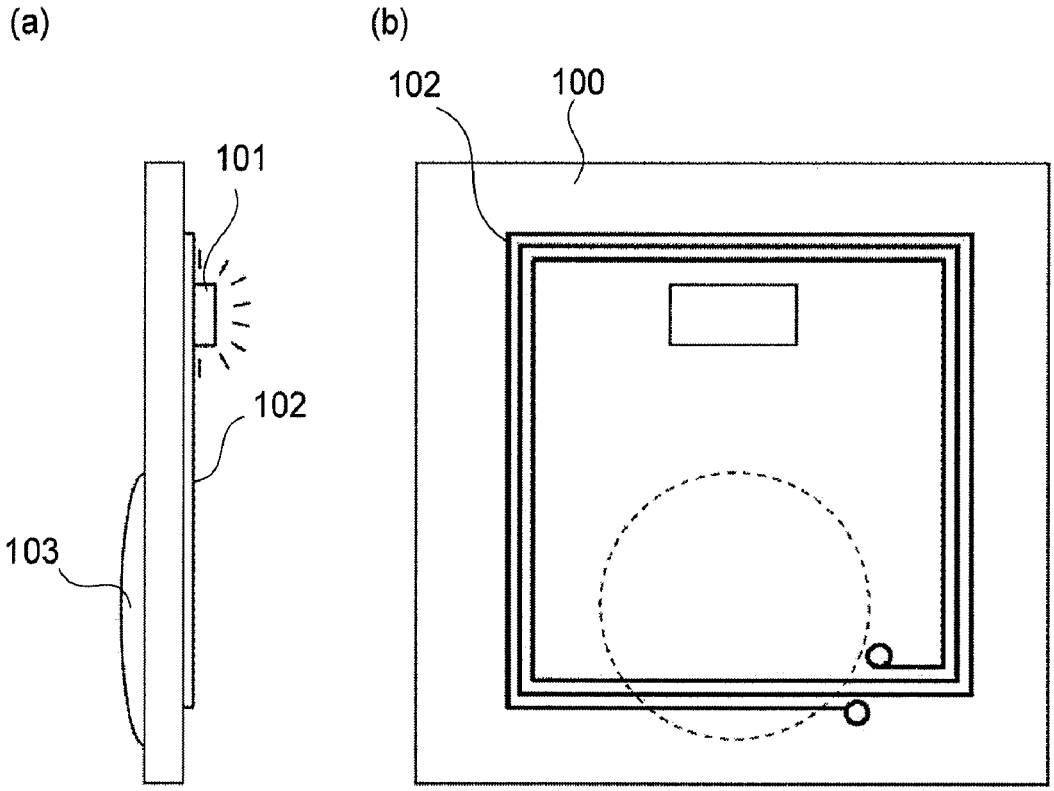
FIG. 13 is a side view (a) and a front view (b) of a further example of the controller substrate mounted on the ink container.

FIG. 13 is a side view (a), a front view (b) of a further example of the controller substrate mounted on the ink container. In the example of FIG. 10, the first light emitting portion 101 is disposed close to the end of the substrate 100, and in this case, the size of the antenna 102 is required to be relatively small. In the example of FIG. 13, the first light emitting portion 101 is shifted toward inside of the substrate 100, by which the maximum size of the antenna 102 can be assured, so that further preferable wireless communication is accomplished.

Figure 14:
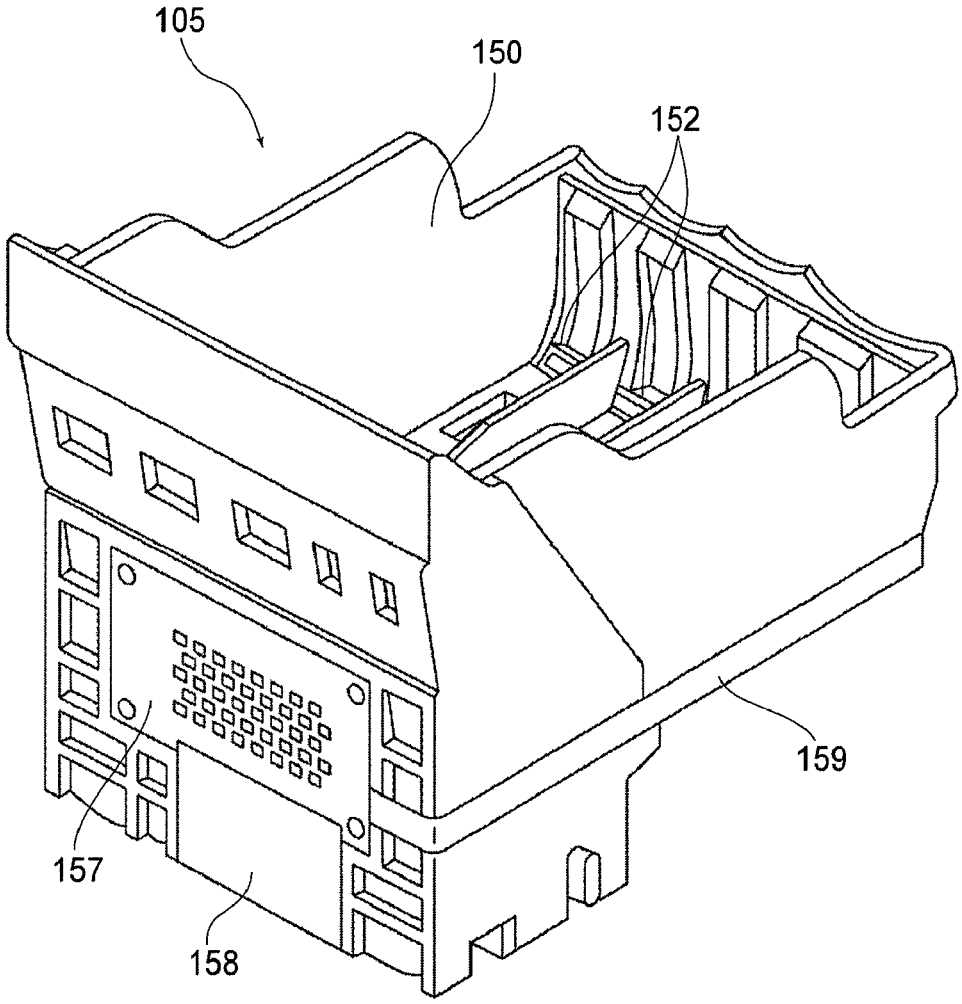
FIG. 14 is a perspective view illustrating an example of a recording head unit having a holder to which the ink container according to the first embodiment is mountable.
Figure 15:
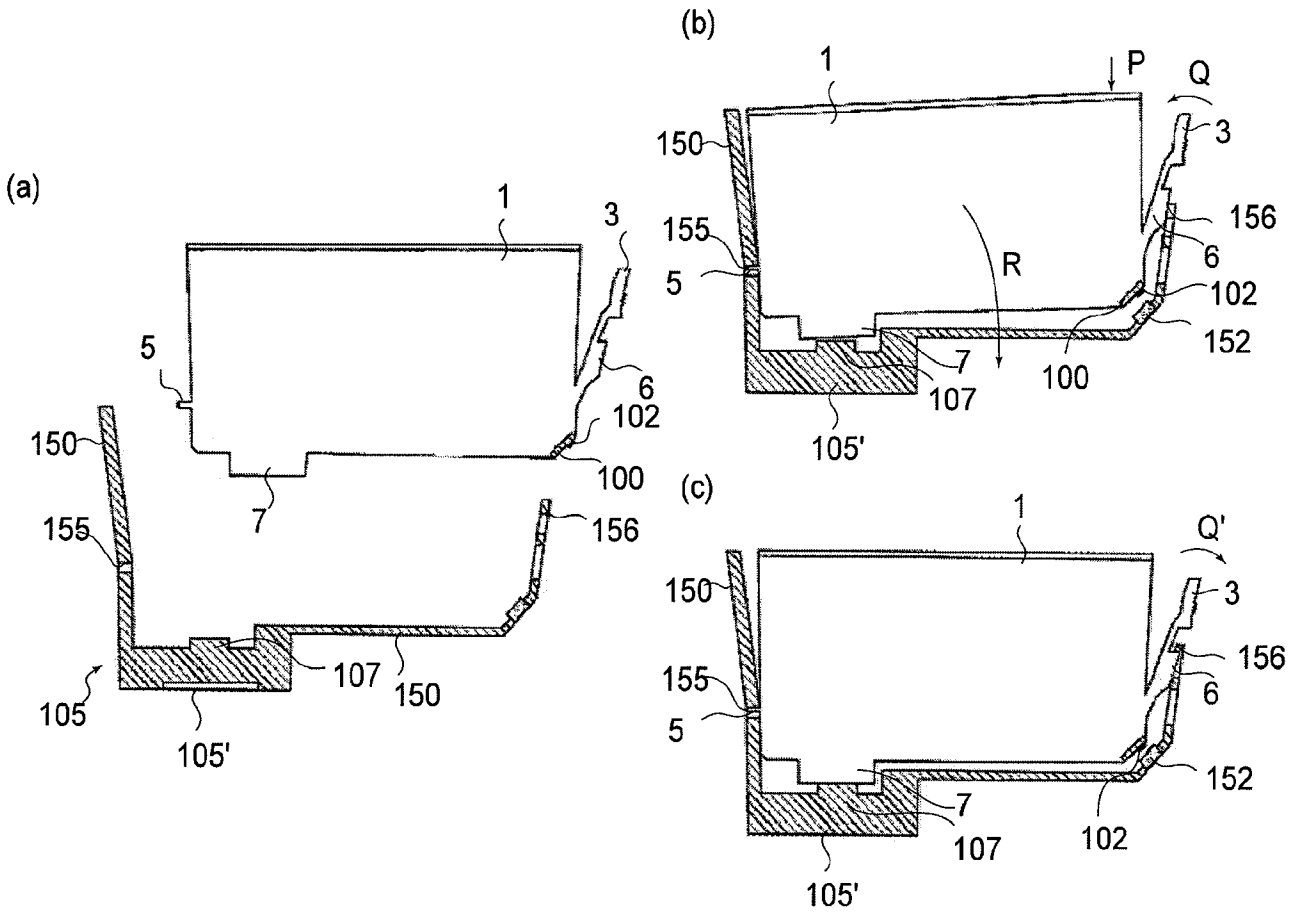
FIG. 15 is schematic side views ((a)-(c)) illustrating an operation of mounting and demounting of the ink container according to the first embodiment to the holder shown in FIG. 14.

1.3 Mounting Portion of Ink Container:

FIG. 14 is a perspective view illustrating an example of a recording head unit having a holder to which the ink container according to the first embodiment is mountable. FIG. 15 is a schematic side view illustrating an operation of mounting and demounting (a)-(c) of the ink container according to the first embodiment to the holder shown in FIG. 14.

The recording head unit 105 is generally constituted by a holder 150 for detachably holding a plurality (four, in the example shown in the Figure) of ink containers, and a recording head 105 disposed adjacent the bottom side (unshown in FIG. 14). By mounting the ink container to the holder 150, an ink introduction opening 107 of the recording head disposed in the bottom portion of the holder is connected with the ink supply port 7 of the ink container to establish an ink fluid communication path therebetween.

An example of usable recording head 105 comprises a liquid passage constituting a nozzle, an electrothermal transducer element provided in the liquid passage. The electrothermal transducer element is supplied with electrical pulses in accordance with recording signals. Thermal energy is applied to the ink in the liquid passage. This causes a phase change of the ink resulting in bubble generation (boiling), and therefore, abrupt pressure rise, by which the ink is ejected from the nozzle. By this, the thermal energy is applied to the ink in the liquid passage. This causes a phase change of the ink resulting in bubble generation (boiling), and therefore, abrupt pressure rise, by which the ink is ejected from the nozzle. An electrical contact portion (unshown) for signal transmission provided on the carriage 203 which will be described hereinafter, and an electrical contact portion 157 of the recording head unit 105, are electrically contacted to each other, so that transmission of the recording signal is enabled to the electrothermal transducer element driving circuit of the recording head 105 through the wiring portion 158. From the electrical contact portion 157, a wiring portion 159 is extended to the antenna substrate 152.

When the ink container 1 is mounted to the recording head unit 105, the ink container 1 is brought to above the holder 150 ((a) in FIG. 15). And, a first engaging portion 5 in the form of a projection provided on an ink container rear side is inserted into a first locking portion 155 in the form of a through hole provided in a holder rear side, so that ink container 1 is placed on the inner bottom surface of the holder ((b) of FIG. 15). With this state kept, the front side upper end of the ink container 1 is pressed down as indicated by arrow P, by which the ink container 1 rotates in the direction indicated by the arrow R about the engaging portion between the first engaging portion 5 and the first locking portion 155, so that front side of the ink container displaces downwardly. In the process of this action, the supporting member 3 is displaced in the direction of an arrow Q, while a side surface of a second engaging portion 6 provided in the supporting member 3 on the ink container front side is being pressed to the second locking portion 156 provided on the holder front side.

When the upper surface of the second engaging portion 5 reaches a lower portion of the second locking portion 156, the supporting member 3 displaces in the direction Q' by the elastic force of the supporting member 3, so that second engaging portion 6 is locked with the second locking portion 156. With this state ((c) in FIG. 15), the second locking portion 156 elastically urges the ink container 1 in a horizontal direction through the supporting member 3, so that rear side of the ink container 1 is abutted to the rear side of the holder 150. The upward displacement of the ink container 1 is suppressed by the first locking portion 155 engaged with the first engaging portion 5 and by the second locking portion 156 engaged with the second engaging portion 6. At this time, the mounting of the ink container 1 is completed, wherein the ink supply port 7 is connected with the ink introduction opening 107, and the antenna 102 and the main assembly side antenna 220 on the antenna substrate 152 are closely opposed to each other.

The above-described uses the principle of "lever" during the mounting process shown in (b) of FIG. 15, wherein the engaging portion between the first engaging portion 5 and the first locking portion 155 is a fulcrum, and the front side of the ink container 1 is a power point where the force is applied. The connecting portion between the ink supply port 7 and the ink introduction opening 107 is a working point which is located between the power point and the fulcrum, preferably, closer to the fulcrum. Therefore, the ink supply port 7 is pressed against the ink introduction opening 107 with a large force by the rotation of the ink container 1. At the connecting portion, an elastic member such as a filter, an absorbing material, a packing or the like which has a relatively high flexibility is provided to assure an ink communication property to prevent ink leakage there.

Such structure, arrangement and mounting operation are therefore preferable in that such a member is elastically deformed by the relatively large force. When the mounting operation is completed, the first locking portion 155 engaged with the first engaging portion 5 and the second locking portion 156 engaged with the second engaging portion 6 are effective to prevent the ink container 1 from rising away from the holder. Therefore, the restoration of the elastic member is suppressed, so that member is kept in an appropriately deformed elastically.

However, the structure of the mounting portion of the ink container according to the first embodiment or the modified example shown in FIG. 14 is not limiting in the present invention.

Figure 16:
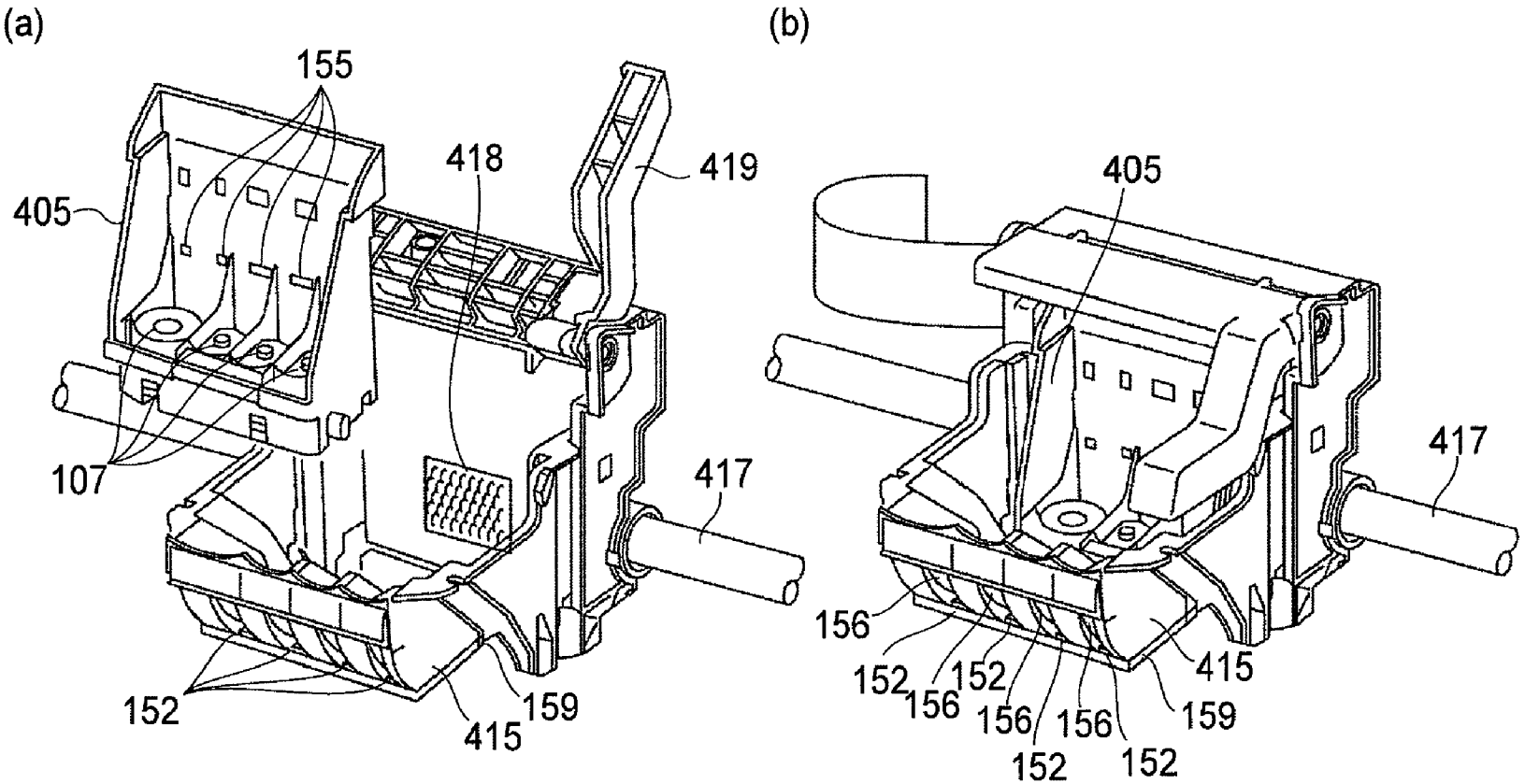
FIG. 16 are perspective views (a) and (b) of another example of a mounting portion of the ink container according to the first embodiment of the present invention.

Referring to FIG. 16, this will be described. This Figure is a perspective view (a) of the recording head unit of another example and a carriage therefor, the recording head unit functioning to receive the ink from an ink container and to effect recording, and a perspective view (b) of these elements connected with each other.

The recording head unit 405 of this example is different from the foregoing holder 150 which securedly holds the entirety of the ink container. More particularly, as shown in FIG. 16, (a), the holder portion corresponding to the ink container front side, the second locking portion or the antenna substrate disposed here is not provided. In the other respects, the structures of this example is substantially similar to the foregoing examples, that is, the recording head unit is provided in the bottom surface with an ink introduction opening 107 connectable with the ink supply port 7, and is provided at the rear side with the first locking portion 155, and is provided at the back side thereof with an electrical contact portion (unshown) for the signal transmission.

A carriage 415 movable along a shaft 417 is provided with a lever 419 for mounting and fixing the recording head unit 405 as shown in FIG. 16, (b). It has a holder portion corresponding to the structure of the ink container front side, in addition to an electrical contact portion 418 connected with the electrical contact portion of the recording head side. Thus, the second locking portion 156, the wiring portion 159 to the antenna substrate 152 and the connector are provided on the carriage side.

With such a structure, when the recording head unit 405 is mounted to the carriage 415 as shown in FIG. 16, (b), the mounting portion of ink container is entirely mounted. More particularly, through the process similar to the mounting operation in FIG. 15, the connection between the ink supply port 7 and the ink introduction opening 107, and the close facing between the antenna 102 and the main assembly side antenna substrate 152 are accomplished, thus completing the mounting operation.

Figure 17:
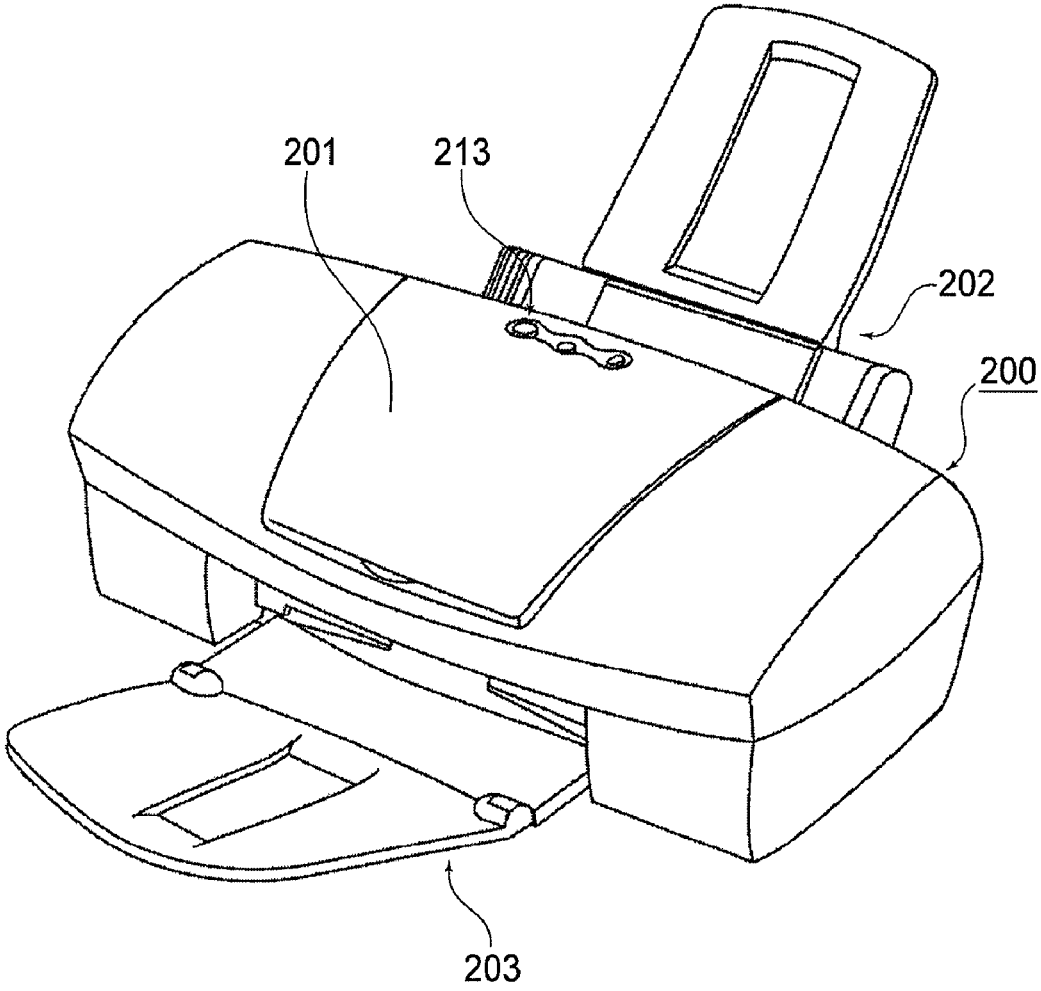
FIG. 17 shows an outer appearance of an ink jet printer to which the ink container according to the first embodiment is mountable.
Figure 18:
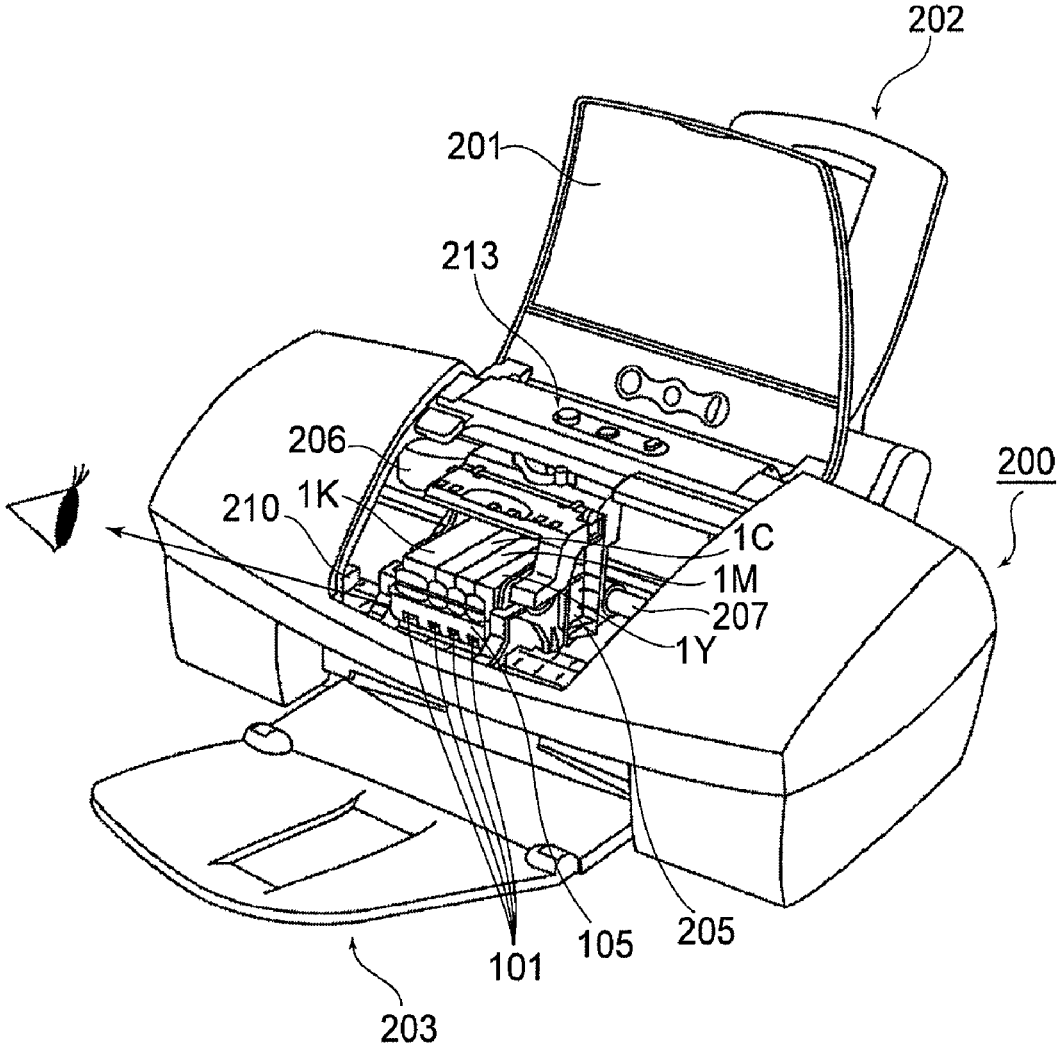
FIG. 18 is a perspective view of the printer in which the main assembly cover 201 of FIG. 17 is open.

1.4 Recording Device (FIG. 17-FIG. 18):

FIG. 17 shows an outer appearance of an ink jet printer 200 to which the ink container described in the foregoing. FIG. 18 is a perspective view of the printer in which the main assembly cover 201 of FIG. 17 is open.

As shown in FIG. 17, the printer 200 of this embodiment comprises a main assembly, a sheet discharge tray 203 at the front side of the main assembly, an automatic sheet feeding device (ASF) 202 at the rear side thereof, a main assembly cover 201, and other case portions which cover major parts including a mechanism for scanningly moving the carriage carrying the recording heads and the ink containers and for effecting the recording during the movement of the carriage. There is also provided an operating panel portion 213 which includes a displaying device which in turn displays states of the printer irrespective of whether the main assembly cover is closed or opened, a main switch, and a reset switch.

When the main assembly cover 201 is open, the user can see the recording head unit 105 as shown in FIG. 18. The user can also see the movable range and the neighborhood of the carriage 205 which carries the recording head unit 105 and the ink containers 1K, 1Y, 1M and 1C (the ink containers will be indicated by reference numeral "1" only hereinafter for simplicity, as the case may be). In this embodiment, when the main assembly cover 201 is opened. A sequence operation is carried out so that carriage 205 is automatically comes to the center position ("container exchanging position", shown in the Figure), where the user can do the ink container exchanging operation or the like.

In this embodiment, the recording head (unshown) is in the form of a chip mounted to the recording head unit 105, corresponding to the respective inks. The recording heads for the respective color inks scan the recording material by the movement of the carriage 205, during which the recording heads eject the ink to effect the printing. To do this, the carriage 205 is slidably engaged with the guiding shaft 207 which extends in the moving direction thereof, is driven by a carriage motor through a drive transmission mechanism. The recording heads corresponding to the K, Y, M and C (black, yellow, magenta and cyan) inks eject the inks on the basis of ejection data fed from a control circuit provided in the main assembly side through a flexible cable 206. There is provided a paper feeding mechanism including a paper feeding roller, a sheet discharging roller and so on to feed the recording material (unshown) fed from the automatic sheet feeding device 202 to the sheet discharge tray 203. The recording head unit 105 having an integral ink container holder is detachably mounted on the carriage 205, and the respective ink containers 1 in the form of cartridges are detachably mounted on the recording head unit 105. Thus, the recording head unit 105 can be mounted on the carriage 205, and the ink container 1 can be mounted on the recording head unit 105. In this embodiment, the ink container 1 is, therefore, detachably mountable to the carriage 205 by way of the recording head unit 105. In addition, by mounting the ink container 1 to the recording head unit 105, the liquid supplying system of the present invention is established.

During the recording or printing operation, the recording head scan the recording material by the above-described movement, during which the recording heads eject the inks onto the recording material to effect the recording operation on a width of the recording material corresponding to the range of the ejection outlets of the recording head. In a time period between a scanning operation and the next scanning operation, the paper feeding mechanism feeds the recording material through a predetermined distance corresponding to the width. In this manner, the recording is sequentially effected to cover the entire area of the recording material. An end portion of the movement range of the recording head by the movement of the carriage, there is provided an ejection refreshing unit including caps for capping the sides of the recording heads having the ejection outlets. Therefore, the recording heads move to the position of the refreshing unit at predetermined time intervals, and are subjected to the refreshing process including the preliminary ejections or the like.

Figure 25:
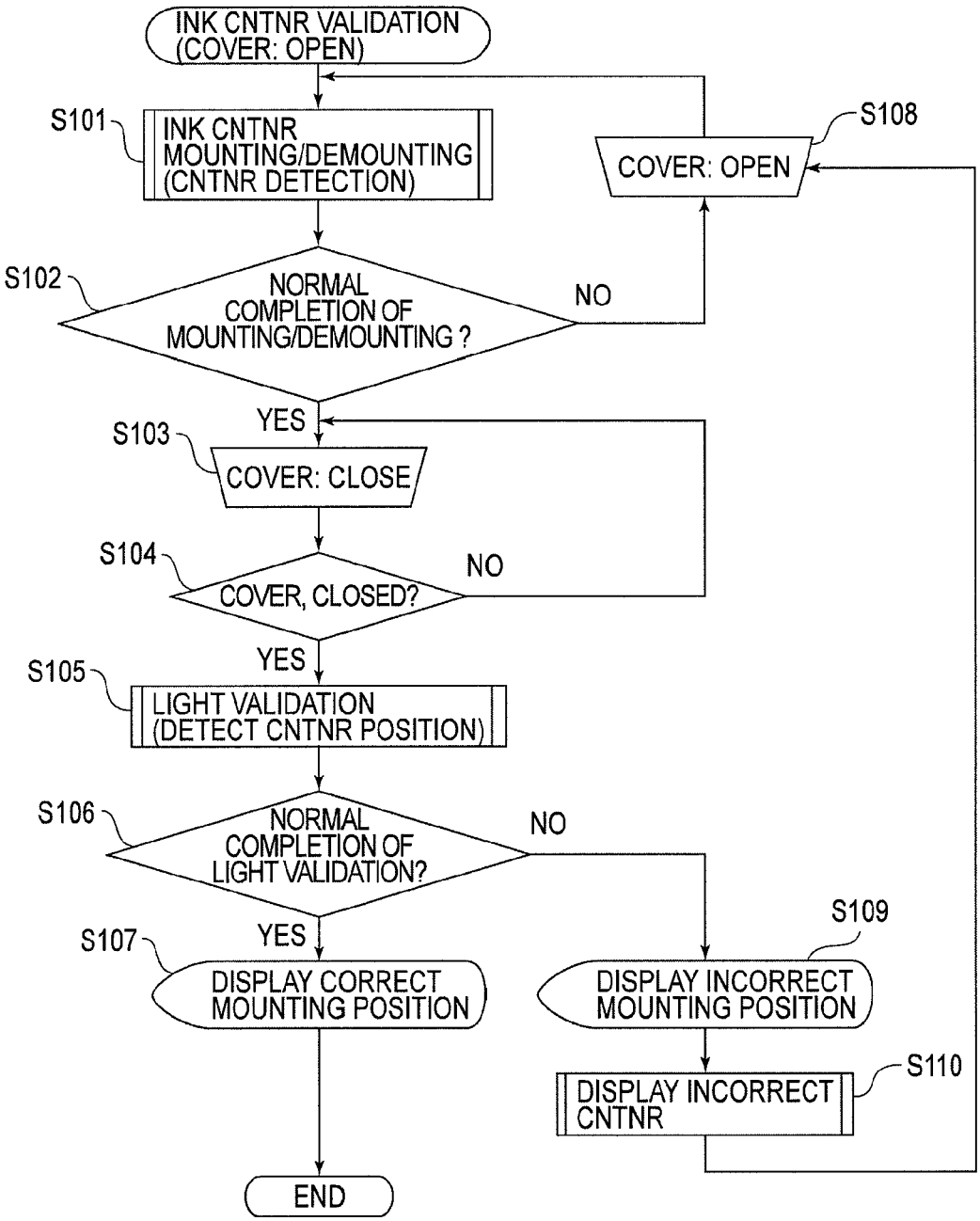
FIG. 25 is a flow chart illustrating a control process relating to mounting and demounting of the ink container according to an embodiment of the present invention.
Figure 26:
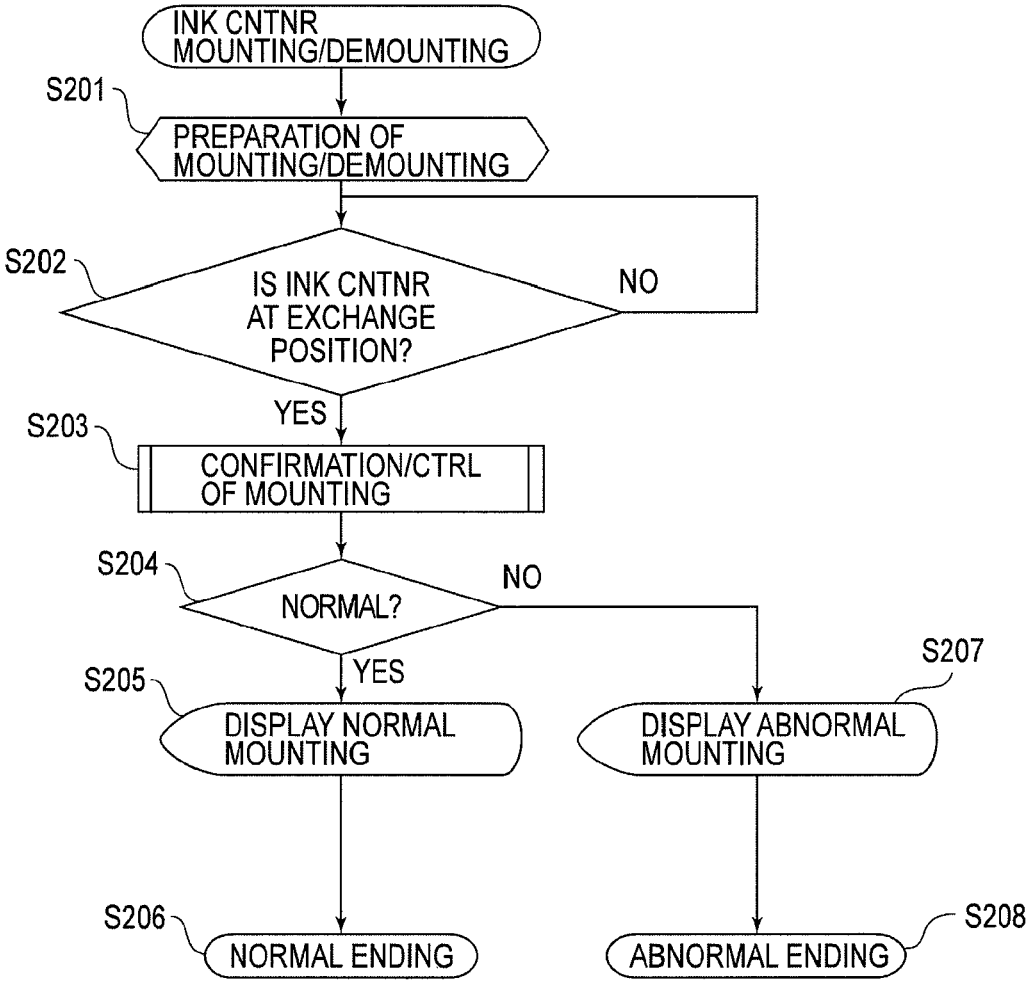
FIG. 26 is a flow chart of a mounting and demounting process of the ink container in FIG. 25.
Figure 27:
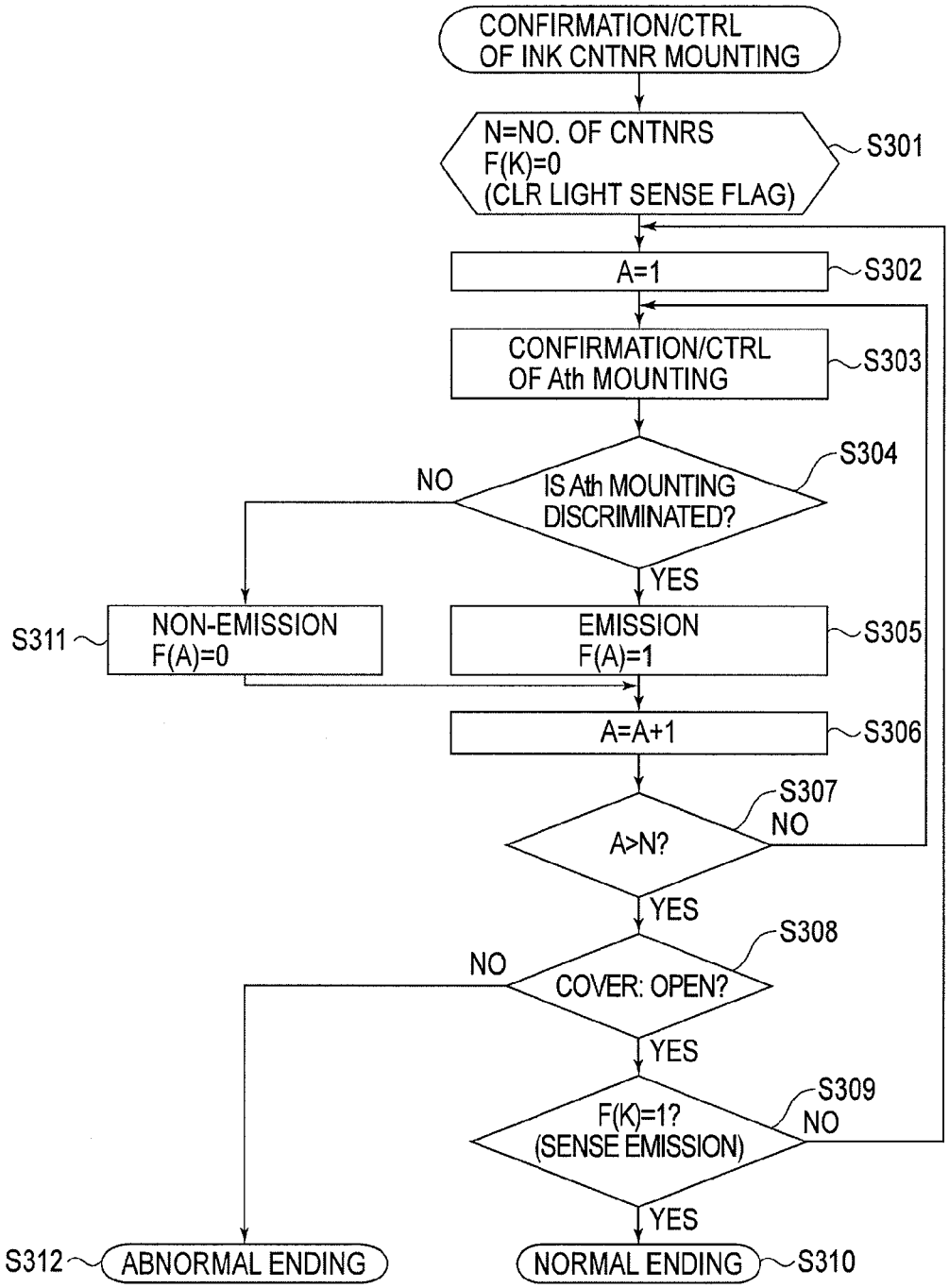
FIG. 27 is a flow chart showing in detail a mounting confirmation control in FIG. 26.

As described hereinbefore, the recording head unit 105 having the container holder portion for the ink containers 1 is provided with an antenna substrate, and the antennas thereon are positioned close to the antennas on the substrate provided on the ink container 1 mounted thereto. By this, the control of turn-on and -off of each of the LEDs 101 in accordance with the sequence which will be described hereinafter in conjunction of FIG. 25-FIG. 27, are enabled.

More particularly, at the container exchange position, when an ink remaining amount of an ink container 1 is short, the LED 101 of the ink container 1 is switched on or flickered. This applies to each of the ink containers 1. In the movement range of the carriage, a first light receiving portion 210 having a light receiving element is provided adjacent an end opposite the end provided with the refreshing unit. When the LEDs 101 of the ink containers 1 pass by the light receiving portion 210 by the movement of the carriage 205, the LEDs 101 are switched on. And, the light is received by the first light receiving position 210 so that positions of the ink containers 1 on the carriage 205 can be detected on the basis of the position of the carriage 205 when the light is received. In another example of the control for the turn-on of the LED or the like, the LED 101 of the container is switched on, when the ink container 1 is correctly mounted at the container exchange position. The control for these operations are effected, similarly to the control of the ink ejection of the recording head, in accordance with the control data (control signals) supplied to the ink container through the flexible cable 206 and the wireless communication with the control circuit of the main assembly side.

Figure 19:
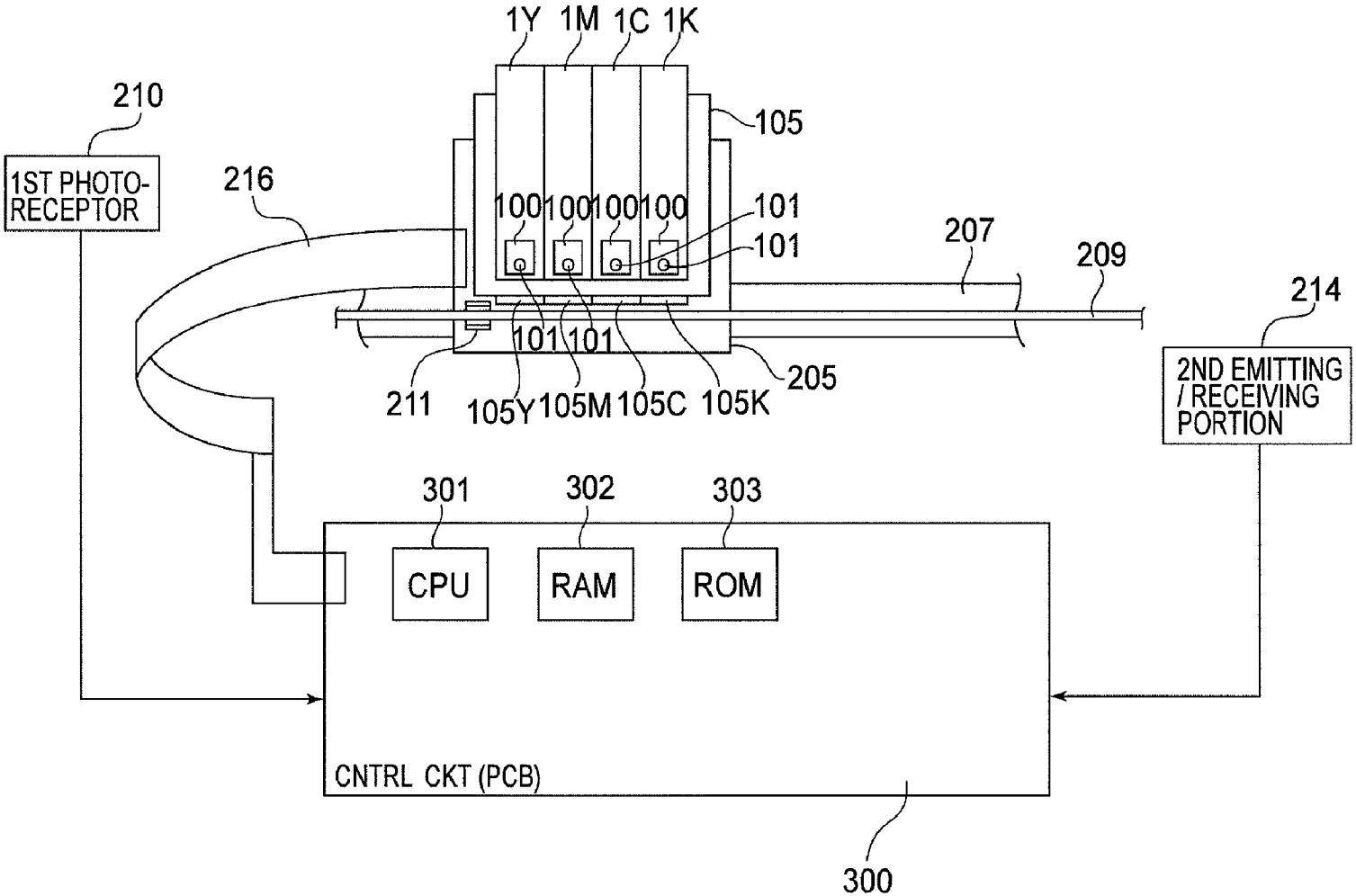
FIG. 19 is a block diagram showing a structure of a control system of the ink jet printer.

2. Structure of Control System:

2.1 General Arrangement (FIG. 19):

FIG. 19 is a block diagram showing an example of a structure of a control system of the ink jet printer. The control system mainly comprises a control circuit (PCB (printed-wiring board)) in the main assembly of the printer, and the structure for the light emission of the LED of the ink container to be controlled by the control circuit.

In FIG. 19, the control circuit 300 executes data processing relating to the printer and operation control. More particularly, a CPU 301 carried out processes which will be described hereinafter in conjunction with FIG. 25-FIG. 28 in accordance with a program stored in ROM 303. RAM 302 is used as a work area in the process execution of the CPU 301.

As shown in FIG. 19, the recording head unit 105 carried on the carriage 205 has recording heads 105K, 105Y, 105M and 105C which have a plurality of ejection outlets, respectively, for ejecting black (K), yellow (Y), magenta (M) and cyan (C) inks, respectively. On the holder of the recording head unit 105, the ink containers 1K, 1Y, 1M and 1C are detachably mounted corresponding to the respective recording heads.

Each of the ink containers 1, as described hereinbefore, is provided with the substrate 100 provided with the LED 101, the display control circuit therefor and the antenna. When the ink container 1 is correctly mounted to the recording head unit 105, the antenna on the substrate 100 is close to the antenna substrate which is provided on the recording head unit 105 and which is common for the ink containers 1. The connector (unshown) provided in the carriage 205 and the control circuit 300 provided in the main assembly side are electrically connected for transmission of signals through the flexible cable 206. Furthermore, by the mounting of the recording head unit 105 on the carriage 205, the connector of the carriage 205 and the connector of the recording head unit 105 are electrically contacted with each other for signal transmission. With such connecting and communicating structure, the signals can be transmitted between the control circuit 300 of the main assembly side and the respective ink containers 1. Thus, the control circuit 300 can perform the control operation for turning-on and -off of LED in accordance with the sequence which will be described hereinafter in conjunction with FIG. 25-FIG. 27.

The control of ink ejections of the recording heads 105K, 105Y, 105M and 105C, is carried out similarly through the flexible cable 206, the connector of the carriage 205, the connector of the recording head unit with the signal connection between the driving circuit and so on provided in the recording head, and the control circuit 300 in the main assembly side. Thus, the control circuit 300 controls the ink ejections and so on for the respective recording heads.

The first light receiving portion 210 disposed adjacent one of the end portions of the movement range of the carriage 205 receives light from the LED 101 of the ink container 1, and a signal indicative of the event is supplied to the control circuit 300. The control circuit 300, as will be described hereinafter, responds to the signal to discriminate the position of the ink container 1 in the carriage 205. In addition, an encoder scale 209 is provided along the movement path of the carriage 205, and the carriage 205 is correspondingly provided with an encoder sensor 211. The detection signal of the sensor is supplied to the control circuit 300 through the flexible cable 206, by which the movement position of the carriage 205 is obtained. The position information is used for the respective recording head ejection controls, and is used also for light validation process in which the positions of the ink containers are detected, which will be described hereinafter in conjunction with FIG. 25. A second light emitting/receiving portion 214 is provided in the neighborhood of the predetermined position in the movement range of the carriage 205, includes a light emitting element and a light receiving element, and it functions to output to the control circuit 300 a signal relating to an ink remaining amount of each of the ink container 1 carried on the carriage 205. The control circuit 300 can detect the ink remaining amount on the basis of the signal.

Figure 20:
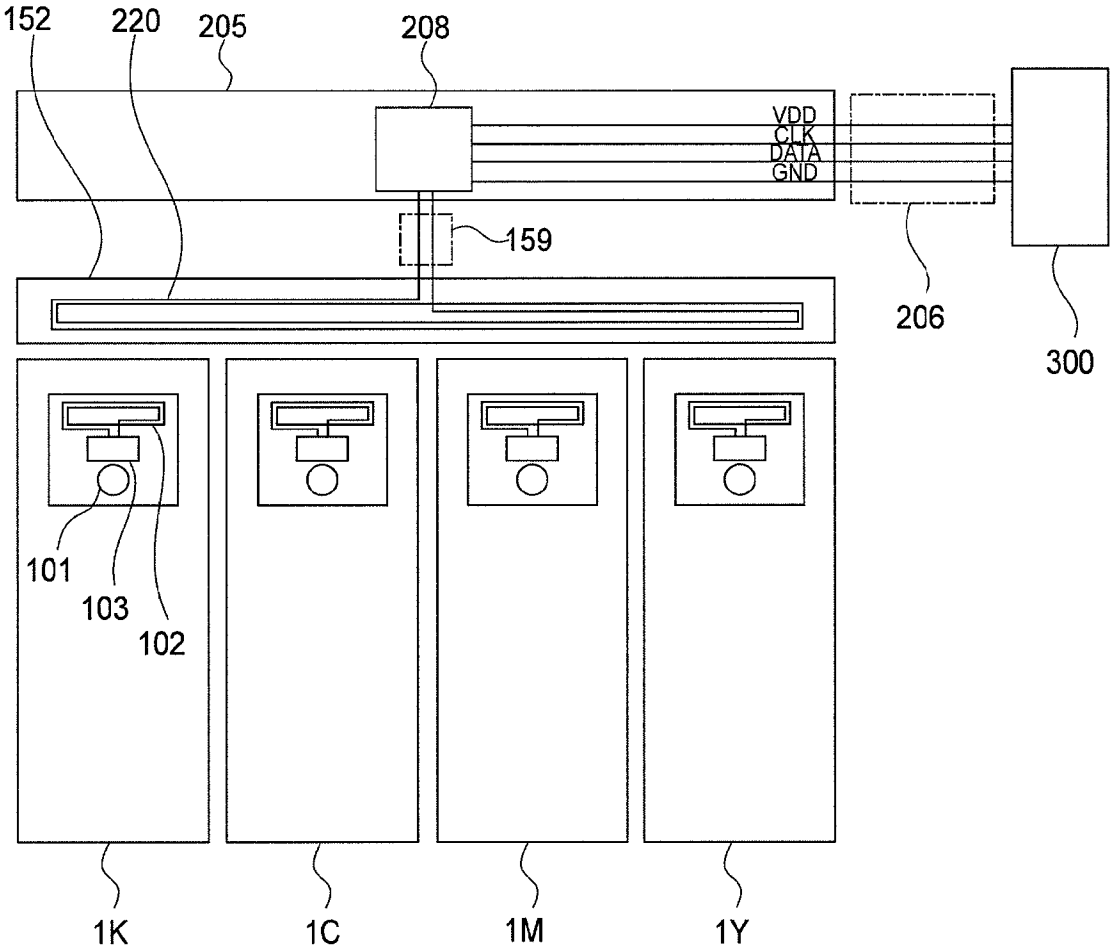
FIG. 20 shows structure of signal line wiring for signal transmission between the ink container and the flexible cable of the ink jet printer in terms of the substrate of the ink container.

2.2 Connecting Portion (FIG. 20-FIG. 24):

FIG. 20 shows a structure of signal line wiring for signal transmission with the ink container 1 in terms of the substrate 100 of the ink container 1.

As shown in FIG. 20, the carriage 205 is provided with a control circuit 208, and the signal line wiring from the main assembly side control circuit 300 to the control circuit 208 comprises four signal lines, for example. More particularly, the signal line wiring to the control circuit 208 includes a voltage source signal line VDD for electric power supply and a ground signal line GND. Furthermore, it includes a signal line DATA for feeding the control signal (control data) relating to the turning-on or flickering process of the LED101, and a clock signal line CLK therefor, namely, it includes four signal lines in total. In this embodiment, the description will be made with the four signal lines, but the present invention is not limited to such an example, and a plurality of control signal lines may be required as the case may be. The control circuit 208 mainly comprises a high frequency modulation and demodulation circuit for wireless communication of the DATA and CLK signals, and the control circuit 208 is electrically connected with a loop antenna 220 by wiring lead 159. The antenna 220 generates electromagnetic radiation of a shortwave band, and communicates with the antenna on the ink container side. The control circuit 208 is disposed on the carriage 205 in this embodiment, but may be disposed on the antenna substrate 152.

On the other hand, the substrate 100 of each of the ink containers 1 is provided with an antenna 102 for wireless communication with the main assembly side antenna 220. It is also provided with a controller 103 for signal processing for processing the high frequency signal received from the antenna 102 and for sending the high frequency signal from the antenna 102. Moreover, it is further provided with a LED101 actuated thereby.

Figure 21:
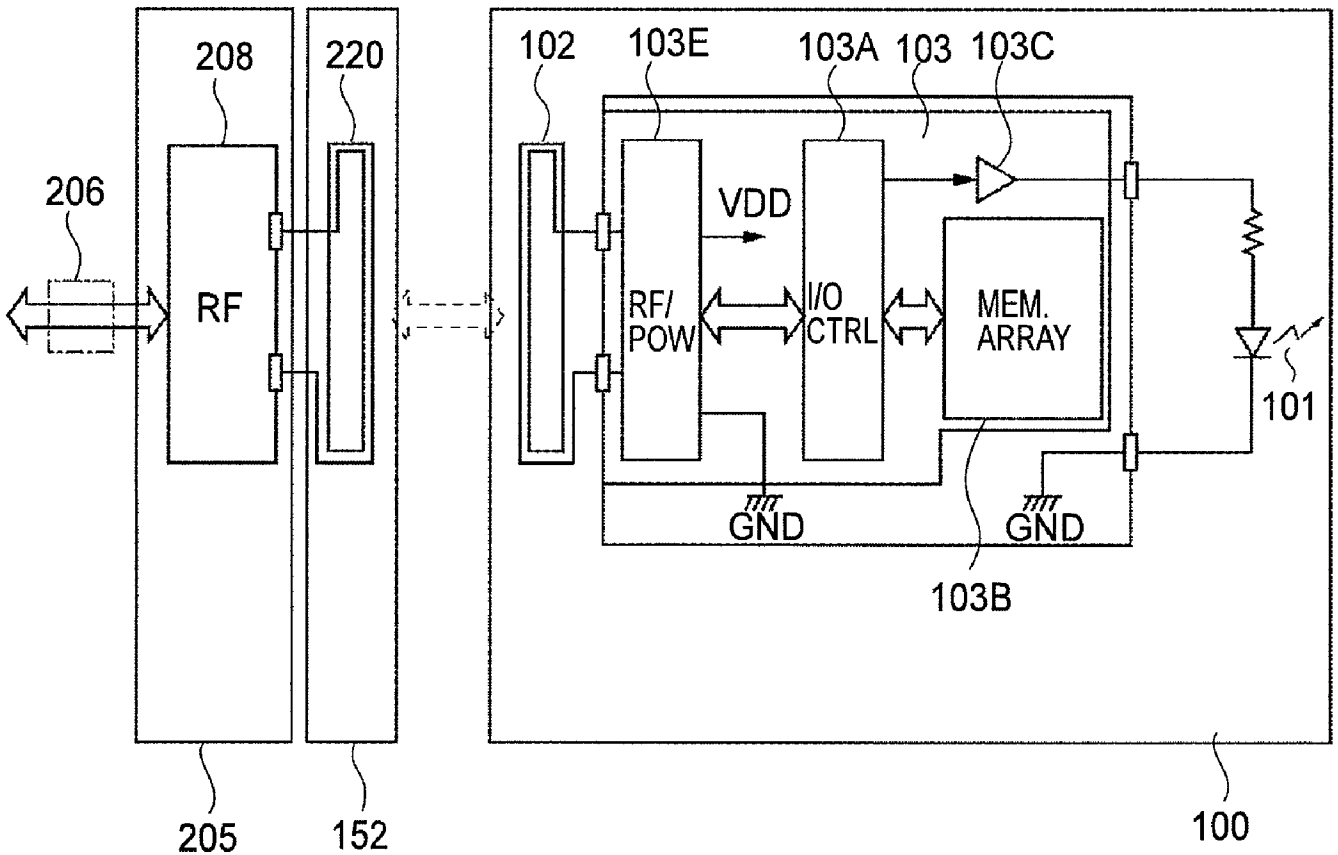

FIG. 21 is a circuit diagram illustrating the details of the substrate on which the controller and the like are provided. As shown in this Figure, the controller 103 comprises an I/O control circuit (I/O CTRL) 103A, a memory array 103B, a LED driver 103C, a high frequency modulation/demodulation circuit, and a voltage source circuit 103E. The demodulation circuit of the high frequency modulation/demodulation circuit demodulates the high frequency signal received by the main assembly side antenna 220 to obtain DATA and CLK signals. The voltage source circuit generates a voltage from the inputted electromagnetic radiation to supply the electric power to the I/O control circuit (I/O CTRL) 103A, the memory array 103B, the LED driver 103C and the LED101. The modulation circuit modulates the signal into a high frequency voltage to generate the electromagnetic radiation from the antenna 102 to send the information to the main assembly side from the memory array 103B.

The I/O control circuit 103A controls display driving for the LED101 and controls writing and reading of the data to and from the memory array 103B, in accordance with the demodulated control data. The memory array 103B is in the form of an EEPROM in this embodiment, and is able to store individual information of the ink container, such as information relating to the ink remaining amount in the ink container, the color information of the ink therein, and in addition, manufacturing information such as an number of the ink container, production lot number or the like. The color information is written in a predetermined address of the memory array 103B corresponding to the color of the ink stored in the ink container. For example, the color information is used as ink container discrimination information (individual information) which will be described hereinafter in conjunction with FIGS. 23 and 24. By this, it is possible to identify the ink container when the data is written in the memory array 103B and is read out therefrom, or when the actuation and deactuation of the LED 101 is controlled for the particular ink container. The data written in the memory array 103B or read out of it include, for example, the data indicative of the ink remaining amount. The ink container of this embodiment, as described hereinbefore, is provided in the bottom portion with a prism, and when the remaining amount of the ink becomes small, the event can be optically detected by means of the prism. In addition to that, the control circuit 300 of this embodiment counts the number of ejections for each of the recording heads on the basis of the ejection data. The remaining amount information is written in the memory array 103B of the corresponding ink container, and the information is read out. By doing so, the memory array 103B stores the information of the ink remaining amount in real time. The information represents the ink remaining amount with high accuracy since the information is provided with the aid of the prism, too. Also, it is possible to use it to discriminate whether the mounted ink container is a fresh one, or used and then remounted one.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

Figure 22:
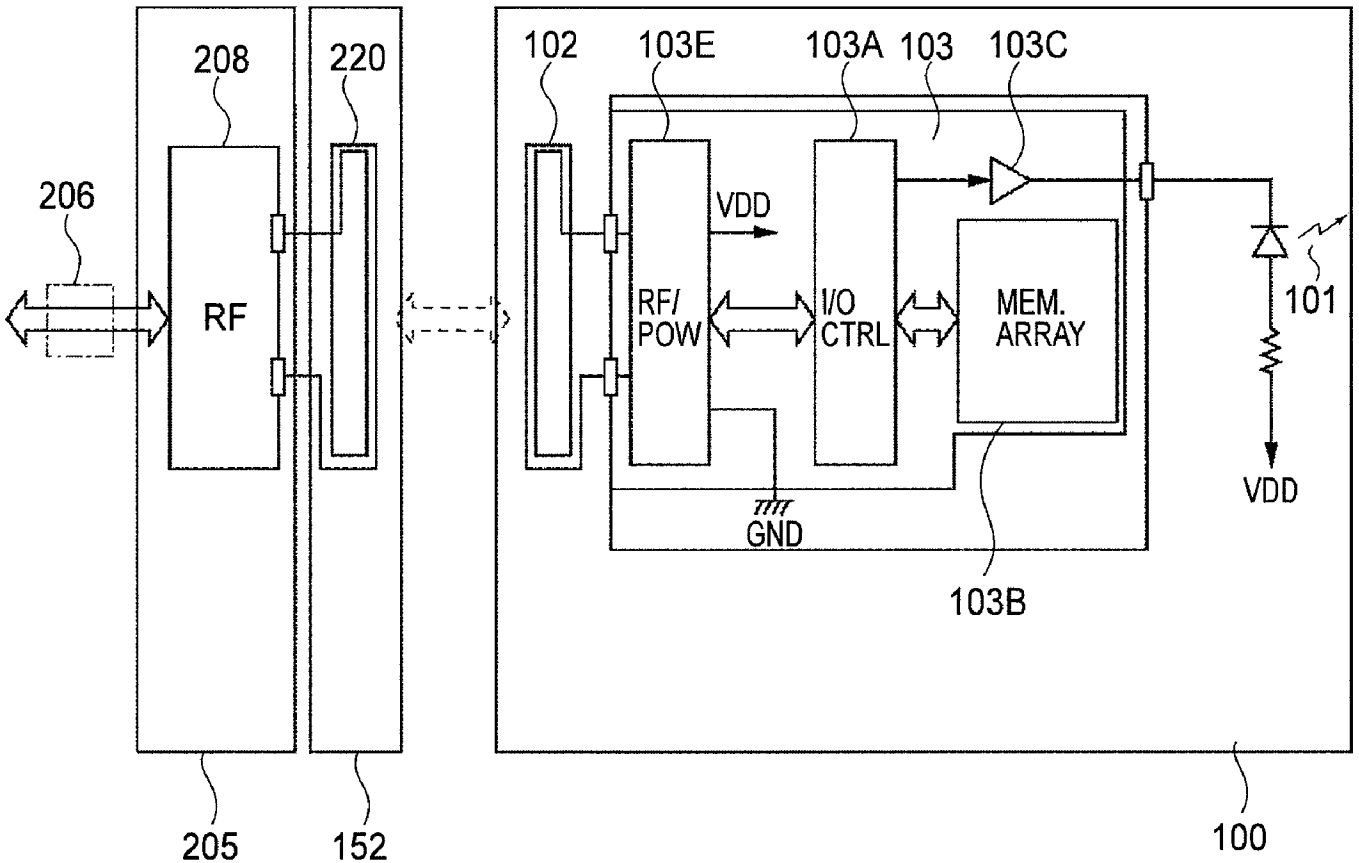
FIG. 22 is a circuit diagram of a modified example of the substrate of FIG. 21.

FIG. 22 is a circuit diagram of a modified example of the substrate of FIG. 21. This modified example is different from the example of FIG. 21 in the structure for applying the power source voltage to the LED 101, and more particularly, the voltage source voltage is supplied from the VDD voltage source pattern provided inside the substrate 100 of the ink container. Ordinarily, the controller 103 is built in a semiconductor substrate, and in this example, the connecting contact provided on the semiconductor substrate is only for the LED connecting contact. Reduction of the number of the connecting contacts is significantly influential to the area occupied by the semiconductor substrate, and in this sense, the modified example is advantageous in terms of cost reduction of the semiconductor substrate.

Figure 23:
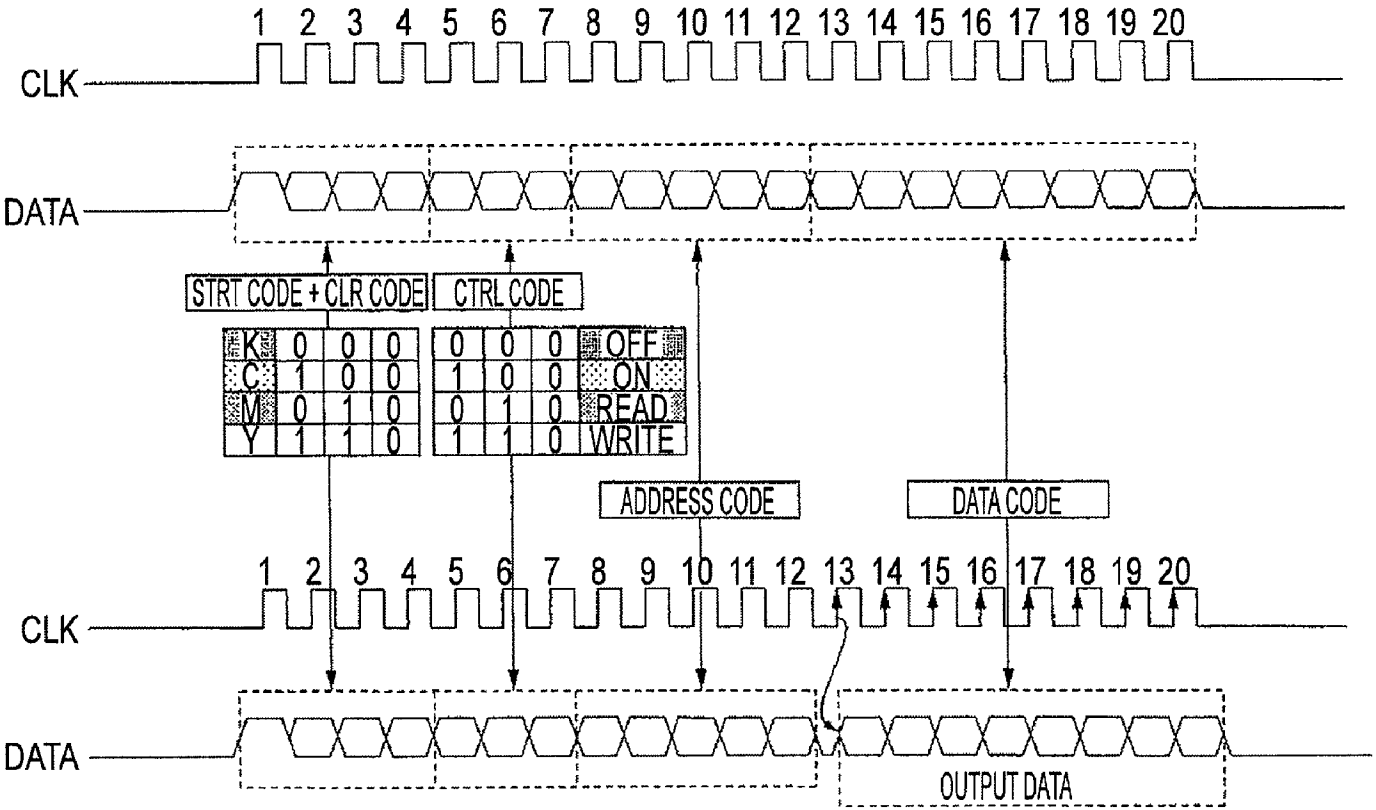
FIG. 23 is a timing chart illustrating the data writing and reading operations to and from a memory array of the substrate.
Figure 24:
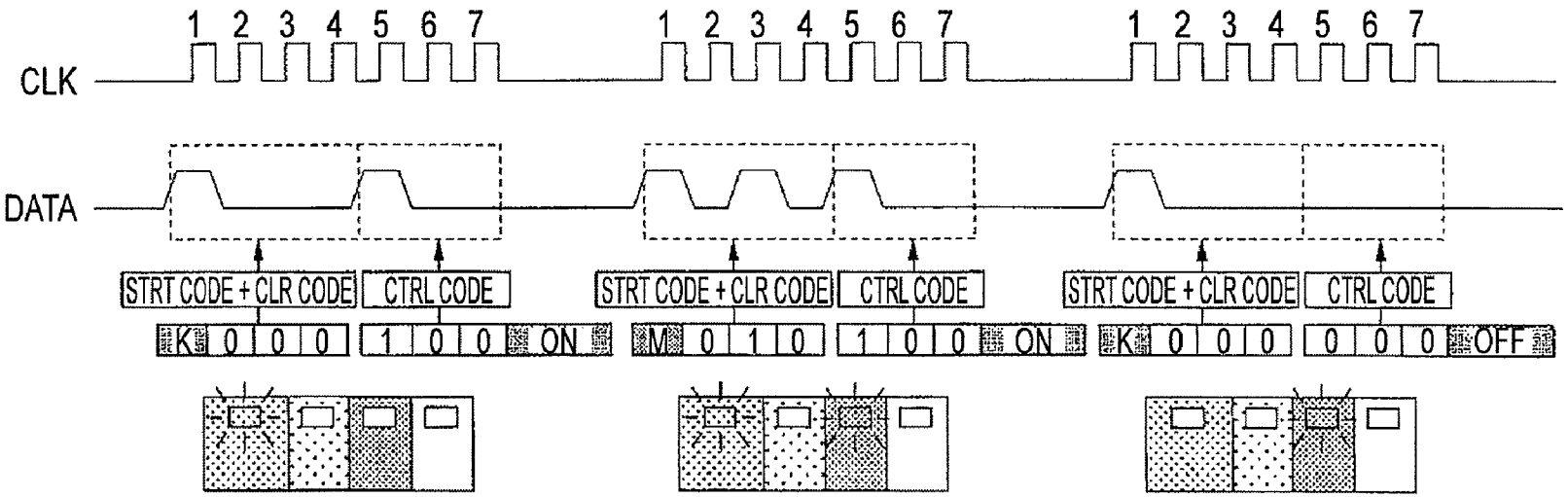
FIG. 24 is a timing chart illustrating actuation and deactuation of LED 101.

FIG. 23 is a timing chart illustrating the data writing and reading operations to and from the memory array 103B of the substrate. FIG. 24 is a timing chart illustrating actuation and deactuation of LED 101.

As shown in FIG. 23, regarding the writing in the memory array 103B, the signals are sent through the antennas 220 and 102 from the main assembly side control circuit 300. More particularly, the start code plus color information, control code, address code, data code, are supplied in the order named from the signal line DATA to the I/O control circuit 103A in the controller 103 of the ink container 1 in synchronism with the clock signal CLK. The start code signal in the start code plus color information indicates the beginning of the series of the data signals, and the color information signal is effective to identify the particular ink container which the series of data signal are related to. Here, the color of the ink includes not only the Y, M, C or the like color but also such ink having different densities.

The color information, as shown in the Figure, has a cord corresponding one of the ink colors K, C, M and Y. Using this, the I/O control circuit 103A compares the color information indicated by the cord and the color information stored in the memory array 103B, and only when they are the same, the data signals are taken in thereafter. If they are not the same, the subsequent data signals are ignored. Therefore, even though the data signal is supplied commonly to all of the ink containers from the main assembly side through the common signal line DATA shown in FIG. 20, the ink container to which the data are concerned can be correctly identified since the data include the color information. Therefore, the processing on the basis of the subsequent data, such as the writing, reading of the subsequent data, actuation, deactuation of the LED, can be effected only to the identified ink container (that is, only to the right ink container). As a result, (one) common data signal line is enough for all of the four ink containers to write the data in, to actuate the LED and to deactuate the LED, thus reducing the required number of the signal lines. As will be readily understood, (one) common data signal line is enough irrespective of the number of the ink containers.

As shown in FIG. 23, the control modes of this embodiment include OFF and ON codes for actuation and deactuation of the LED which will be described hereinafter, and READ and WRITE codes for reading out of the memory array and writing therein. In the writing operation, the WRITE code follows the color information code for identifying the ink container. The next code, i.e., the address code indicates an address in the memory array in which the data are to be written in, and the last code, i.e., the data code indicates the content of information to be written in.

The content indicated by the control code is not limited to the example described above, and, for example, control codes for verification command and/or continuous reading command may be added.

For the reading operation, the structure of the data signal is the same as in the case of the writing operation. The code of the start code plus color information is taken by the I/O control circuit 103A of all of the ink containers, similarly to the case of the writing operation. The subsequent data signal is taken in only by the I/O control circuit 103A of the ink container having the same color information. What is different is that read data are outputted in synchronizm with rising of the first clock (13th clock in FIG. 23) after the address is designated by the address code. Thus, the I/O control circuit 103A effects control to prevent interference of the read data with another input signal even though the data signals of the ink containers communicate with the common (one) data signal line.

As shown in FIG. 24, with respect to the actuation (turning-on) and the deactuation (turning-off) of the LED 101, the data signal of the start code plus color information is first sent to the I/O control circuit 103A through the signal line DATA from the main assembly side, similarly to the foregoing. As described hereinbefore, the right ink container is identified on the basis of the color information, and the actuation and deactuation of the LED 101 by the control code fed subsequently, are effected only for the identified ink container. The control codes for the actuation and the deactuation, as described hereinbefore in conjunction with FIG. 23, include one of ON code and OFF code which are effective to actuate and deactuate the LED 101, respectively. Namely, when the control code indicates ON, the I/O control circuit 103A outputs an ON signal to the LED driver 103C, as described hereinbefore in conjunction with FIG. 22, and the output state is continuously maintained thereafter. On the contrary, when the control code indicates OFF, the I/O control circuit 103A outputs an OFF signal to the LED driver 103C, and the output state is continuously maintained thereafter. The actual timing for the actuation or deactuation of the LED 101 is after 7th clock of the clock CLK for each of the data signals.

In the example of this Figure, the black (K) ink container which the leftmost data signal designates is first identified, and then, the LED 101 of the black ink K container is switched on. Then, the color information of the second data signal indicates magenta ink M, and the control code indicates actuation, and therefore, the LED 101 of the ink M container is switched on while the LED 101 of the ink K container is kept in ON state. The control code of the third data signal means instruction of deactuation, and only the LED 101 of the ink K container is deactuated.

As will be understood from the foregoing description, the flickering control of the LED is accomplished by the control circuit 300 of the main assembly side sending repeated actuation and deactuation control codes alternately for the identified ink container. The cyclic period of the flickering can be determined by selecting the cyclic period of the alternating control codes.

2.3 Control Process (FIG. 25-FIG. 31):

FIG. 25 is a flow chart illustrating control processes relating the mounting and demounting of the ink container according to the embodiment of the present invention, and particularly shows the actuation and deactuation control for the LED 101 of each of the ink container 1 by the control circuit 300 provided in the main assembly side.

The process shown in FIG. 25 starts in response to the user opening the main assembly cover of the printer 201 which is detected by a predetermined sensor. When the process is started, the ink container is mounted or demounted by step S101.

FIG. 26 is a flow chart of a mounting and demounting process of the ink container in FIG. 25. As shown in the Figure, in the mounting or demounting process, the carriage 205 moves at step S201, and the information of the state of ink container (individual information thereof) carried on the carriage 205 is obtained. The information of the state to be obtained here is an ink remaining amount or the like which is read out of the memory array 103B together with the number peculiar to the ink container. In step S202, the discrimination is made as to whether the carriage 205 reaches the ink container exchange position having been described in conjunction with FIG. 18 or not.

If the result of the discrimination is affirmative, step S203 is executed for ink container mounting confirmation control.

FIG. 27 is a flow chart showing in detail the mounting confirmation control in FIG. 26. First, in step S301, a parameter N indicative of the number of the ink containers carried on the carriage 205 is set, and a flag F (k) for confirmation of light emission of the LED correspondingly to the number of the ink containers, is initialized. In this embodiment, N is set to 4 since the number of the ink containers is 4 (K, C, M, and Y). Then, four flags F (k), k=1-4 are prepared, and they are all initialized to zero.

In step S302, a variable An of the flag relating to the order of mounting discrimination for the ink container is set to "1", and in step S303, the mounting confirmation control is effected for the A-th ink container. In this control, by the user sets the ink container at the correct position in the holder 150 of the recording head unit 105, the wireless communication between the antenna substrate 152 of the holder 150 and the antenna 102 of the ink container is enabled. By this, the control circuit 300 of the main assembly side, as described hereinbefore, identifies the ink container on the basis of the color information (individual information for the ink container), and the color information stored in the memory array 103B of the identified container is sequentially read out. The color information for the identification is not used for the already read out one or ones. In this control process, the discrimination is also made as to whether or not the read color information is different from the color information already read out after the start of this process.

In step S304, if the color information have been able to be read out, and the color information has been different from the already read out piece or pieces of information, it is then discriminated that ink container of the color information is mounted as the A-th ink container. Otherwise, it is discriminated that the A-th ink container is not mounted. Here, the "A-th" represents only the order of discrimination of the ink container, does not represent the order indicative of the mounted position of the ink container. When the A-th ink container is discriminated as being correctly mounted, the flag F (A) (the flag satisfying k=A among the prepared flags F(k), k=1-4) is set to "1" in step S305. Then, as described hereinbefore in conjunction with FIG. 24, the LED 101 of the ink container 1 having the corresponding color information is switched on. When it is discriminated that ink container is not mounted, the flag F (A) is set to "0" in step S311.

Then, in step S306, the variable A is incremented by 1, and in step S307, the discrimination is made as to whether or not the variable A is larger than N set in the step S301 (in this embodiment, N=4). If the variable A is not more than N, the process subsequent to step S303 is repeated. If it is discriminated as being larger than N, the fact means that mounting confirmation control has been completed for all of four ink containers. Then, in step S308, the discrimination is made as to whether or not the main assembly cover 201 is in an open position on the basis of an output of the sensor. When the main assembly cover is in a closed state, an abnormality state is returned to the processing routine of FIG. 26 in step S312 since there is a possibility that user has closed the cover although one or some of the ink containers are not mounted or are not properly mounted. Then, this process operation is completed.

When, on the contrary, the main assembly cover 201 is discriminated as being open in the step S308, the discrimination is made as to whether or not all of the four flags F (k), k=1-4 are "1", that is, whether the LEDs 101 are all switched on or not. If it is discriminated that at least one of the LEDs 101 is not switched on, the process subsequent to the step S302 is repeated. Until the user mounts or correctly remounts the ink container or ink containers of which the LED or LEDs 101 are not switched on, the LED or LEDs of the ink container or containers are switched on, and the process operation is repeated.

Figure 28:
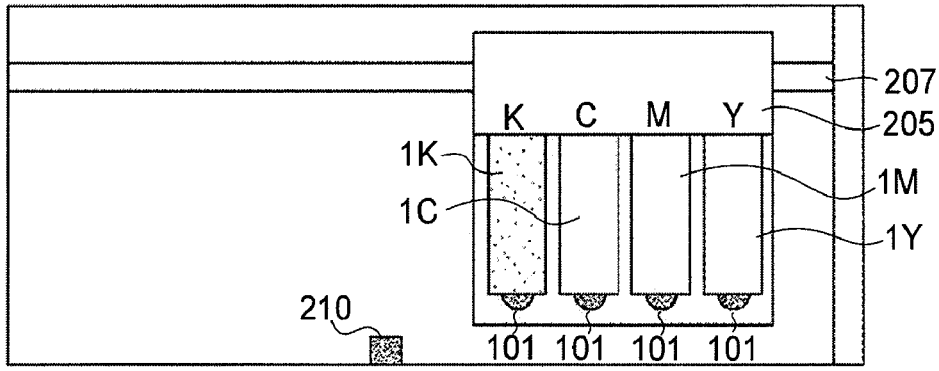
FIG. 28 shows a state (a) in which all of the ink containers are correctly mounted at correct positions, and therefore the LEDs are switched on, respectively, in the process of the control for the mounting and demounting of the ink containers, in which (b) shows movement of the carriage to a position for validation which is carried out using, light (light validation), after the main assembly cover is closed subsequently to the LED lightening.
Figure 28:
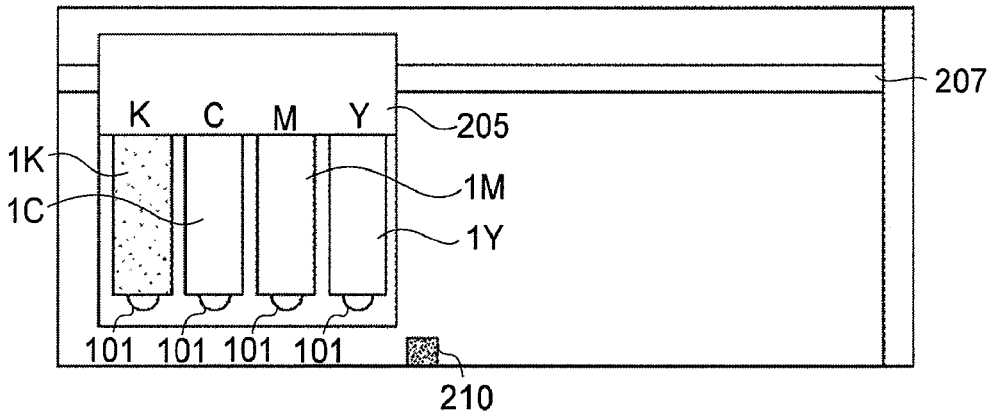

When all of the LEDs are discriminated as being switched on, a normal ending operation is carried out in step S310, and this process operation is completed. Then, the process returns to the processing routine shown in FIG. 26. FIG. 28 shows a state (a) in which all of the ink containers are correctly mounted at correct positions, and therefore, the LEDs are all switched on, respectively.

Referring back to FIG. 26, after the ink container mounting confirmation control (step S203) is executed in the above-described manner, the discrimination is made as to whether or not the control is normally completed, namely, whether or not the ink containers are properly mounted, in step S204. If the mountings are discriminated as being normal, the displaying device (FIG. 17 and FIG. 18) in the operating portion 213 is lighted green, for example, and in step S205, a normal ending is executed at step S206, and the operation returns to the processing routine shown in FIG. 25. When the abnormality mounting is discriminated, the displaying device in the operating portion 213 is flickered orange, for example, in step S207, and the abnormality ending process is carried out, and then, the operation returns the processing routine shown in FIG. 25. When the printer is connected with a host PC which controls the printer, the mounting abnormality display is also effected on the display of the PC simultaneously.

In FIG. 25, when the ink container mounting and dismounting process of step S101 is completed, the discrimination is made as to whether or not the mounting and demounting process is properly completed in step S102. If the abnormality is discriminated, the process operation waits for the user to open the main assembly cover 201, and in response to the opening of the cover 201, the process of the step S101 is started, so that process described in conjunction with FIG. 26 is repeated.

When the proper mounting or demounting process is discriminated in step S102, the process waits for the user to close the main assembly cover 201 in step S103, and the discrimination is made as to whether or not the cover 201 is closed or not in step S104. If the result of the discrimination is affirmative, the operation proceeds to light validation process of step S105. In this case, if the closing of the main assembly cover 201 is detected as shown by (b) in FIG. 28, the carriage 205 moves to the position for light validation, and the LEDs 101 of the ink containers are deactuated.

The light validation process is intended to discriminate whether or not the properly mounted ink containers are mounted at the correct positions, respectively. In this embodiment, the structures of the ink containers are not such that configurations thereof are made peculiar depending on the colors of the ink contained therein for the purpose of preventing the ink containers from being mounted at wrong positions. This is for the simplicity of manufacturing of the ink container bodies. Therefore, there is a possibility that ink containers are mounted at wrong positions. Therefore, the light validation process is effective to detect such wrong mounting and to notify the user of the event. By this and the efficiency and low cost of the ink container manufacturing are accomplished since it is not required to make the configurations of the ink containers different from each other depending on the colors of the ink.

Figure 29:
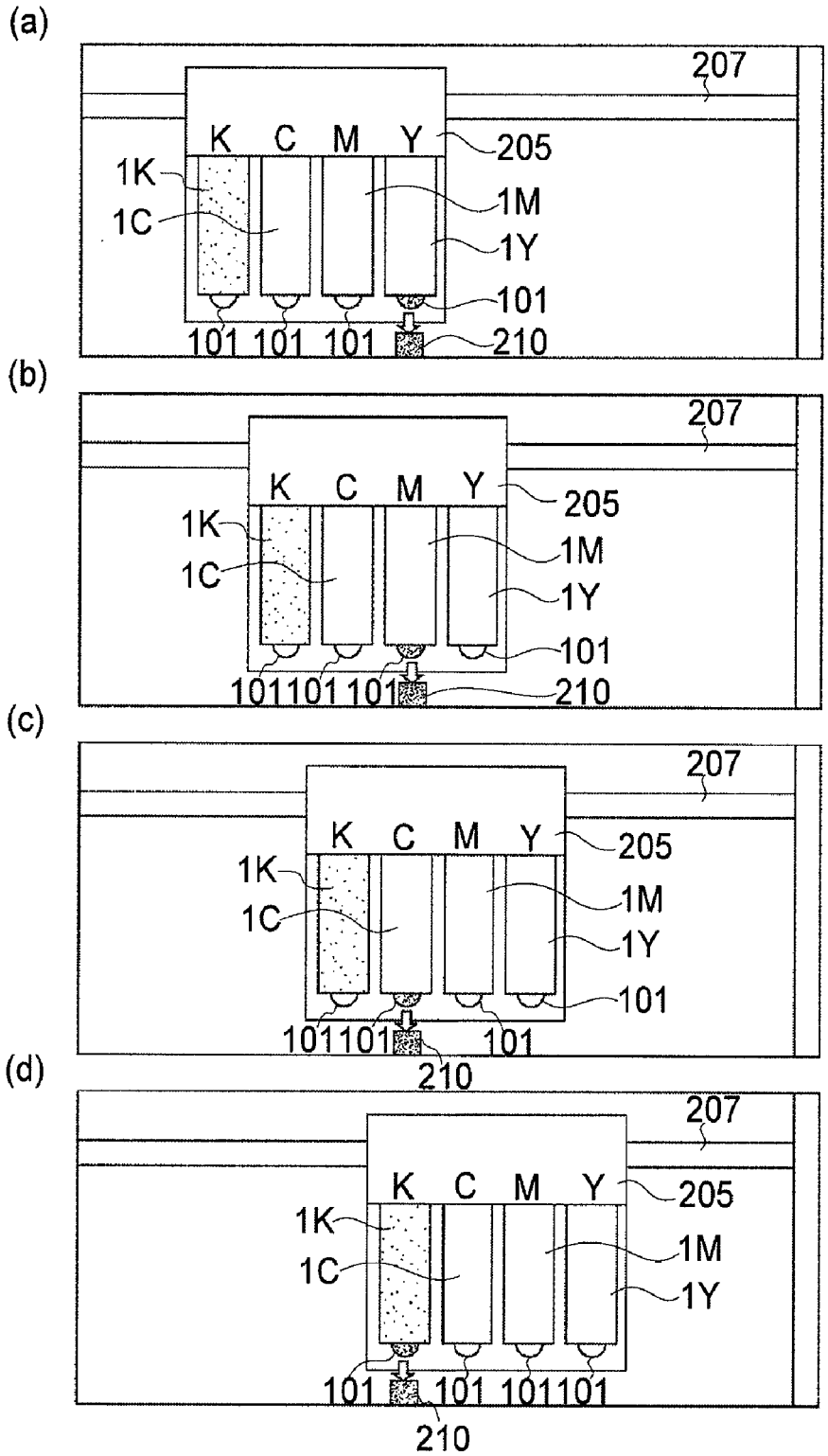
FIG. 29 illustrates the light validation process (a)-(d).
Figure 30:
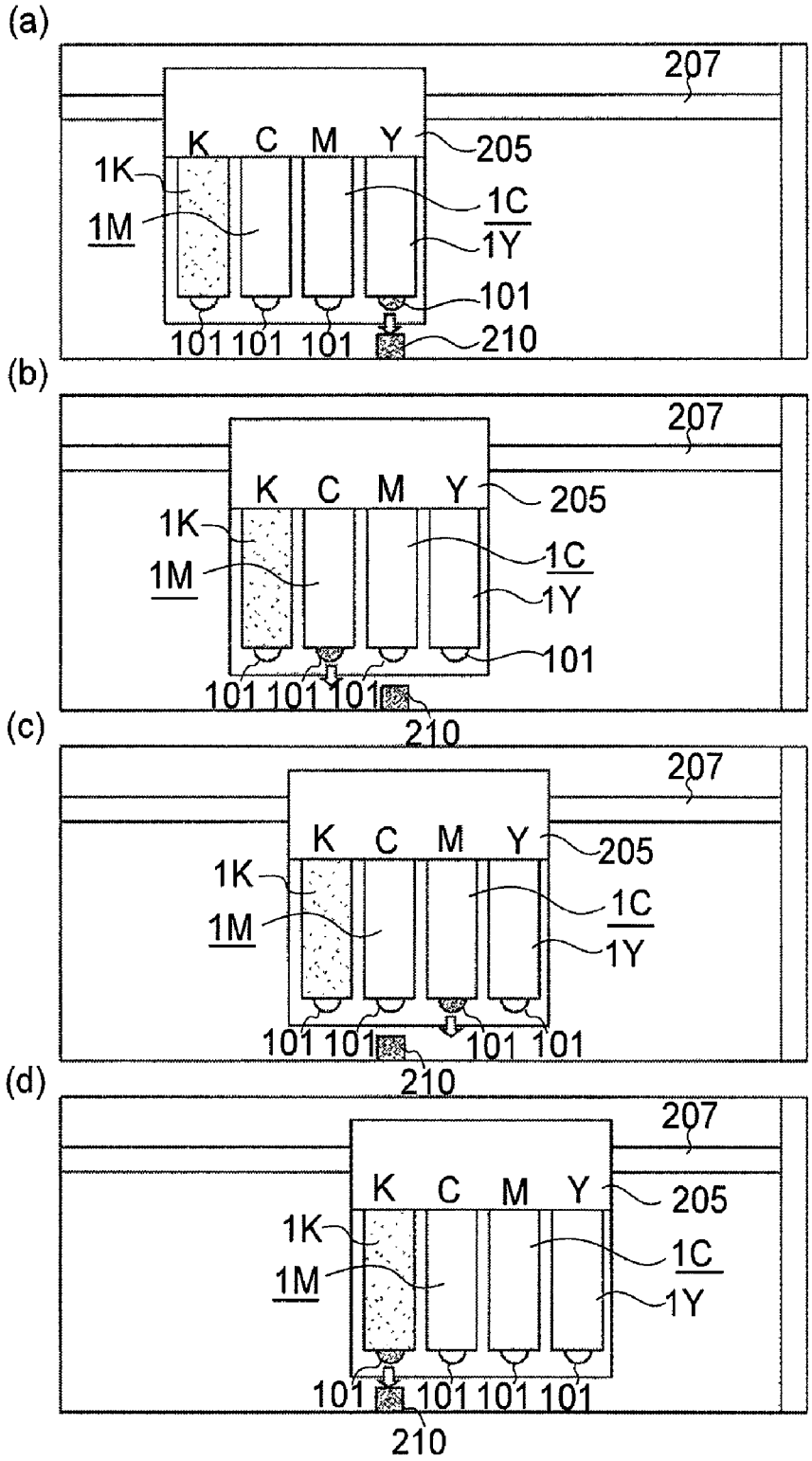
FIG. 30 also illustrates the light validation process (a)-(d).

FIG. 29 illustrates the light validation process (a)-(d), and FIG. 30 also illustrates the light validation process (a)-(d).

As shown by (a) in FIG. 29, the movable carriage 205 first starts moving from the lefthand side to the righthand side in the Figure toward the first light receiving portion 210. When the ink container placed at the position for a yellow ink container comes opposed to the first light receiving portion 210, a signal for actuating the LED 101 of the yellow ink container is outputted in order to switch it on and to keep the on-state for a predetermined time duration, by the control having been described in conjunction with FIG. 24. When the ink container is placed at the correct position, the first light, receiving portion 210 receives the light from the LED 101, so that control circuit 300 discriminates that ink container 1Y is mounted at the correct position.

While moving the carriage 205, as shown by (b) in FIG. 29, when the ink container placed at the position for a magenta ink container comes opposed to the first light receiving portion 210, a signal for actuating the LED 101 of the magenta ink container is outputted to switch it on and to keep the on-state for a predetermined time duration, similarly. In the example shown in the Figure, the ink container 1M is mounted at the correct position, so that first light receiving portion 210 receives the light from the LED. As shown by (b)-(d) in FIG. 29, the light is emitted sequentially, while changing the position of discrimination. In this Figure, all of the ink containers are mounted at correct positions.

On the contrary, if a cyan ink container 1C is erroneously mounted at a position for a magenta ink container 1M, as shown by (b) in FIG. 30, the LED 101 of the ink container 1C which is opposed to the first light receiving portion 210 is not actuated, but the ink container 1M mounted at another position is switched on. As a result, the first light receiving portion 210 does not receive the light at the predetermined timing, so that control circuit 300 discriminates that mounting position has an ink container other than the ink container 1M (right container). Correspondingly, if a magenta ink container 1M is erroneously mounted at a position for a cyan ink container 1C, as shown by (c) in FIG. 30, the LED 101 of the ink container 1M which is opposed to the first light receiving portion 210 is not actuated, but the ink container 1C mounted at another position is switched on.

In this manner, the light validation process with the control circuit 300 described above is effective to identify the ink container or ink containers not mounted at the correct position. If the mounting position does not have the correct ink container mounted thereto, the color of the ink container erroneously mounted there can be identified by sequentially actuating the LEDs of the other three color ink containers.

In FIG. 25, after the light validation process in the step S105, the discrimination is made as to whether or not the light validation process is properly completed or not in step S106. When the proper completion of the light validation is discriminated, the displaying device in the operating portion 213 is lighted up green, for example, in step S107, and the process ends. On the other hand, if the ending is discriminated as being abnormal, the displaying device in the operating portion 213 is flickered orange at step S109, and the LED 101 of the ink container which is not mounted at the correct position and which has been identified in the step S105 is flickered or switched on in step S105. In this manner, when the user opens the main assembly cover 201, the user is notified of the ink container which is not mounted at the correct position, so that user is prompted to remount it to the correct position.

Figure 31:
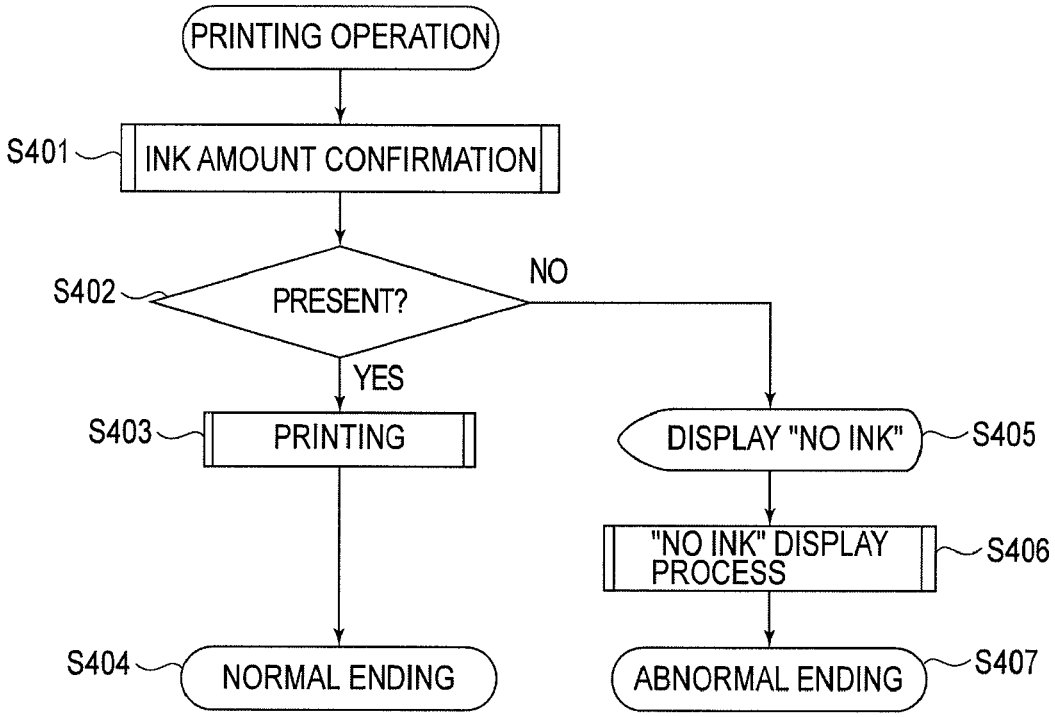
FIG. 31 is a flow chart illustrating a recording process according to the embodiment of the present invention.

FIG. 31 is a flow chart illustrating a recording process according to the embodiment of the present invention. In this process, the ink remaining amount is first checked in step S401. In this process, an amount of printing is determined from the printing data of the job for which the printing is going to be effected, and the comparison is made between the determined amount and the remaining amount of the ink container to check whether the remaining amount is sufficient or not (confirmation process). In this process, the ink remaining amount may be the amount detected by the control circuit 300 on the basis of the counting.

In step S402, the discrimination is made as to whether the remaining ink amount is sufficient for the intended printing or not, on the basis of the confirmation process. On the other hand, if the result of the discrimination at the step S402 indicates a shortage of the ink, the displaying device of the operating portion 213 is flickered orange in the step S405, and in step S406, the LED 101 of the ink container 1 containing the insufficient amount of the ink is flickered or switched on (abnormal ending). When the recording device is connected with a host PC which controls the recording device, the ink remaining amount may be displayed on the display of the PC, simultaneously.

3. Other Embodiments (FIG. 32-FIG. 54):

In the first embodiment described in the foregoing, the first engaging portion 5 provided on the ink container rear side is inserted into the first locking portion 155 provided at the rear side of the holder, and the ink container 1 is rotated about the rotational pivot which is the inserted portion, while pushing the ink container front side down. When such a structure is employed, the preferable position of the substrate 100 is, as described hereinbefore, the front side which is away from the rotational pivot, and the first light receiving portion 210, and the first light emitting portion 101 for directing the light toward the first light receiving portion 210 and toward the user's eyes are integral with the substrate 100, accordingly.

However, in some cases, the position preferred by the substrate and the position required by the light emitting portion are different from each other, depending on the structures of the ink container and/or the mounting portion thereof. In such a case, the substrate and the light emitting portion may be disposed at proper positions. Therefore, they are not necessarily integral with each other.

Figure 32:
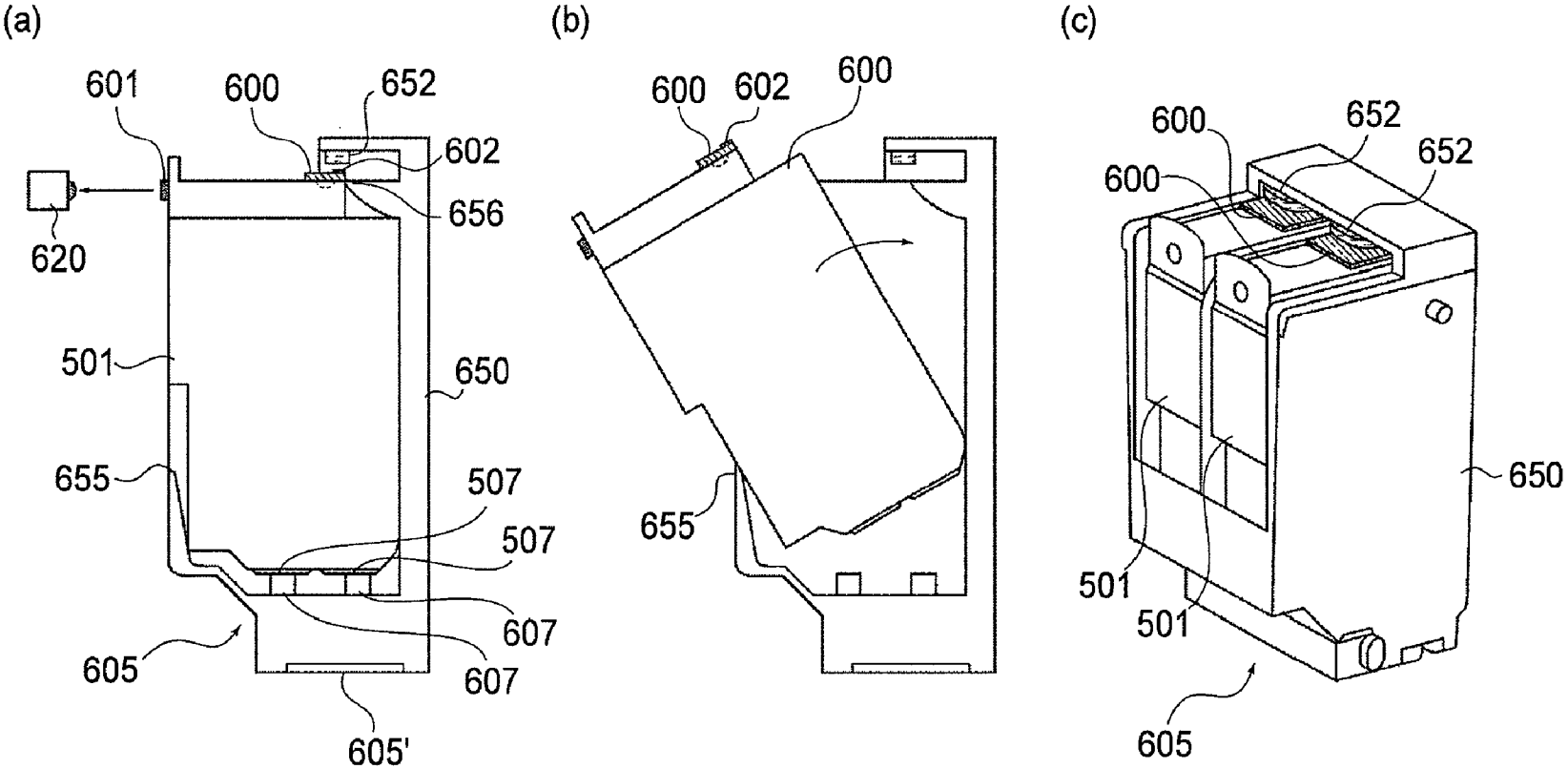
FIG. 32 illustrates structures of an ink container and a mounting portion thereof according to another embodiment of the present invention, and a mounting operation thereof (a)-(c).

FIG. 32 illustrates structures of an ink container and a mounting portion thereof according to another embodiment of the present invention ((a)-(c)).

As shown by (a) in FIG. 32, the ink container 501 of this embodiment of the present invention is provided on the top side adjacent the front side with a substrate 600 which has a light emitting portion 601 such as LED, which has a pad 602 at the top rear portion. When the light emitting portion 601 is actuated, the light is emitted toward the front side. A light receiving portion 620 is disposed at a position for receiving the light directed leftward in the Figure adjacent an end of a scanning range of the carriage. When the carriage comes to such a position, the light emitting portion 601 is controlled, so that recording device side can obtain predetermined information relating to the ink container 501 from the content of the light received by the light receiving portion. When the carriage is at the center portion of the scanning range, for example, the light emitting portion 601 is controlled, by which the user is able to see the state of lightening so that predetermined information relating to the ink container 501 can be readily recognized by the user.

As shown by (c) in FIG. 32, the recording head unit 605 comprises a holder 650 for detachably holding a plurality of ink containers (two, in the example of the Figure), a recording head 605' provided at the bottom side thereof. By mounting the ink container 501 in the holder 650, an ink introduction opening 607 of the recording head side located in the inner bottom portion of the holder is connected with an ink supply port 507 located in the bottom portion of the ink container, so that ink fluid communication path is established therebetween. The holder 650 is provided on a rear side thereof with a locking portion 656 for locking the ink container 501 at the complete mounting position with the engaging portion 655 (rotational center) at the front side. Adjacent the locking portion 656, there is provided an antenna 652 for communication with the substrate 600 antenna 602.

When the ink container 501 is mounted to the recording head unit 605, the ink container 501 is handled at the front side of the holder 650. As shown by (b) in FIG. 32, the user presses the lower edge portion of the ink container rear side to the rear side of the holder 650 to bring the ink container front side into engagement with the engaging portion 655 of the holder 650. With this state, the upper portion of the front side of the ink container 501 is pressed toward the rear side, by which the ink container 501 is mounted in the holder while rotating in the direction indicated by an arrow about the engaging portion 655. Shown in (a) and (c) in FIG. 32 is the ink container 501 which has been completely mounted, wherein the ink supply port 507 and the ink introduction opening 607 are connected to each other, and the antenna 602 and the antenna 652 are close to each other.

The structures of the engaging portion 655 of the holder 650 and the locking portion 656 and the corresponding structure of the ink container 501 side, may be properly determined by one skilled in the art. In the example shown in the Figure, the substrate 600 is provided on the top surface of the ink container 501, and extends in parallel with the top surface, but this is not limiting, and it may be inclined as in the first embodiment. Furthermore, the holder 650 and the structural members relating to it are not necessarily provided in the head unit.

Figure 33:
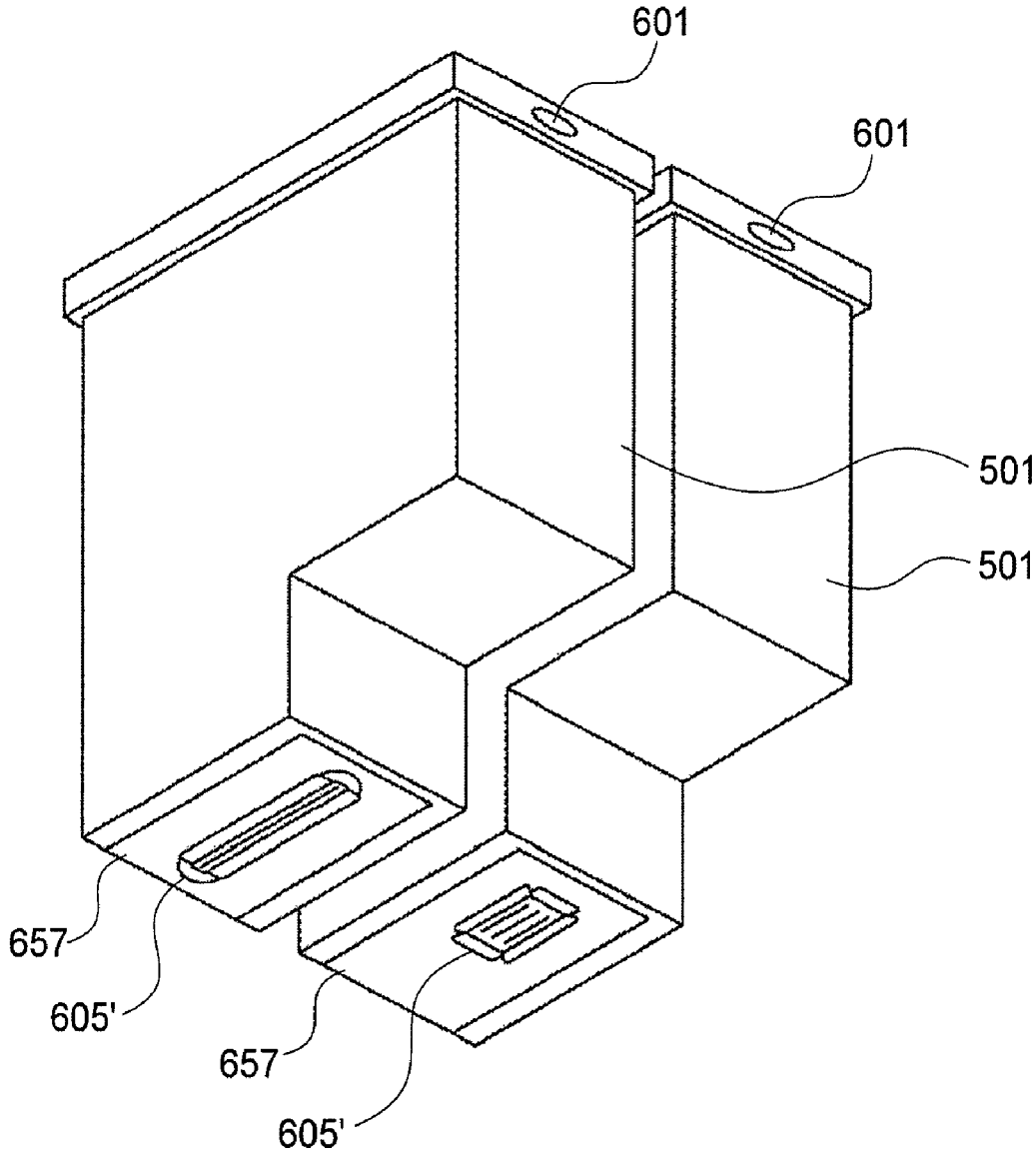
FIG. 33 is a perspective view illustrating a modified example of the structure of FIG. 32.

FIG. 33 shows a modified example of FIG. 32 structure, and shows two recording head units (liquid containing cartridges) each of which comprises an ink container 501 and a recording head 605' which are integral with each other. In this embodiment, one of the units is a cartridge for black ink, and the other is a cartridge for yellow, magenta and cyan inks.

The holder 650 may be provided with similar structures corresponding to such a structure. In this embodiment, the control circuit for the light emitting portion 601 disposed on the front side may be provided at a proper position on the head unit. For example, a control circuit is provided on the driving circuit substrate having an integral recording head 605', and the wiring is extended to the light emitting portion 601. In such a case, a driving circuit for the recording head 605' and the control circuit for the light emitting portion 601 are connected with an electrical contact portion on the carriage through an unshown electrical contact portion.

Figure 34:
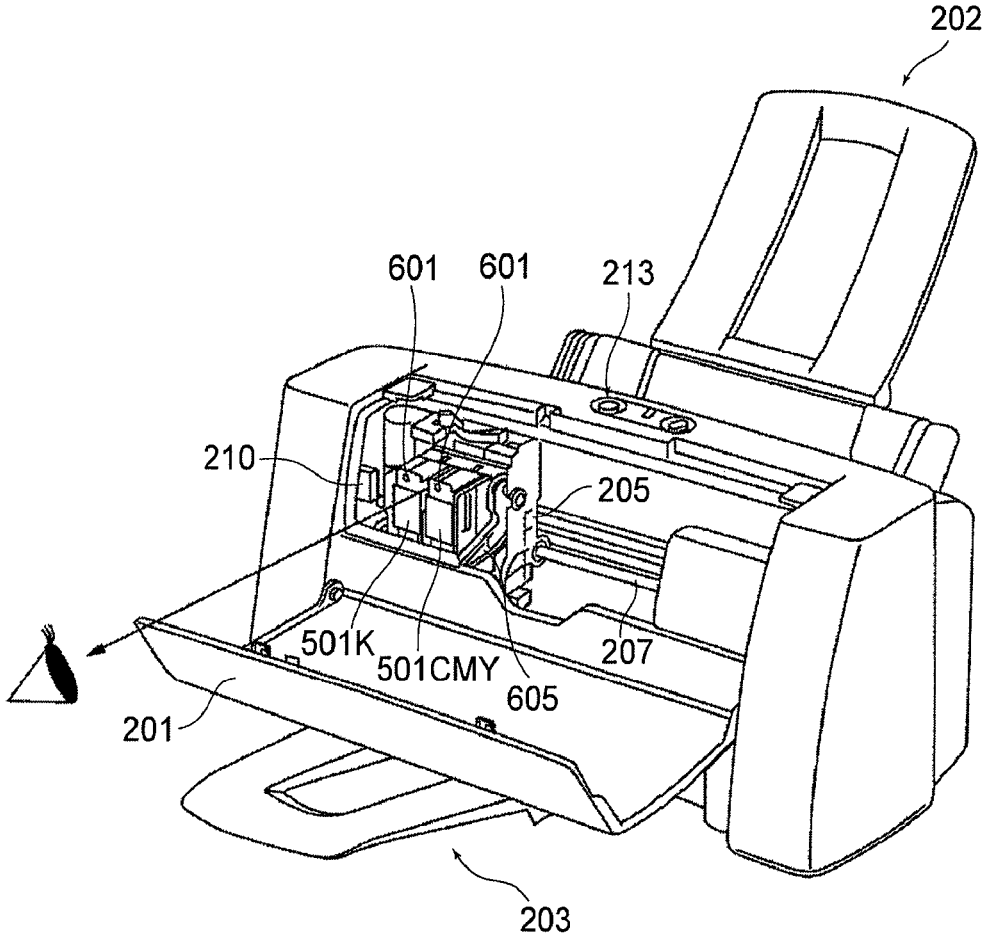
FIG. 34 is a perspective view of a printer to which the ink container according to said another embodiment of the present invention.

FIG. 34 is a perspective view of a printer with which the ink container according to said another embodiment of the present invention is usable, wherein the main assembly cover is shown in the open state. The same reference numerals as in Embodiment shown in FIG. 17 and FIG. 18 are assigned to the elements having the corresponding functions in this embodiment, and the detailed description thereof is omitted for simplicity.

As shown in FIG. 34, an ink container 501K containing black ink, and an ink containers 501CMY having integral accommodating chambers containing cyan, magenta and yellow inks separately, are mounted in the holder of the recording head unit 605 on the carriage 205. In each of the ink containers, as described hereinbefore, the LED 601 is provided as a separate member from the substrate, and the user can see the LEDs 601 at the front side when the ink container is mounted at the exchange position. Corresponding to the position of the LEDs, a light receiving portion 210 is provided in the neighborhood of one of the end portions of the movement range of the carriage 205.

Figure 35:
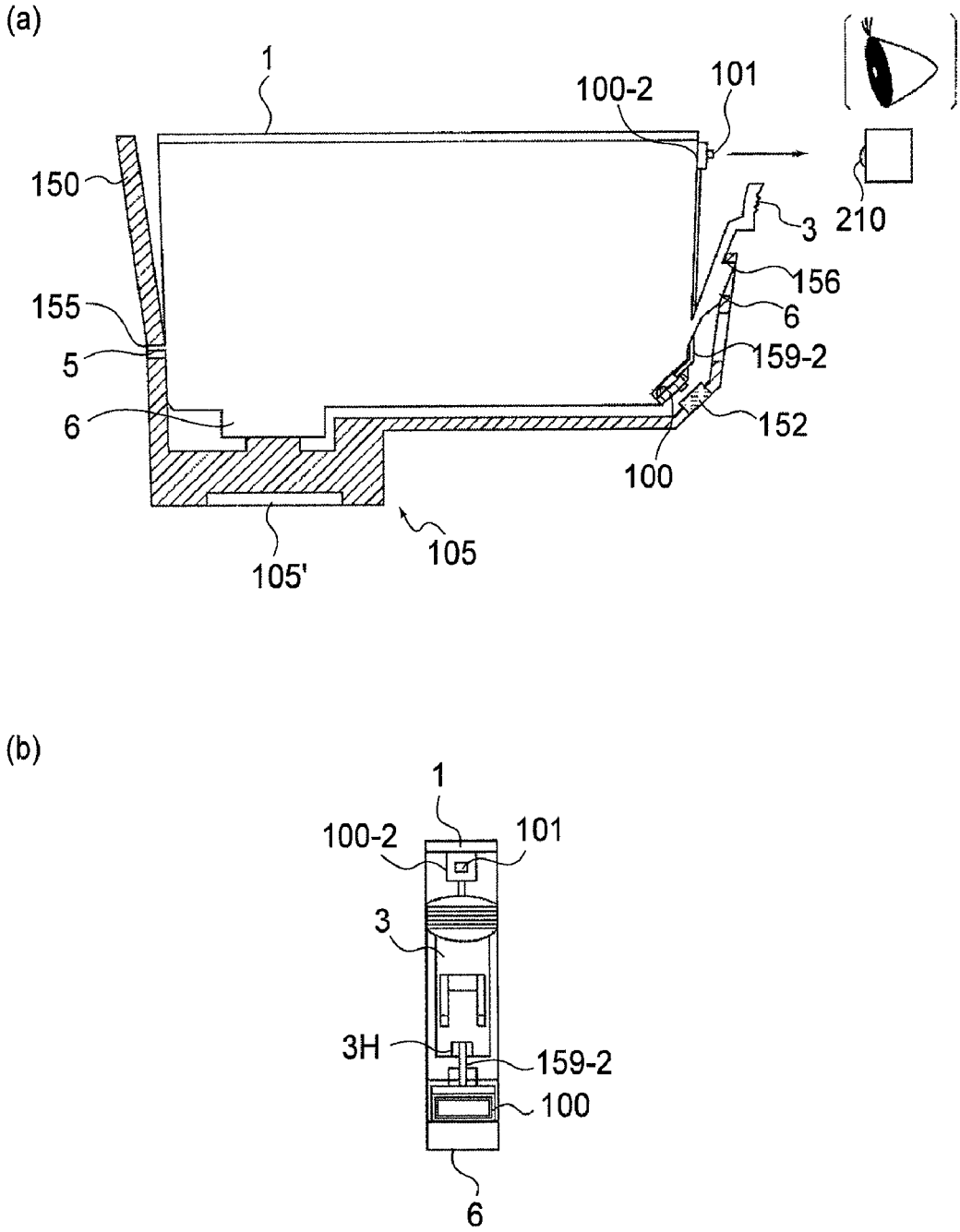
FIG. 35 is a schematic side view (a) and a schematic front view (b) of an ink container according to a further embodiment of the present invention.

FIG. 35 is a schematic side view (a) and a schematic front view (b) of an ink container according to a further embodiment of the present invention, wherein the first embodiment is modified by placing the substrate and the light emitting portion at different positions.

In this embodiment, substrates 100-2 each having a light emitting portion 101 such as a LED is provided on the top portion of ink container front side. Similarly to the foregoing embodiment, the substrate 100 is provided on an inclined surface portion since doing so is preferable from the standpoint of satisfactory communication with the antenna substrate 152 provided on the carriage side, the protection from the ink, and the substrate 100 is connected with the substrate 100-2 or the light emitting portion 101 by wiring portion159-2 so that electric signal can be transmitted therebetween. Designated by 3H is a hole formed in a base portion of a supporting member 3 to extend the wiring portion159-2 along the ink container casing.

In this embodiment, when the light emitting portion 101 is actuated, the light is directed toward the front side. A light receiving portion 210 is disposed at a position for receiving the light which is directed to the right in the Figure adjacent an end of the scanning range of the carriage, and when the carriage faces such a position, the light emission of the light emitting portion 101 is controlled. Recording device side can obtain the predetermined information relating to the ink container 1 from the content of the received light by the light receiving portion. By doing so, the recording device side can obtain the predetermined information relating to the ink container 1 from the content of the received light by the light receiving portion. When the carriage is at the center portion of the scanning range, for example, the light emitting portion 101 is controlled, by which the user is more easily able to see the state of lightening so that predetermined information relating to the ink container 1 can be recognized by the user.

Figure 36:
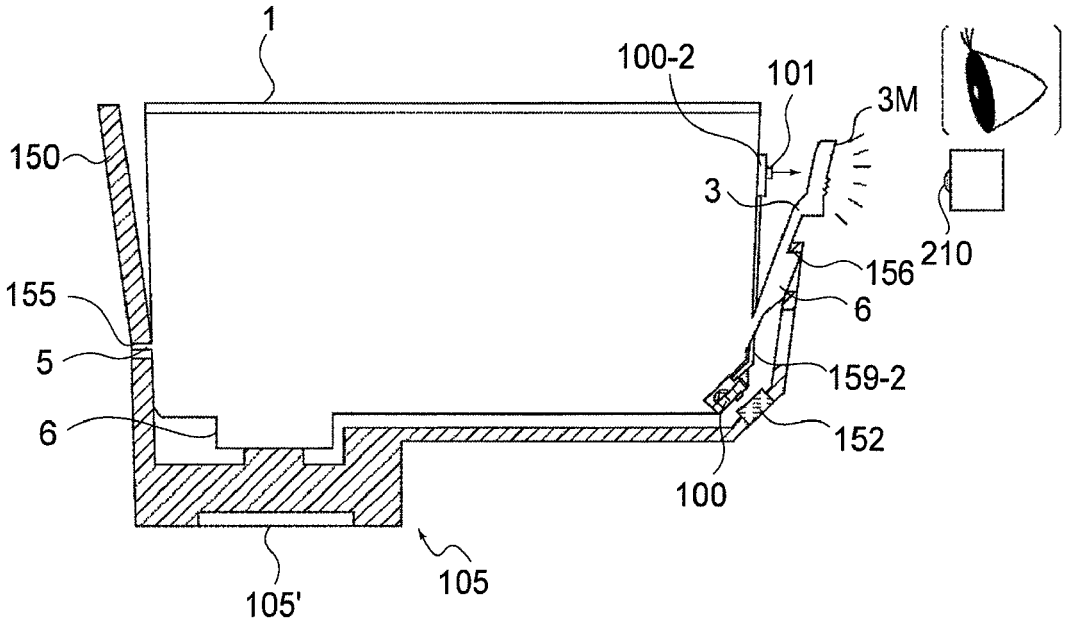
FIG. 36 is a schematic side view of a modified example of the structure of FIG. 35.

FIG. 36 is a schematic side view (a) and a schematic front view (b) of an ink container according to a modified embodiment of FIG. 35. In this embodiment, the light emitting portion 101 and the substrate100-2 supporting it, are provided on a back side of the operating portion 3M at the ink container front side, the operating portion 3M being the portion manipulated by the user. The functions and advantageous effects of this embodiment are the same as the foregoing embodiments. According to the embodiment, when the carriage is placed at the center portion of the scanning range, for example, the light emitting portion 101 is actuated, and therefore, the operating portion 3M of the supporting member 3 is also illuminated, so that user can intuitively understand the required manipulation, for example, exchange of the ink container. The operating portion 3M may be provided with a portion for transmitting or scattering a proper amount of the light to facilitate recognition of the illuminated state of the operating portion 3M.

Figure 37:
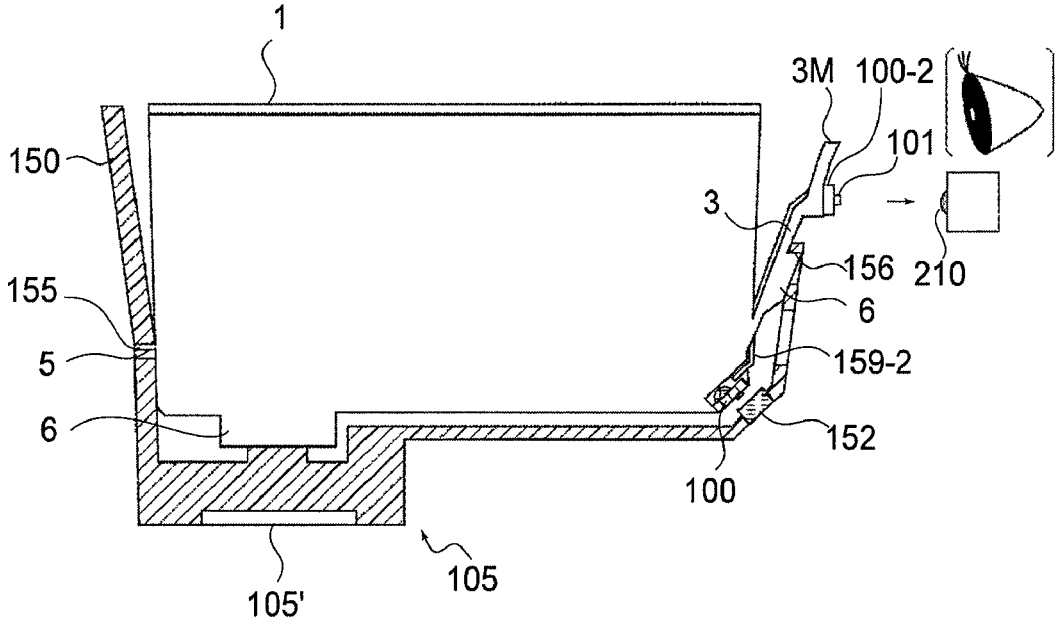
FIG. 37 is a schematic side view of a modified example of the structure of FIG. 35.

FIG. 37 is a schematic side view of a modified example of the structure of FIG. 35. In this embodiment, the substrate100-2 having the light emitting portion 101 is disposed on a front side of the operating portion 3M of the supporting member 3. The substrate 100, the substrate100-2 and the light emitting portion 101 are connected with each other through a hole 3H formed in the base portion of the supporting member 3 by a wiring portion159-2 extending along the supporting member 3. According to this example, the same advantageous effects as with FIG. 36 can be provided.

In the structure shown in FIG. 35-FIG. 37, a flexible print cable (FPC) may be used, by which the substrate 100, the wiring portion159-2 and the substrate100-2 may be one integral member.

In the foregoing embodiment, the liquid supply system is so-called continuous supply type wherein an amount of the ink ejected out is substantially continuously supplied to the printing head with the use of an ink container separably mounted to the recording head which reciprocates in a main-scanning direction. More particularly, the description of the foregoing embodiments has been made with respect to the ink container which is detachably mountable to the recording head which reciprocates on the carriage or the like. However, the present invention is applicable to another liquid supply system, wherein the ink container is integrally fixed to the recording head. Even with such a system, if the mounting position is not correct, the recording head receives data for another color, or the order of different color ink ejections is different from the predetermined order with the result of deteriorated recording quality.

The present invention is applicable to another continuous supply type, wherein the ink containers are separate from the recording heads, are provided at fixed positions in the recording device, and the fixed ink containers and the associated recording heads are connected by tubes to supply the inks to the recording heads. Intermediary containers which are fluidically between the ink container and the recording head may be carried on the recording head or carriage.

Figure 38:
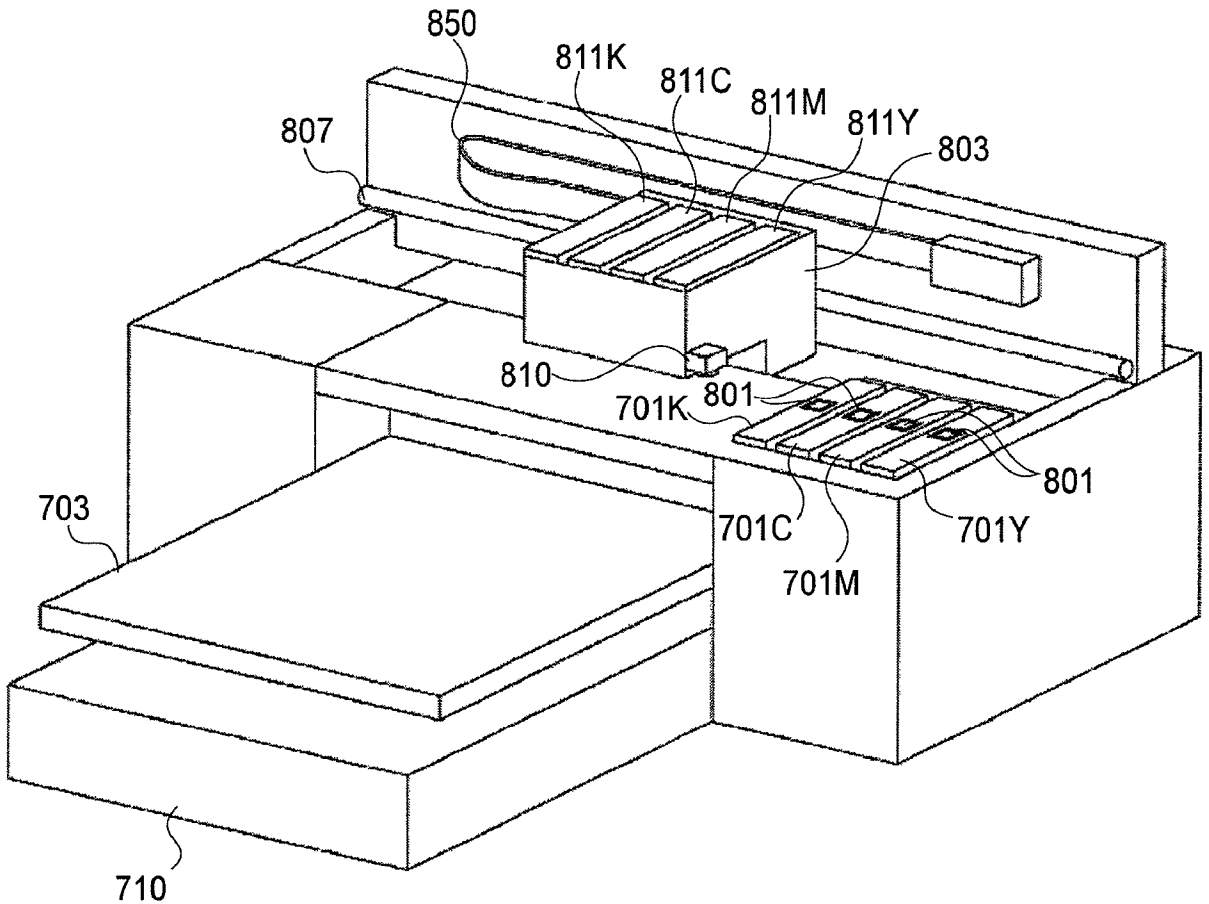
FIG. 38 is a perspective view of a printer having a structure according to a further embodiment of the present invention.

FIG. 38 is a perspective view of a printer having such a structure according to a further embodiment of the present invention.

In this Figure, designated by 710 is a sheet feeding tray in the form of a cassette, and the recording materials are stacked thereon and is singled out during operation. It is fed along a folded-back feeding path to a recording region (unshown) where the recording head is carried on a carriage 803, then to a sheet discharge tray 703. The carriage 803 is supported and guided by a guiding shaft 807, and is reciprocated along the guiding shaft 807, during which the recording head effects scanning and recording operations.

The carriage 803 carries recording heads of respective colors. The recording heads have intermediary containers 811K, 811C, 811M and 811Y containing black ink, cyan ink, magenta ink and yellow ink, respectively. The intermediary containers are supplied with the inks from relatively large capacity fixed containers 701K-701Y, respectively, which are detachably mounted at a fixed portion of the apparatus. Designated by 850 is a flexible follower which moves following the movement of the carriage 803. The follower includes electric wiring portion for transmitting electric signals to the respective recording heads carried on the carriage, and a group of ink supply tubes extending from the fixed containers to the intermediary containers. The group of the supply tubes is in fluid communication with the group of the fixed containers through unshown communicating tubes.

The recording operation in this embodiment is similar to that of the foregoing embodiment. In this embodiment, however, the light emitting portions 801 having the function similar to the above-described light emitting portions 101 are provided on the respective fixed containers 701K-701Y. Correspondingly, a light receiving portion 810 for detecting a state of light emission during the main-scanning operation is provided on the carriage 803. With such a mechanism, the presence or absence of the ink, the presence or absence of the mounted ink container and/or the properness of the mounting of each of the fixed containers 701K-701Y is detected in the manner similar to those described in the foregoing, and the predetermined control operations are carried out. The user can observe the state of light emission of the light emitting portion 801 and therefore the information relating to each of the fixed container. The fixed container may be of a semi-permanent type which is not ordinarily detachable, and in such a case, the ink is replenished into the ink containers when the ink is short in the containers.

The structure of this embodiment is not limited to the one employing the tube. More particularly, such structures are applicable to an intermittent supply type or so-called pit-stop-supply type as well as to the continuous supply type using the tube. In the pit-stop-supply type, the recording head is provided with an accumulator for retain a relatively small amount of the ink, there is provided a supply system for intermittently supplying the ink at appropriate timing to the accumulator portion from an associated supply source, which is fixed in the apparatus and which contain a relatively large amount of the ink.

The ink supply system may be connected only when the ink supply is necessary to the intermediary container from the fixed container. Alternatively, the intermediary container and the supply source container may be connected with each other through a solenoid valve or the like, which is controlled to be open and close to connect and disconnect them at proper timing. Another pit-stop type is usable wherein the intermediary container portion is provided with a gas-liquid separator film which passes gas but not liquid, the air in the container is suctioned through the film to supply the ink into the intermediary container.

Figure 39:
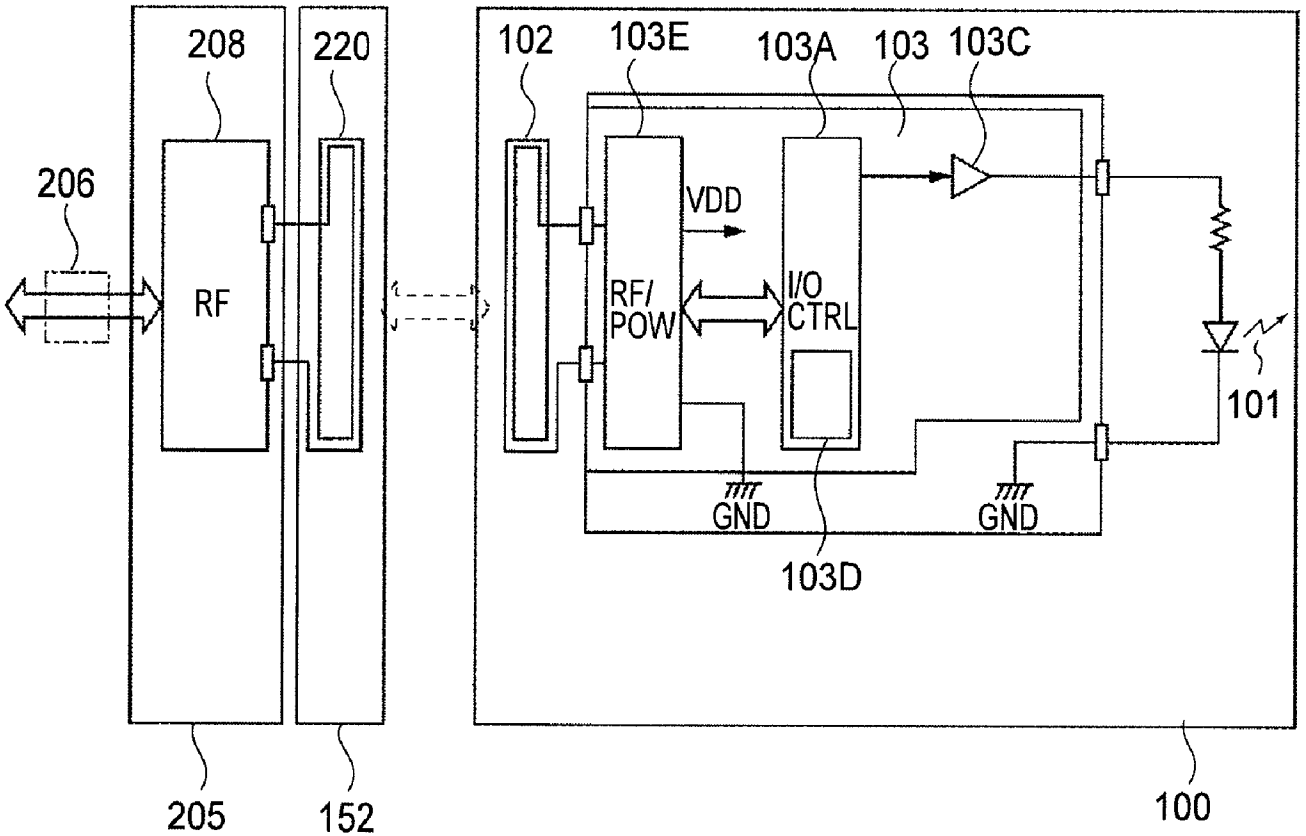
FIG. 39 is a circuit diagram of a substrate having a controller and the like, according to a further embodiment of the present invention.

FIG. 39 is a circuit diagram of a substrate having a controller and the like, according to a further embodiment of the present invention. As shown in this Figure, the controller 103 comprises an I/O control circuit (I/O-CTRL) 103A, a LED drivers 103C, a high frequency modulation/demodulation and voltage source circuit 103E.

The I/O control circuit 103A controls the display driving of the LED101 in accordance with the control data sent through the high frequency circuit and the antenna from the control circuit 300.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

This embodiment is different from the first embodiment in that there is not provided a memory array 103B. Referring to a timing chart of FIG. 40, an embodiment will be described wherein even if the information (color information, for example) is not stored in the memory array, the ink container can be identified, and the LED 101 of the identified ink container can be actuated or deactuated.

An I/O control circuit 103A of the controller 103 of the ink container 1 receives the start code plus color information and the control code are supplied with clock signal CLK from the main assembly side control circuit 300 through a signal line DATA (FIG. 20). The I/O control circuit 103A includes a command discrimination portion 103D for recognizing a combination of the color information plus the control code as a command and for determining actuation or deactuation of the LED driver 103C. 1 The ink containers 1K, 1C, 1M and 1Y are provided with respective controllers 103 which have different command discrimination portions 103D, and the commands for controlling the ON and OFF of the LED for the respective colors have the arrangements shown in FIG. 40. Thus, the respective command discrimination portions 103D have the respective individual information (color information); the information is compared with the color information of the inputted command; and various operations are controlled. When, for example, the main assembly transmits together with the start code the color information plus control code 000100 indicative of K-ON for turning on the LED of the ink container 1K, only the command discrimination portion 103D of the ink container 1K accept it, so that only the LED of ink container 1K is switched on. In this embodiment, the controllers 103 have to have structures which are different depending on the colors, but are advantageous in that provision of the memory array 103B is not necessitated.

Figure 40:
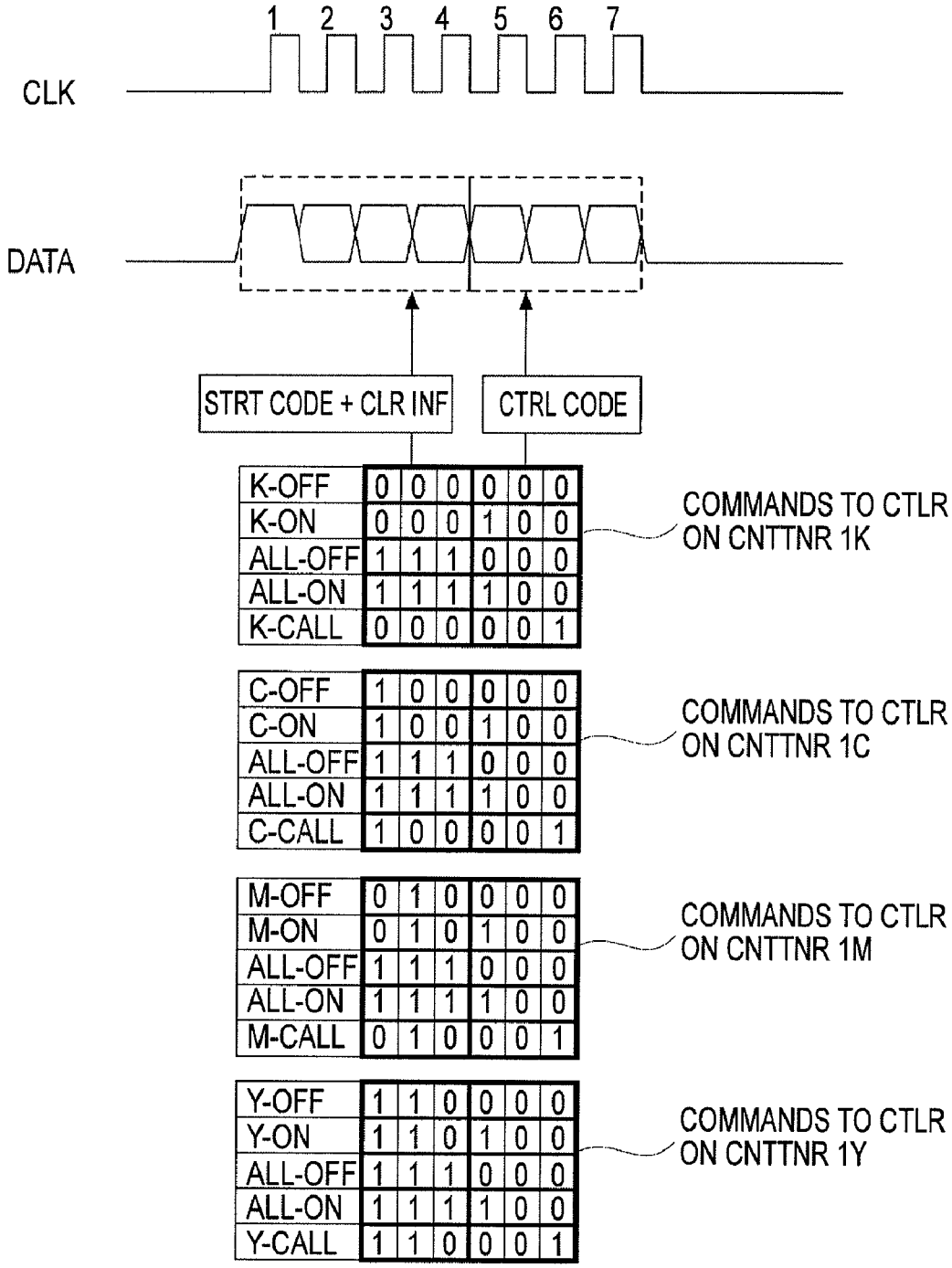
FIG. 40 is a timing chart of an operation in the structure of the embodiment.

The command discrimination portion 103D, as shown in FIG. 40, may have a function of discriminating not only the commands indicative of turning-on and -off of a particular LED 101 but also a command ALL-ON or ALL-OFF indicative of turning-on and -off of the LEDs 101 of all of the ink containers, and/or a CALL command causing a particular color controller 103 to output a reply signal.

As a further alternative, the command including the color information and the control code sent from the main assembly side control circuit 300 to the ink container 1 may not be directly compared with the color information (individual information) in the ink container. In other words, the inputted command is converted or processed in the controller 103, and the value provided as a result of the conversion is compared with the predetermined value stored in the memory array 103B or the command discrimination portion 103D. Only when the result of the comparison corresponds to the predetermined relation, the LED is actuated or deactuated.

As a further alternative, the signal sent from the main assembly side is converted or processed in the controller 103, and the value stored in the memory array 103B or the command control portion 103D is also converted or processed in the controller 103. The converted ones are compared, and only when the result of the comparison corresponds to the predetermined relation, the LED is actuated or deactuated.

Figure 41:
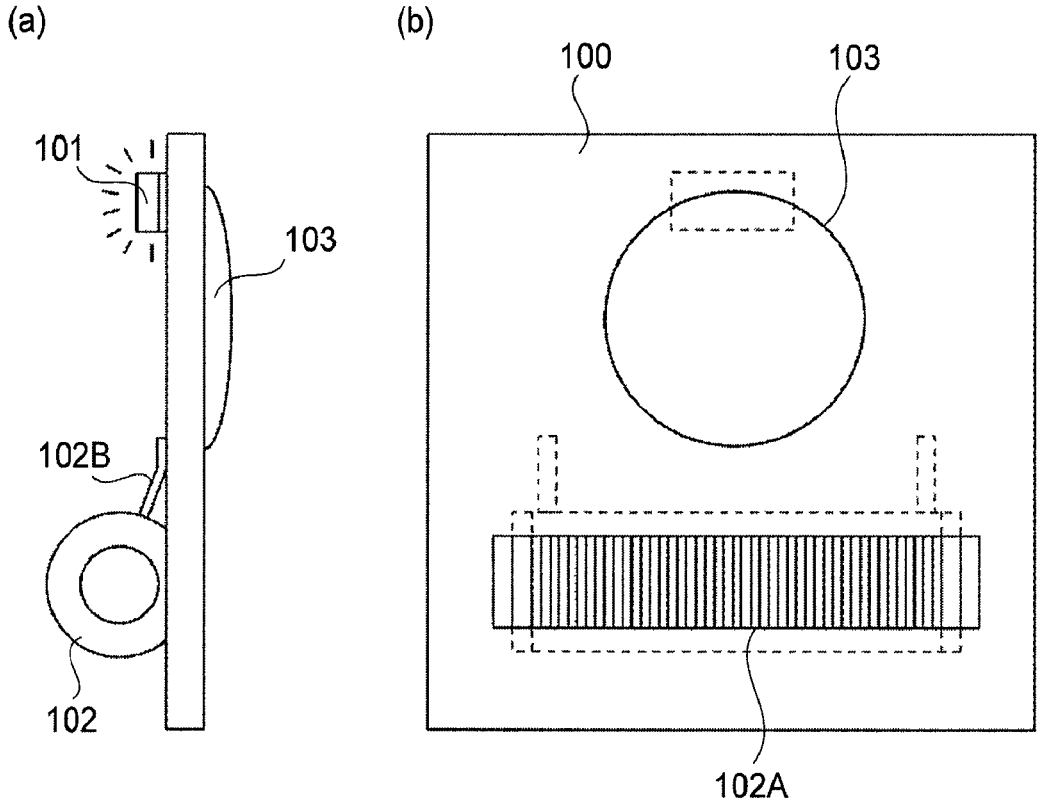
FIG. 41 is a side view (a) and a front view (b) of a further example of the controller substrate mounted on the ink container.

FIG. 41 is a side view (a) and a front view (b) of an antenna, of a further embodiment, provided on the controller substrate 100 mounted on the ink container. The antenna 102 comprises a coil 102A which is connected with the wiring on the substrate 100 by two lead lines 102B. By using a coil type antenna, the voltage (voltage source) to be supplied to the controller 103 and to the LED101 is efficiently generated from the electromagnetic radiation.

Figure 42:
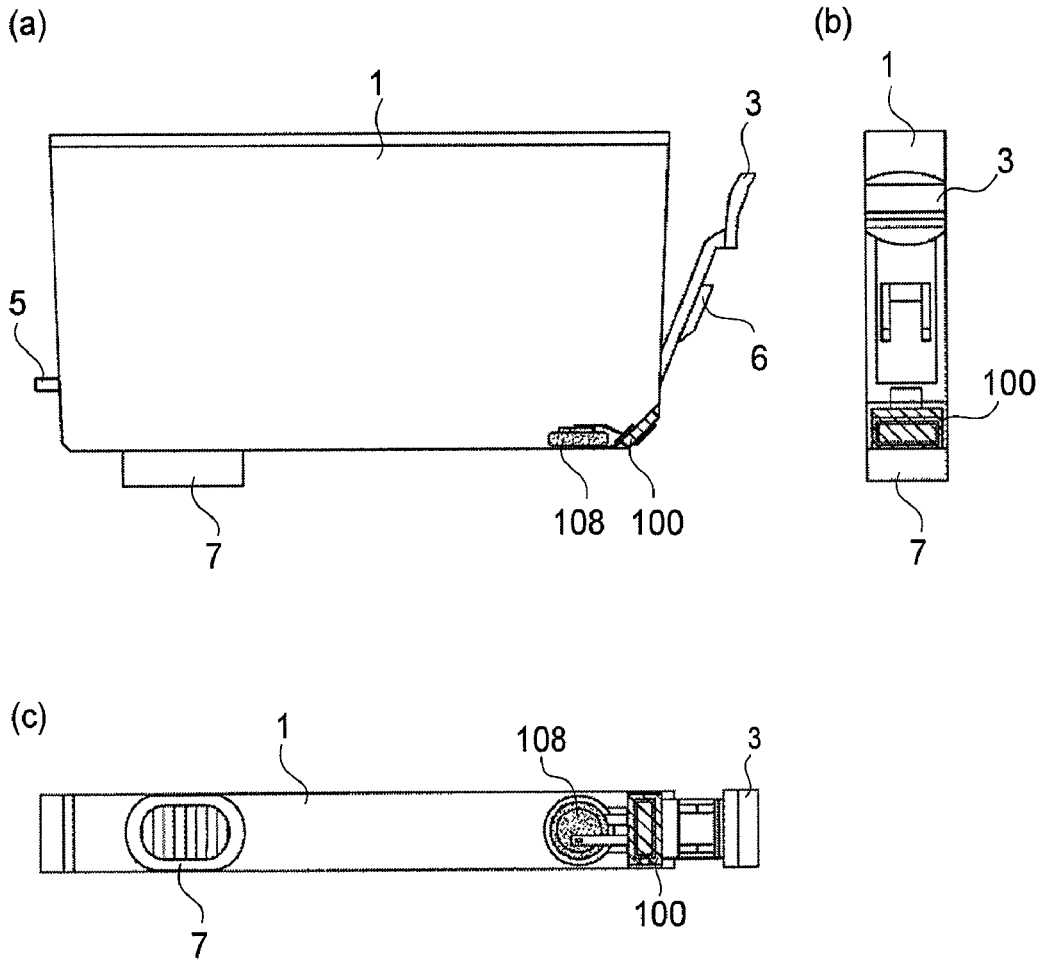
FIG. 42 is a side view (a), a front view (b) and a bottom view (c) of an ink container according to a further embodiment of the present invention.
Figure 43:
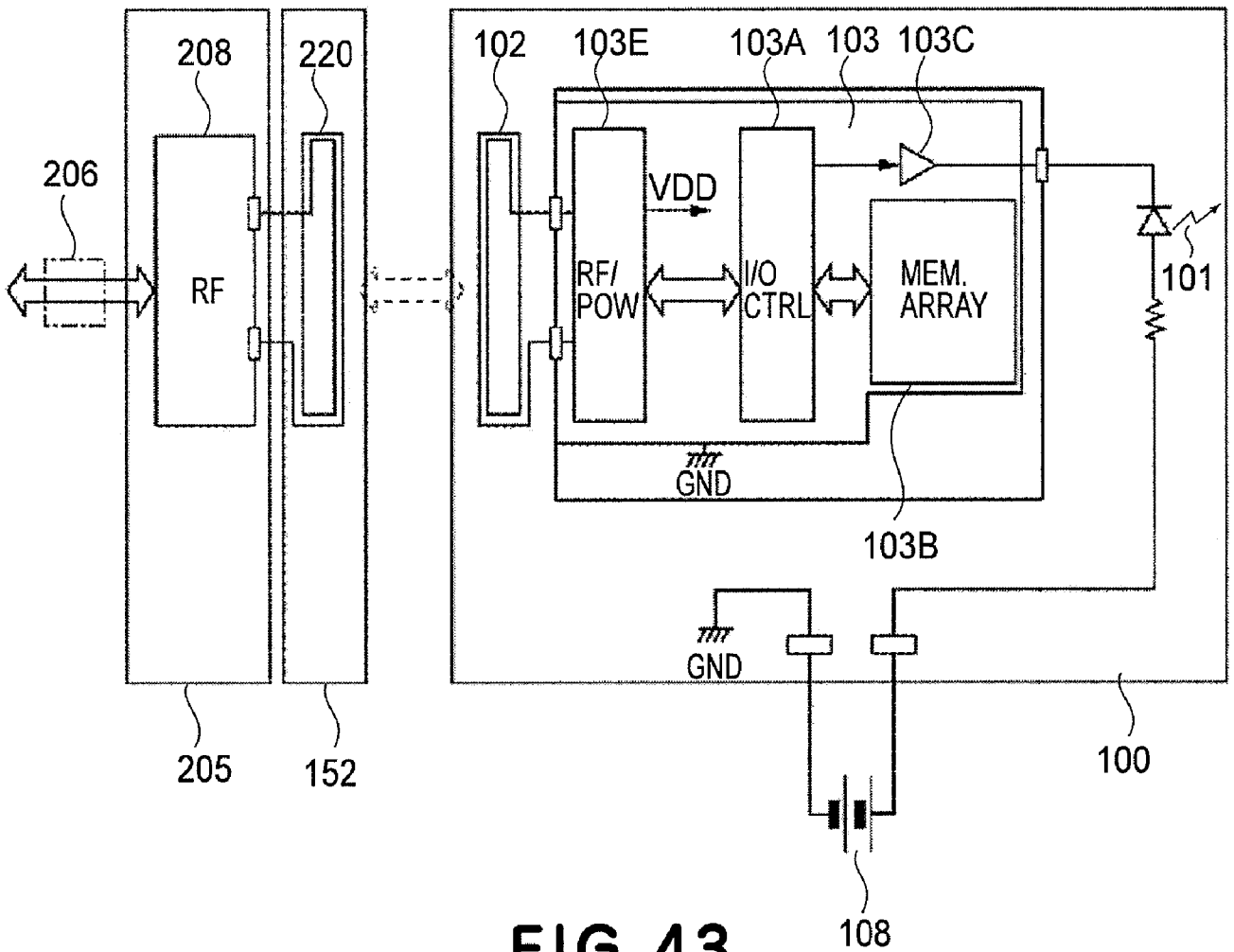
FIG. 43 is a circuit diagram illustrating details of a substrate including a controller, and the like, for the ink container, according to a further embodiment oaf the present invention.

FIG. 42 is a side view (a), a front view (b) and bottom view (c) of an ink container 1 according to a further embodiment of the present invention. A button type battery 108 is disposed on the bottom surface of the ink container 1 adjacent the substrate 100. FIG. 43 is a circuit diagram illustrating details of the substrate 100 having the controller 103 and the like according to this embodiment. As shown in this Figure, a battery 108 connects with the GND and the anode side of the LED101 and functions to supply the electric power required for light emission of the LED101. The electric power generated by the antenna 102 from the electromagnetic radiation is supplied only to the controller 103. By doing so, the electric power for the LED101 which requires relatively large electric power as compared with the controller 103 is supplied by the battery 108, and therefore, the electric power obtained from the electromagnetic radiation may be relatively small. Therefore, the latitude of the wireless communication range can be expanded, and the antenna of the main assembly side may be relatively free in the position and configuration thereof.

Figure 44:
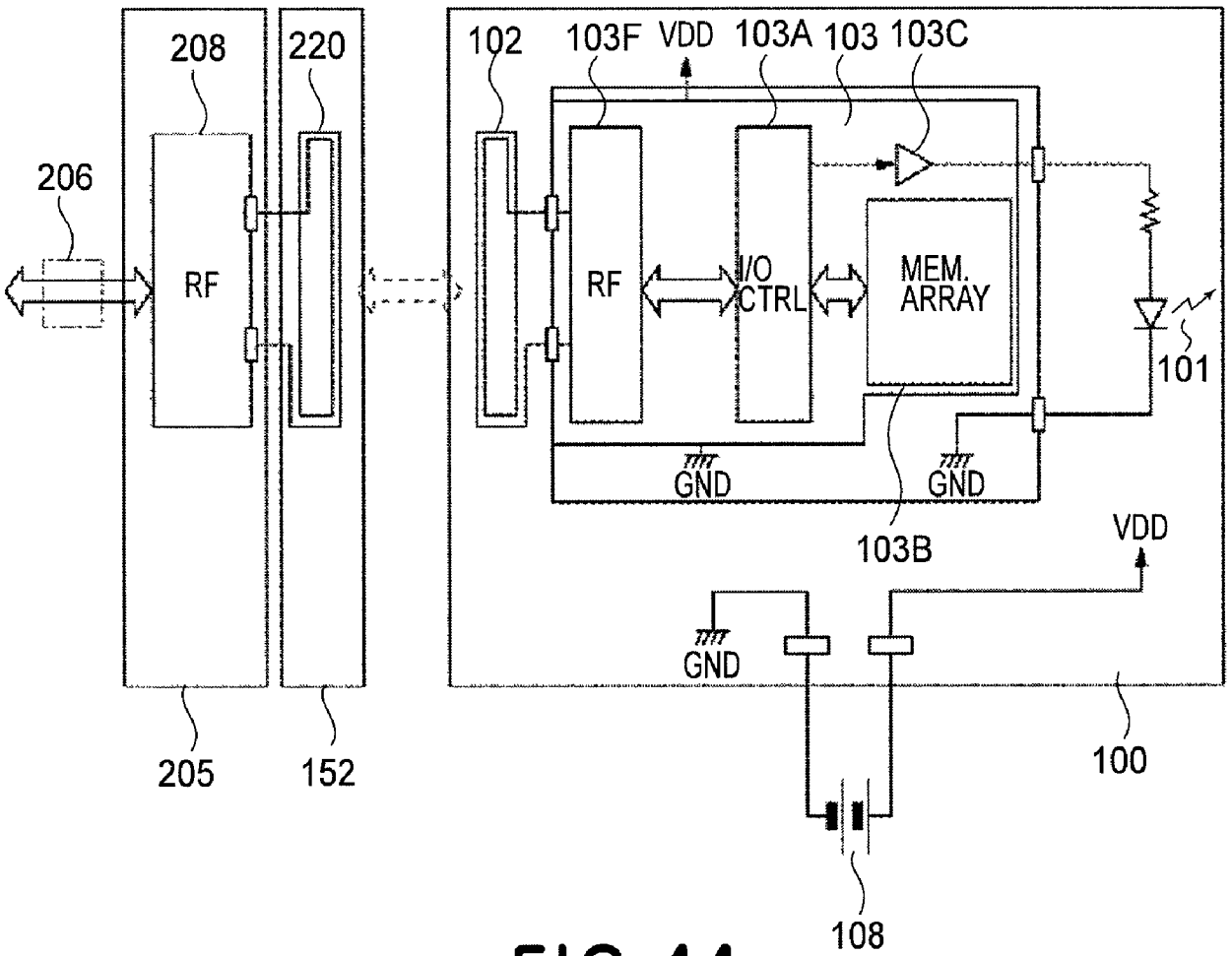
FIG. 44 is a circuit diagram illustrating details of a substrate including a controller, and the like, for the ink container, according to a further embodiment of the present invention.

FIG. 44 shows a circuit for supplying the electric power from the battery 108 to the entirety of the controller 103 and the LED101. With this structure, the voltage source circuit for obtaining the electric power from the electromagnetic radiation can be omitted from the controller 103, and in addition, a larger electric power can be supplied to the high frequency modulation circuit for the wireless communication. By this, the wireless communication distance can be increased, and the antenna of the main assembly side may be relatively free in the position and configuration thereof.

Figure 45:
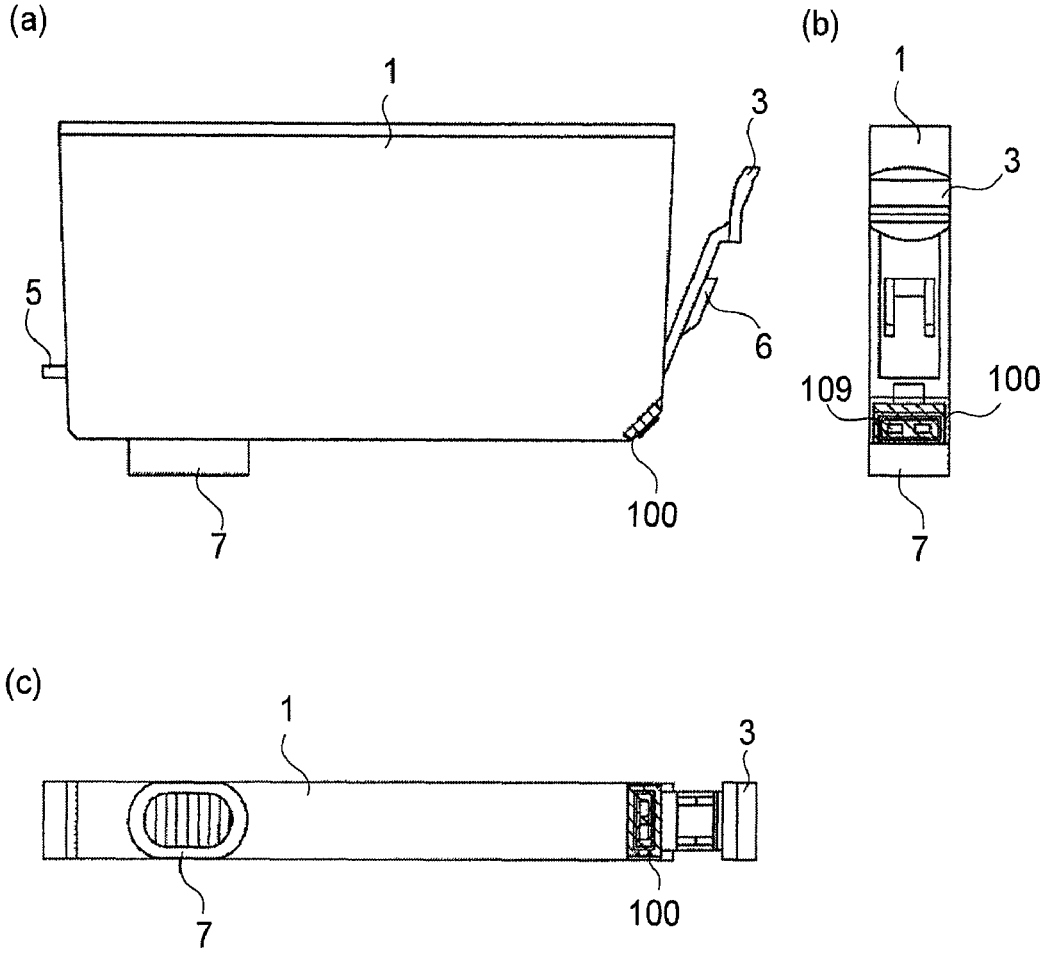
FIG. 45 is a side view (a), a front view (b) and a bottom view (c) of an ink container according to a further embodiment of the present invention.
Figure 46:
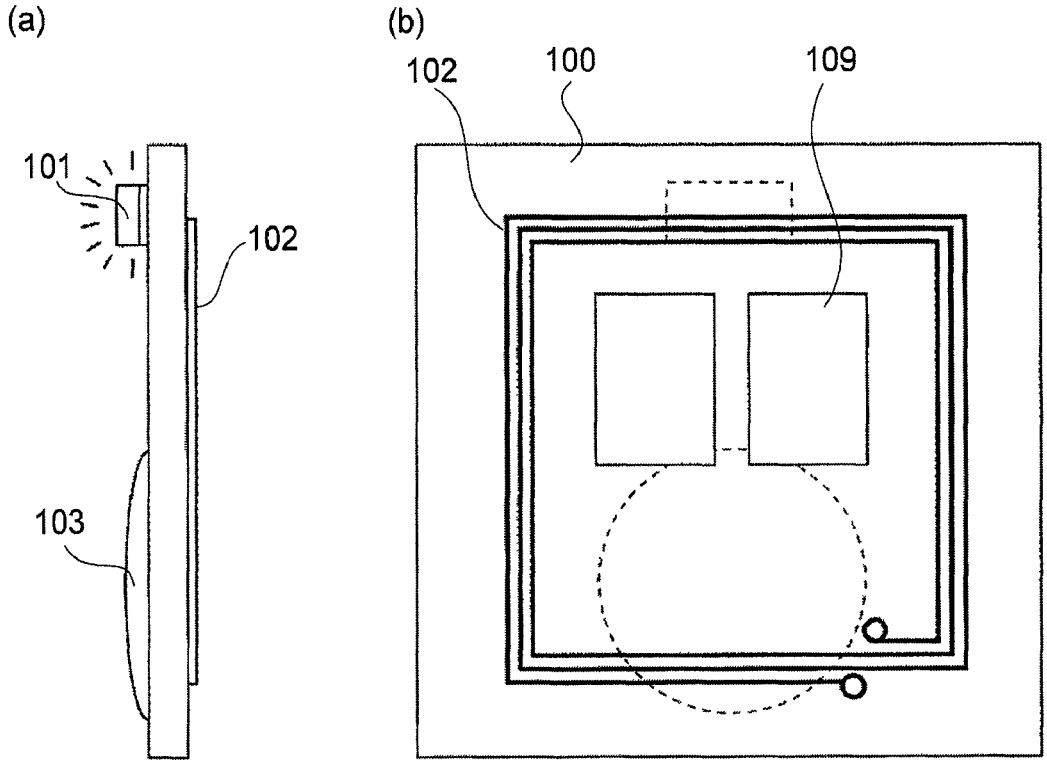
FIG. 46 is a side view (a) and a front view (b) of controller substrate mounted to the ink container according to a further embodiment of the present invention.
Figure 47:
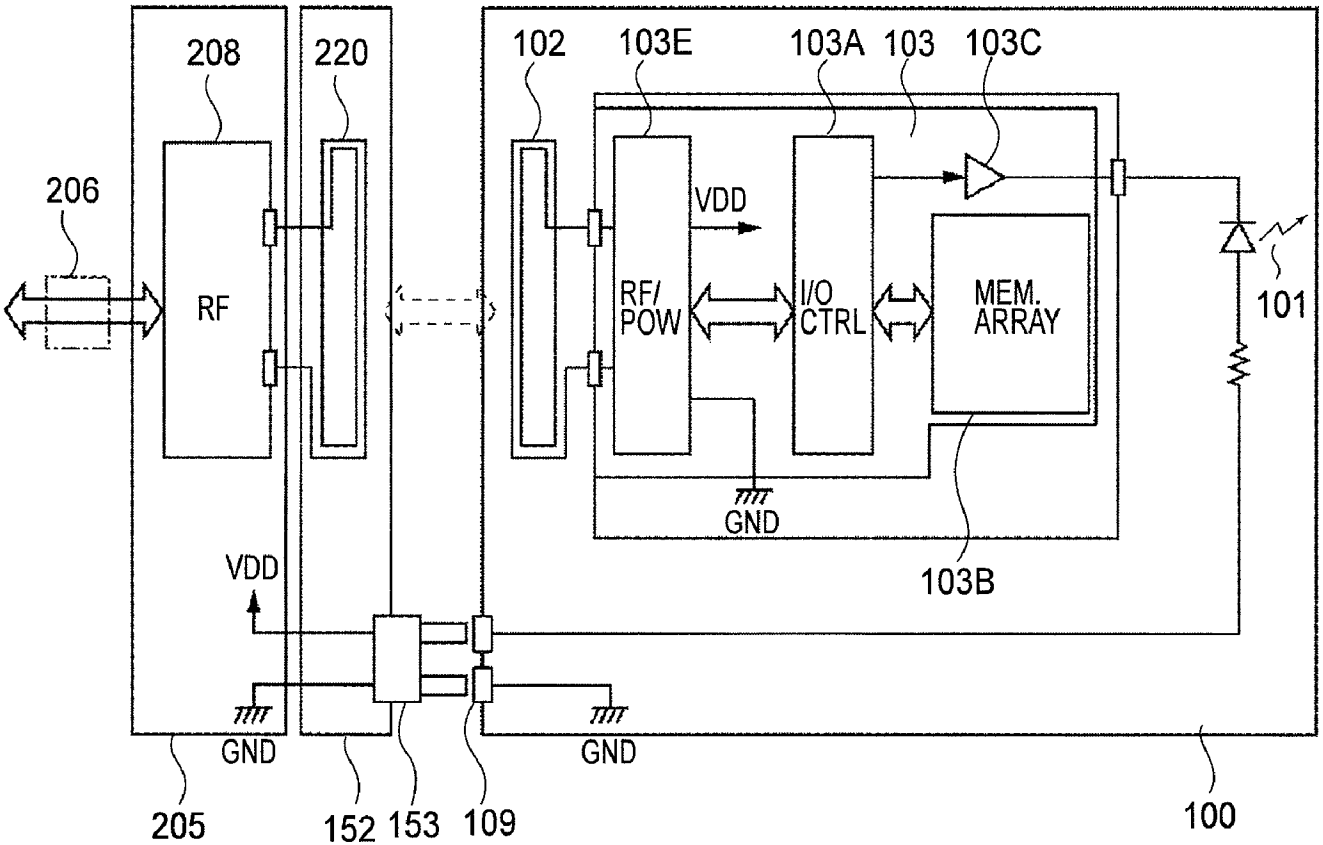
FIG. 47 is a circuit diagram illustrating details of a substrate including a controller, and the like, for the ink container, according to a further embodiment of the present invention.

FIG. 45 is a side view (a), a front view (b) and bottom view (c) of an ink container 1 according to a further embodiment of the present invention. The substrate 100 is provided with two contact pads 109. FIG. 46 is a side view (a) and a front view (b) of a substrate according to this embodiment. The substrate 100 mounted on the ink container 1 is provided on the outwardly facing side with contact pads 109 for the voltage supply, and the contact pads 109 are disposed inside the loop of the antenna 102. FIG. 47 is a circuit diagram illustrating details of the substrate 100 having the controller 103 and the like according to this embodiment. As shown in this Figure, the contact pads for the voltage supply are connected to the GND and the anode side of the LED101 to supply the electric power for light emission of the LED101. The main assembly side connector 153 contactable to the contact pads 109 of the substrate 100 is disposed on the main assembly side antenna substrate 152 and is supplied with the voltage from the main assembly side. The electric power generated by the antenna 102 from the electromagnetic radiation is supplied only to the controller 103. Using such a structure, the LED101 which requires a relatively large electric power as compared with the controller 103 is supplied with the electric power from the battery 108, and therefore, the electric power obtained from the electromagnetic radiation may be relatively small. Therefore, the latitude of the wireless communication range can be expanded, and the antenna, of the main assembly side may be relatively free in the position and configuration thereof.

Figure 48:
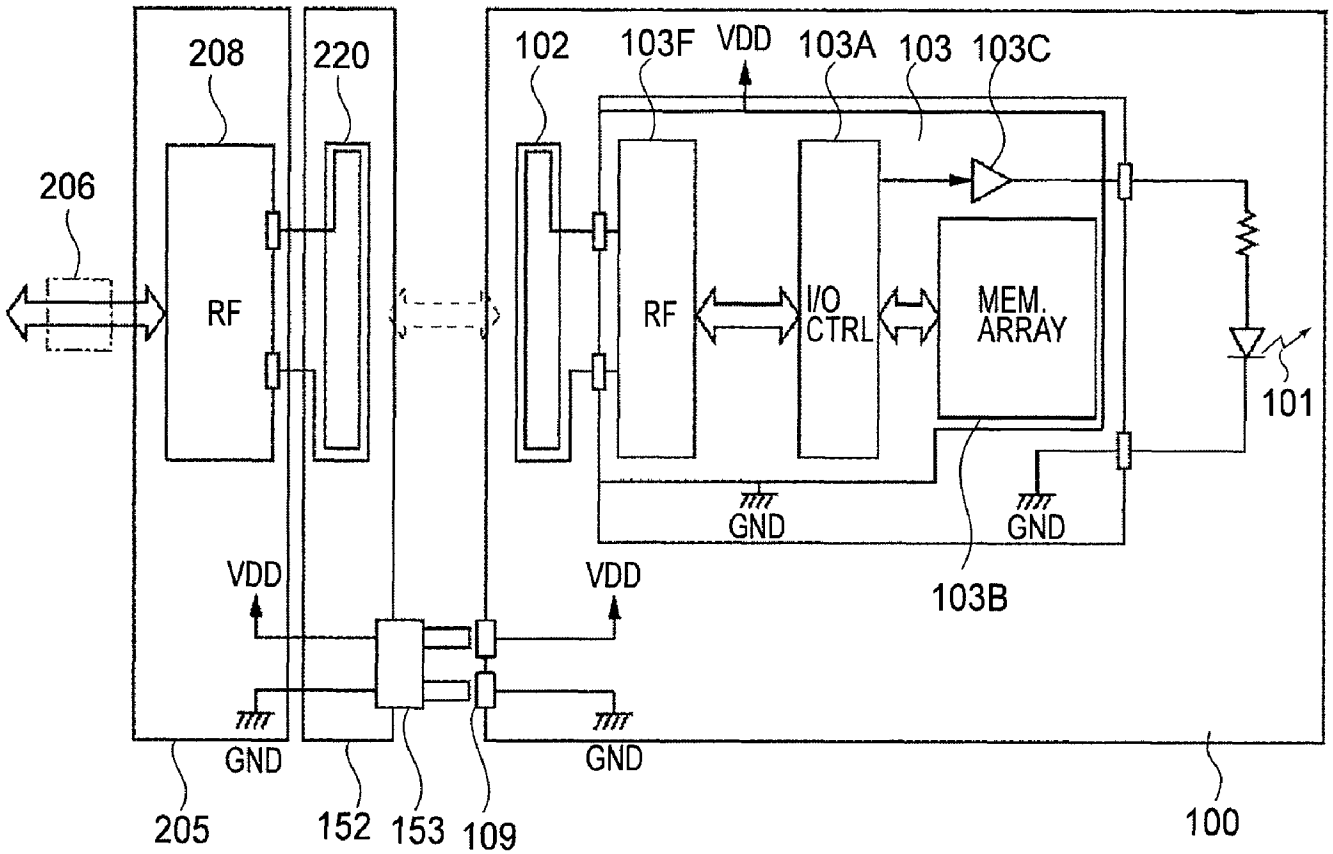
FIG. 48 is a circuit diagram illustrating details of a substrate including a controller, and the like, for the ink container, according to a further embodiment of the present invention.

FIG. 48 shows a circuit for supplying the voltage from the contact pad 109 to the entirety of the controller 103 and the LED101. With this structure, the voltage source circuit for obtaining the electric power from the electromagnetic radiation can be omitted from the controller 103, and in addition, a larger electric power can be supplied to the high frequency modulation circuit for the wireless communication. By this, the wireless communication distance can be increased, and the antenna of the main assembly side may be relatively free in the position and configuration thereof.

Figure 49:
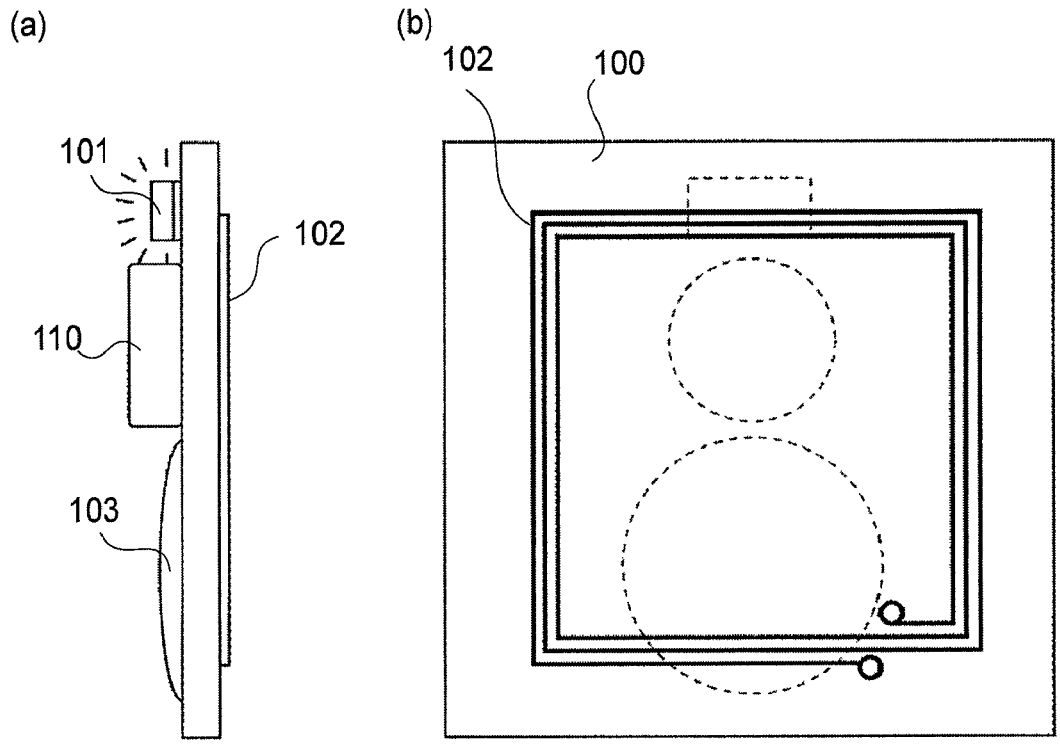
FIG. 49 is a side view (a) and a front view (b) of a further example of the controller substrate mounted on the ink container.
Figure 50:
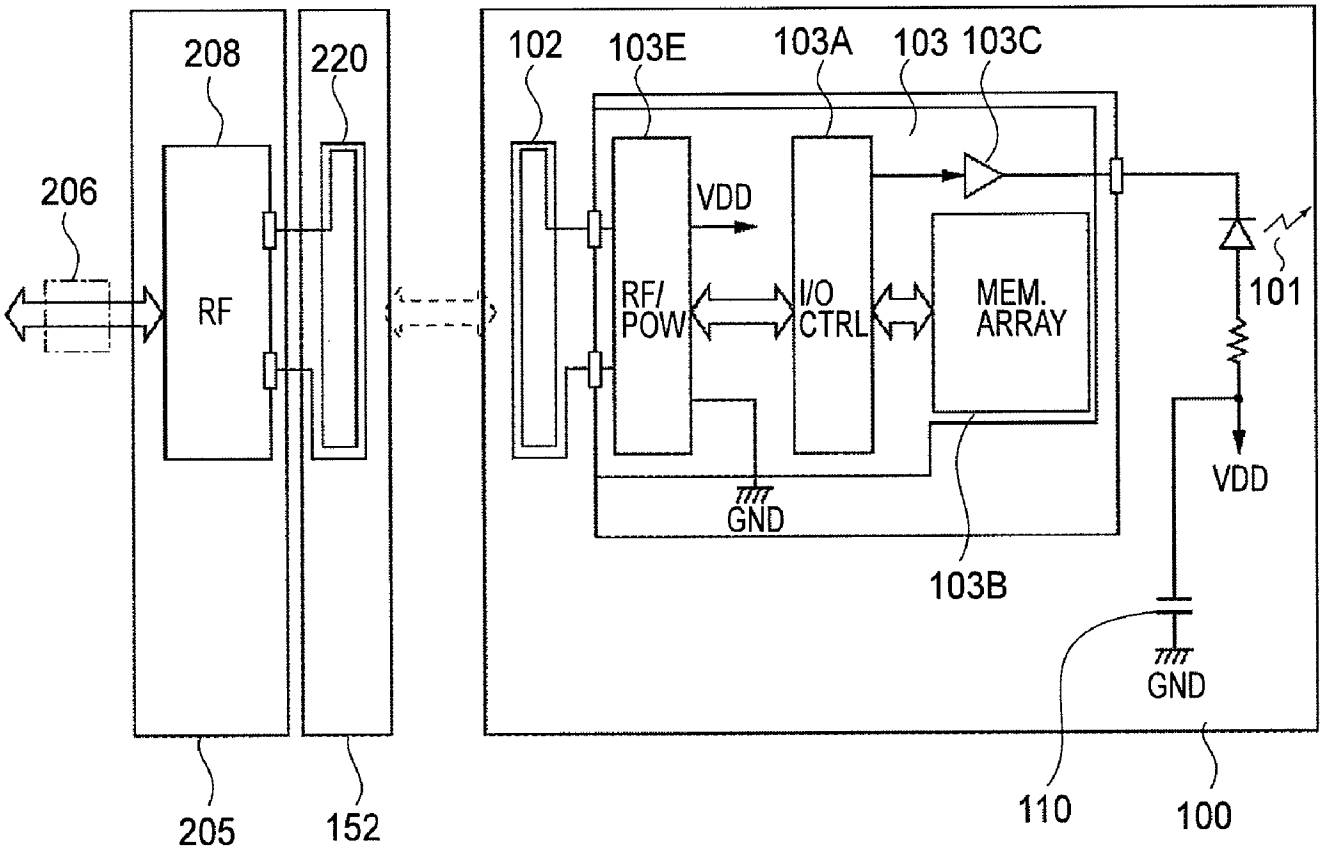
FIG. 50 is a circuit diagram illustrating details of a substrate including a controller, and the like, for the ink container, according to a further embodiment of the present invention.
Figure 51:
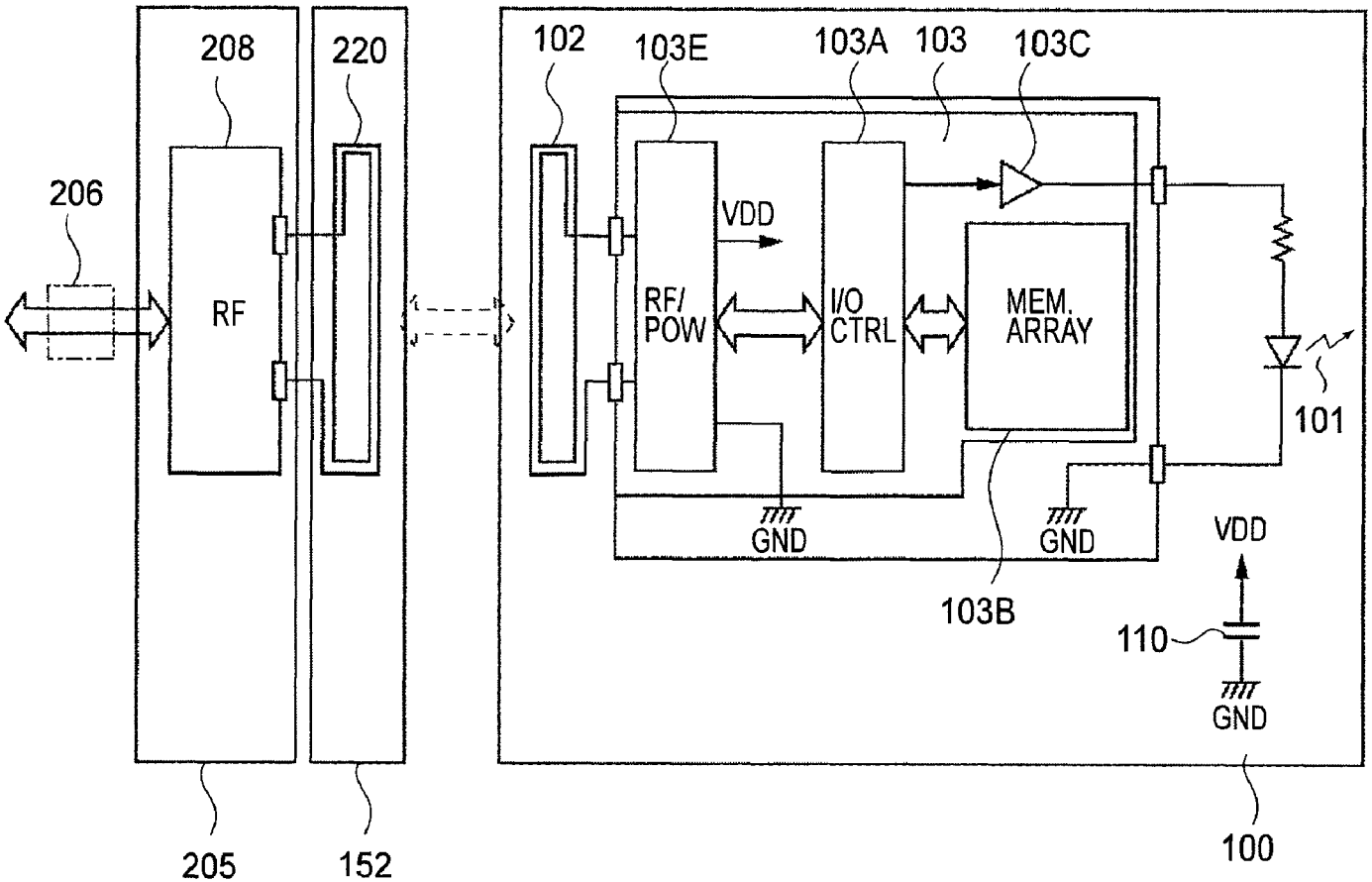
FIG. 51 is a circuit diagram illustrating details of a substrate including a controller, and the like, for the ink container, according to a further embodiment of the present invention.

FIG. 49 is a side view (a) and a front view (b) of a substrate 100 according to a further embodiment of the present invention. The substrate 100 mounted on the ink container 1 is provided on the inwardly facing side with a capacitor 110 for voltage supply. FIGS. 50 and 51 are circuit diagrams illustrating details of the substrate 100 comprising the controller 103 and the like of this embodiment. As shown in these Figures, the capacitor 110 is connected to the voltage source line VDD and to the grounding line GND in the substrate 100. With such a structure, when the LED101 is actuated, the charge accumulated in the capacitor is discharged. This is effective to supply a relatively large current required by the light emission, and during a period in which the LED101 does not emit light, it receives the electromagnetic radiation from the main assembly side and converts it to electric power, which is charged into the capacitor. If the use is made with an electrical double layer capacitor which is recently quite inexpensive, a small-size and large-capacity capacitor can be mounted, and therefore, the electric power supplied to the LED101 can be made large. In the example of FIG. 49, the capacitor 110 is provided on the inwardly facing side of the substrate 100, but it may be disposed on the outwardly facing side of the substrate 100 mounted on the ink container 1. Further alternatively, the capacitor may be disposed outside the substrate 100 connected therewith, similarly to the battery 108 of FIG. 42. With this structure, the capacitor may be further large.

Figure 52:
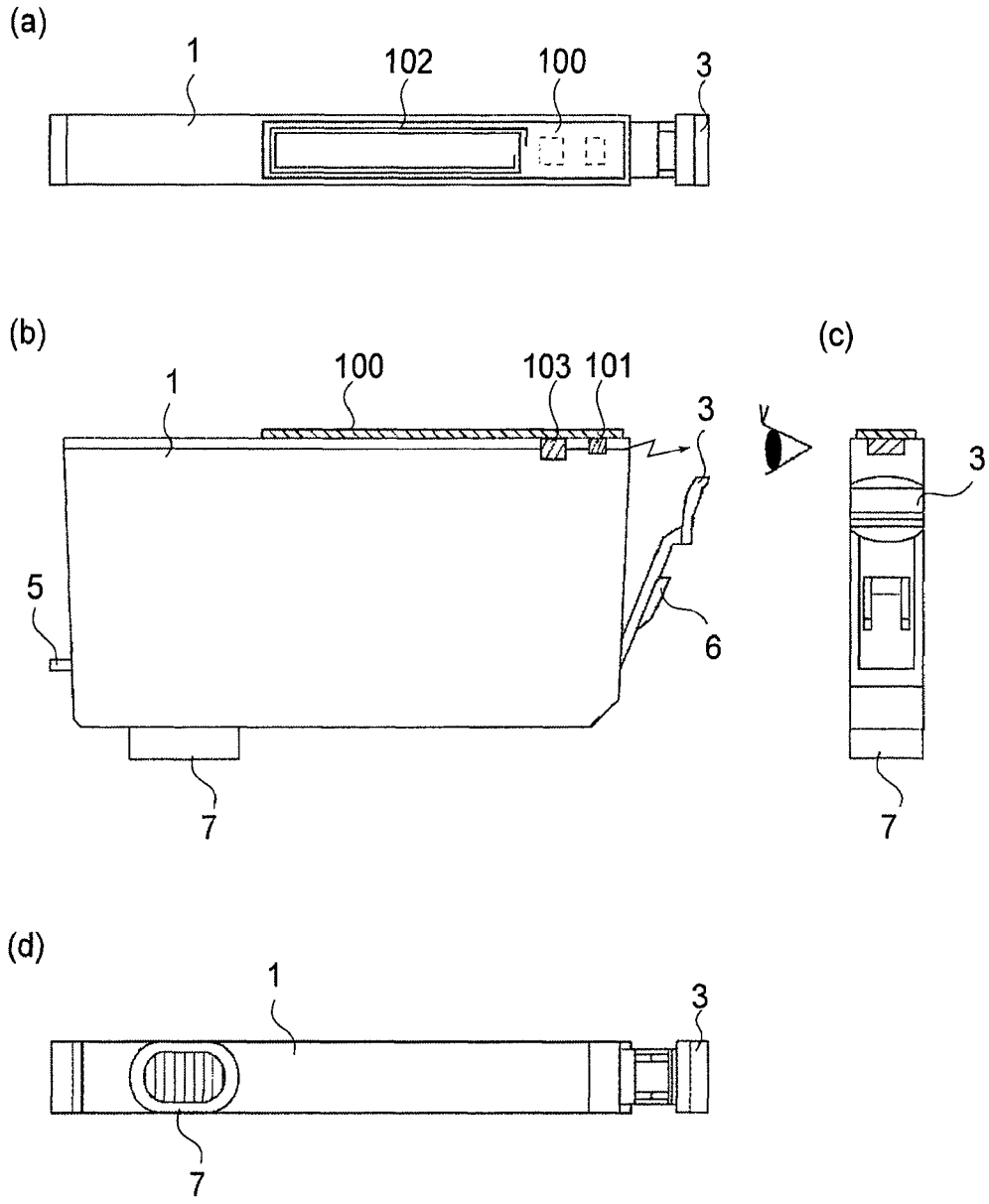
FIG. 52 is a top plan view (a), a side view (b), a front view (c) and a bottom view (d) of an ink container according to a further embodiment of the present invention.

FIG. 52 is a top plan view (a), a side view (b), a front view (c) and a bottom view (d) of an ink container 1 according to a further embodiment of the present invention. In this embodiment, the substrate 100 is provided on the top surface of the ink container 1; the size of the substrate 100 may be relatively large as compared with that in the first embodiment shown in FIG. 1. Therefore, the size of the antenna 102 may be relatively larger, and therefore, the advantage is provided in terms of wireless communication with the main assembly side of the recording device. FIG. 52 shows an example in which a loop antenna in the form of a wiring pattern is formed on the substrate 100, but a coil in the form of wound wire shown in FIG. 41 may be connected to the substrate 100. The LED101 can be disposed on the top side of the ink container, and therefore, the light emission can be observed easily.

Figure 53:
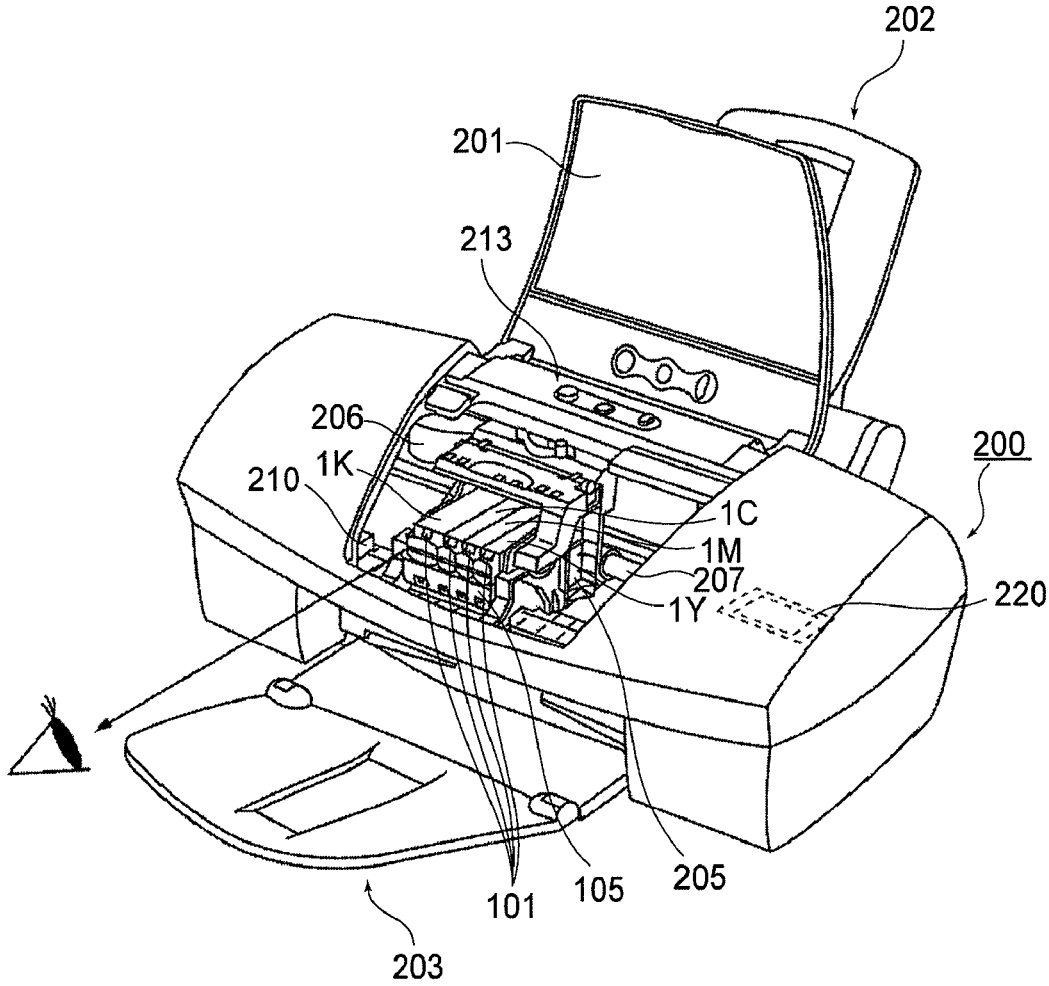
FIG. 53 is a perspective view of a main assembly of the ink jet printer with the cover 201 thereof is removed, in which the ink container according to a further embodiment of the present invention is loaded.
Figure 54:
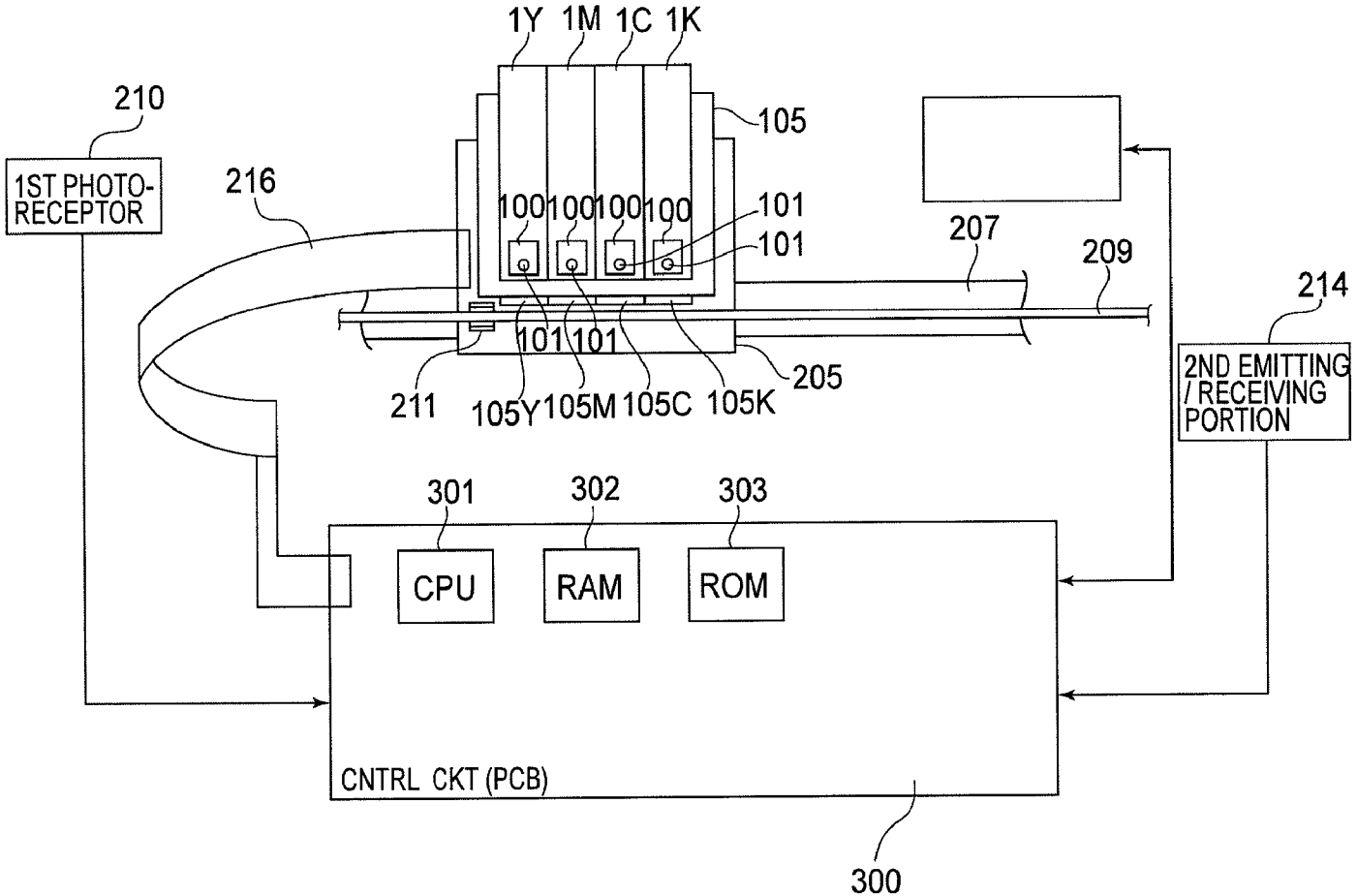
FIG. 54 is a block diagram illustrating a control system of the ink jet printer for use with the ink container of the further embodiment.

FIG. 53 is a perspective view of the printer wherein the main assembly cover 201 is open. FIG. 54 is a block diagram of an example of a structure of the control system for the main assembly of the ink jet printer according to this embodiment. According to this embodiment, the wireless communication distance is relatively larger, and therefore, the antenna 220 of the main assembly side may be disposed at any position in the main assembly of the ink jet printer. FIG. 53 shows an example in which the antenna 220 is disposed adjacent to the home position of the carriage above the carriage, but the antenna 220 may be disposed at a position opposite from the home position or on the carriage as in the first embodiment.

[Industrial Applicability]

As described above, according to the present invention, it is possible to provide a liquid container, a liquid supplying system comprising the container, a manufacturing method for the container, a circuit board for the container and a liquid containing cartridge, wherein light emission control of displaying devices such as LED are carried out through non-contact communication using a common antenna for a plurality of carrying positions for the ink containers.

While the invention has been described with reference to the structures disclosed herein, it is not confined to the details set forth and this application is intended to cover such modifications or changes as may come within the purpose of the improvements or the scope of the following claims.

The invention claimed is:

1. An ink container, comprising:

an ink chamber containing ink;

a communication antenna positioned outside of the ink chamber;

an information storing portion positioned outside of the ink chamber and storing at least container discrimination information that indicates a color of the ink in the ink chamber;

a light emitter positioned outside of the ink chamber; and a controller positioned outside of the ink chamber and configured to control the light emitter based on a command for the light emitter and color information received through the communication antenna and the container discrimination information stored in the information storing portion.

2. An ink container according to claim 1, wherein the controller is configured to turn on the light emitter if (i) the command is a turn on command for turning on the light emitter and (ii) the color information corresponds to the container discrimination information.

3. An ink container according to claim 2, wherein the controller is configured to turn on the light emitter if (i) the command is the turn on command and (ii) the color information is the same as the container discrimination information.

4. An ink container according to claim 2, wherein the controller is configured to turn off the light emitter if (i) the command is a turn off command for turning off the light emitter and (ii) the color information corresponds to the container discrimination information.

5. An ink container according to claim 4, wherein the controller is configured to turn off the light emitter if (i) the command is the turn off command and (ii) the color information is the same as the container discrimination information.

6. An ink container according to claim 4, wherein the controller is capable of continuously maintaining an on state of the light emitter from the time when the controller turns on the light emitter based on the turn on command until the controller turns off the light emitter based on the turn off command.

7. An ink container according to claim 1, wherein the controller is configured to turn on the light emitter if (i) the command is a turn on command for turning on the light emitter and (ii) a color indicated by the color information is the same as the color indicated by the container discrimination information.

8. An ink container according to claim 7, wherein the controller is configured to turn off the light emitter if (i) the command is a turn off command for turning off the light emitter and (ii) a color indicated by the color information is the same as the color indicated by the container discrimination information.

9. An ink container according to claim 8, wherein the controller is capable of continuously maintaining an on state of the light emitter from the time when the controller turns on the light emitter based on the turn on command until the controller turns off the light emitter based on the turn off command.

10. An ink container according to claim 1, wherein the controller is configured to turn on the light emitter if (i) the command is a turn on command for turning on the light emitter and (ii) the color information is the same as the container discrimination information, and wherein the controller is configured to turn off the light emitter, if (i) the command is a turn off command for turning off the light emitter and (ii) the color information is the same as the container discrimination information.

11. An ink container according to claim 10, wherein the controller is capable of continuously maintaining an on state of the light emitter from the time when the controller turns on the light emitter based on the turn on command until the controller turns off the light emitter based on the turn off command.

12. An ink container according to claim 1, wherein the light emitter is disposed at a position where at least a portion of the light emitted from the light emitter travels away from the ink container without passing through the ink chamber.

13. An ink container according to claim 1, wherein the light emitter is an LED capable of emitting visible light.

14. An ink container according to claim 1, further comprising a based member provided with the communication antenna, the light emitter, the information storing portion, and the controller.

15. An ink container according to claim 14, wherein the based member is disposed on an outer surface of the ink container.

16. An ink container according to claim 1, further comprising a based member provided with the communication antenna and the light emitter, wherein the based member has a first surface that faces toward an inside of the ink container and a second surface that is opposite the first side, and wherein the light emitter is disposed on the first surface and the communication antenna is disposed on the second surface.

17. An ink container detachably mountable to an inkjet printing apparatus including an apparatus antenna, a light receptor and a discriminator configured to discriminate whether the ink container is mounted at a correct position in the inkjet printing apparatus on the basis of light reception information of the light receptor provided by light emitted from the ink container, comprising:

an ink chamber containing ink;

a container antenna capable of communicating with the apparatus antenna without physical contact therebetween and positioned outside of the ink chamber;

an information storing portion positioned outside of the ink chamber and storing at least container discrimination information that indicates a color of the ink in the ink chamber;

a light emitter positioned outside of the ink chamber and capable of emitting the light toward the light receptor; and a controller positioned outside of the ink chamber and configured to control the light emitter based on a command for the light emitter and color information received through the container antenna and the container discrimination information stored in the information storing portion.

18. An ink container according to claim 17, wherein the controller is configured to turn on the light emitter if (i) the command is a turn on command for turning on the light emitter and (ii) the color information corresponds to the container discrimination information.

19. An ink container according to claim 18, wherein the controller is configured to turn on the light emitter if (i) the command is the turn on command and (ii) the color information is the same as the container discrimination information.

20. An ink container according to claim 18, wherein the controller is configured to turn off the light emitter if (i) the command is a turn off command for turning off the light emitter and (ii) the color information corresponds to the container discrimination information.

21. An ink container according to claim 20, wherein the controller is configured to turn off the light emitter if (i) the command is the turn off command and (ii) the color information is the same as the container discrimination information.

22. An ink container according to claim 20, wherein the controller is capable of continuously maintaining an on state of the light emitter from the time when the controller turns on the light emitter based on the turn on command until the controller turns off the light emitter based on the turn off command.

23. An ink container according to claim 17, wherein the controller is configured to turn on the light emitter if (i) the command is a turn on command for turning on the light emitter and (ii) a color indicated by the color information is the same as the color indicated by the container discrimination information.

24. An ink container according to claim 22, wherein the controller is configured to turn off the light emitter if (i) the command is a turn off command for turning off the light emitter and (ii) a color indicated by the color information is the same as the color indicated by the container discrimination information.

25. An ink container according to claim 24, wherein the controller is capable of continuously maintaining an on state of the light emitter from the time when the controller turns on the light emitter based on the turn on command until the controller turns off the light emitter based on the turn off command.

26. An ink container according to claim 17, wherein the controller is configured to turn on the light emitter if (i) the command is a turn on command for turning on the light emitter and (ii) the color information is the same as the container discrimination information, and wherein the controller is configured to turn off the light emitter, if (i) the command is a turn off command for turning off the light emitter and (ii) the color information is the same as the container discrimination information.

27. An ink container according to claim 26, wherein the controller is capable of continuously maintaining an on state of the light emitter from the time when the controller turns on the light emitter based on the turn on command until the controller turns off the light emitter based on the turn off command.

28. An ink container according to claim 17, wherein the light emitter is disposed at a position where the emitted light is capable of reaching the light receptor without passing through the ink chamber.

29. An ink container according to claim 17, wherein the light emitter is an LED capable of emitting visible light.

30. An ink container according to claim 17, further comprising a based member provided with the container antenna, the light emitter, the information storing portion, and the controller.

31. An ink container according to claim 30, wherein the based member is disposed on an outer surface of the ink container.

32. An ink container according to claim 17, further comprising a based member provided with the container antenna and the light emitter, wherein the based member has a first surface that faces toward an inside of the ink container and a second surface that is opposite the first side, and wherein the light emitter is disposed on the first surface and the container antenna is disposed on the second surface.

33. An ink container according to claim 17, wherein the controller is configured to control the light emitter so that the discriminator is capable of discriminating whether the ink container is mounted at the correct position, on the basis of the light reception information provided by the light emitted from the light emitter when the correct position faces the light receptor.

34. An ink container detachably mountable to an inkjet printing apparatus that includes an apparatus antenna, a light receptor, a mounting unit having a plurality of mounting positions to which the ink container is detachably mountable, and a discriminator configured to discriminate whether the ink container is mounted at a correct one of the plurality of mounting positions on the basis of light reception information of the light receptor provided by light emitted from the ink container, comprising:

an ink chamber containing ink;

a container antenna capable of communicating with the apparatus antenna without physical contact therebetween and positioned outside of the ink chamber;

an information storing portion positioned outside of the ink chamber and storing at least container discrimination information that indicates a color of the ink in the ink chamber;

a light emitter positioned outside of the ink chamber and positioned to emit the light toward the light receptor; and a controller positioned outside of the ink chamber and configured to control the light emitter based on a control code for controlling the light emitter and color information received which are through the container antenna and the container discrimination information which is stored in the information storing portion.

35. An ink container according to claim 34, wherein the controller is configured to control the light emitter so that the discriminator is capable of discriminating whether the ink container is mounted at the correct mounting position, on the basis of the light reception information provided by the light emitted from the light emitter when the correct mounting position in the mounting unit faces the light receptor.

36. An ink container according to claim 34, wherein the controller is configured to turn on the light emitter if (i) the control code is a turn on command for turning on the light emitter and (ii) the color information corresponds to the container discrimination information.

37. An ink container according to claim 36, wherein the controller is configured to turn on the light emitter if (i) the control code is the turn on command and (ii) the color information is the same as the container discrimination information.

38. An ink container according to claim 36, wherein the controller is configured to turn off the light emitter if (i) the control code is a turn off command for turning off the light emitter and (ii) the color information corresponds to the container discrimination information.

39. An ink container according to claim 38, wherein the controller is configured to turn off the light emitter if (i) the control code is the turn off command and (ii) the color information is the same as the container discrimination information.

40. An ink container according to claim 38, wherein the controller is capable of continuously maintaining an on state of the light emitter from the time when the controller turns on the light emitter based on the turn on command until the controller turns off the light emitter based on the turn off command.

41. An ink container according to claim 34, wherein the controller is configured to turn on the light emitter if (i) the control code is a turn on command for turning on the light emitter and (ii) a color indicated by the color information is the same as the color indicated by the container discrimination information.

42. An ink container according to claim 41, wherein the controller is configured to turn off the light emitter if (i) the control code is a turn off command for turning off the light emitter and (ii) a color indicated by the color information is the same as the color indicated by the container discrimination information.

43. An ink container according to claim 42, wherein the controller is capable of continuously maintaining an on state of the light emitter from the time when the controller turns on the light emitter based on the turn on command until the controller turns off the light emitter based on the turn off command.

* * * * *